US009514631B2

(12) United States Patent
Matsuoka et al.

(10) Patent No.: US 9,514,631 B2
(45) **Date of Patent: *Dec. 6, 2016**

(54) MULTIPLE PROCESOR HAZARD DETECTION SYSTEM

(71) Applicant: Google Inc., Mountain View, CA (US)

(72) Inventors: Yoky Matsuoka, Palo Alto, CA (US); Anthony Michael Fadell, Portola Valley, CA (US); Matthew Lee Rogers, Los Gatos, CA (US); Jeffrey Lee, Sunnyvale, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/334,061

(22) Filed: Jul. 17, 2014

(65) Prior Publication Data

US 2015/0022345 A1 Jan. 22, 2015

Related U.S. Application Data

(60) Provisional application No. 61/847,905, filed on Jul. 18, 2013, provisional application No. 61/847,916, filed on Jul. 18, 2013, provisional application No. 61/847,937, filed on Jul. 18, 2013.

(51) Int. Cl.

| | |
|---|---|
| ***G08B 23/00*** | (2006.01) |
| ***G08B 25/00*** | (2006.01) |
| ***G08B 19/00*** | (2006.01) |
| ***G08B 29/14*** | (2006.01) |
| ***G08B 3/10*** | (2006.01) |

(Continued)

(52) U.S. Cl.

CPC ..... *G08B 25/002* (2013.01); *G08B 3/10* (2013.01); *G08B 17/10* (2013.01); *G08B 19/00* (2013.01); *G08B 25/001* (2013.01); *G08B 29/14* (2013.01); *G08B 29/20* (2013.01)

(58) Field of Classification Search

CPC ..... G08B 25/008

USPC ..... 340/514, 506, 511, 517, 3.1, 539.1,340/539.11

See application file for complete search history.

(56) References Cited

U.S. PATENT DOCUMENTS

| | | | |
|---|---|---|---|
| 4,556,873 | A | 12/1985 | Yamada et al. |
| 4,785,283 | A | 11/1988 | Yuchi |
| 5,019,805 | A | 5/1991 | Curl et al. |

(Continued)

*Primary Examiner* — Daryl Pope

(74) *Attorney, Agent, or Firm* — Van Court & Aldridge LLP

(57) ABSTRACT

Systems and methods for using multi-criteria state machines to manage alarming states and pre-alarming states of a hazard detection system are described herein. The multi-criteria state machines can include one or more sensor state machines that can control the alarming states and one or more system state machines that can control the pre-alarming states. Each state machine can transition among any one of its states based on sensor data values, hush events, and transition conditions. The transition conditions can define how a state machine transitions from one state to another. The hazard detection system can use a dual processor arrangement to execute the multi-criteria state machines according to various embodiments. The dual processor arrangement can enable the hazard detection system to manage the alarming and pre-alarming states in a manner that promotes minimal power usage while simultaneously promoting reliability in hazard detection and alarming functionality.

36 Claims, 27 Drawing Sheets

(51) Int. Cl.
*G08B 17/10* (2006.01)
*G08B 29/20* (2006.01)

(56) References Cited

U.S. PATENT DOCUMENTS

| | | | | |
|---|---|---|---|---|
| 5,400,246 | A * | 3/1995 | Wilson | G08B 25/14 340/12.53 |
| 5,736,927 | A | 4/1998 | Stebbins et al. | |
| 5,959,529 | A | 9/1999 | Kail | |
| 6,320,501 | B1 | 11/2001 | Tice et al. | |
| 6,462,652 | B1 | 10/2002 | McCuen et al. | |
| 7,158,040 | B2 | 1/2007 | Morris | |
| 7,623,028 | B2 | 11/2009 | Kates | |
| 7,690,569 | B2 | 4/2010 | Swanson et al. | |
| 8,766,807 | B2 | 7/2014 | Gonzales | |
| 8,847,772 | B2 | 9/2014 | Marks et al. | |
| 9,412,258 | B2 | 8/2016 | Matsuoka et al. | |
| 2002/0097161 | A1 | 7/2002 | Deeds | |
| 2006/0192680 | A1 | 8/2006 | Scuka et al. | |
| 2007/0194906 | A1 | 8/2007 | Sink | |
| 2008/0211678 | A1 | 9/2008 | Andres et al. | |
| 2009/0322510 | A1 * | 12/2009 | Berger | H04W 60/00 340/539.1 |
| 2010/0052903 | A1 | 3/2010 | Tiwari et al. | |
| 2012/0136485 | A1 | 5/2012 | Weber et al. | |
| 2015/0022345 | A1 | 1/2015 | Matsuoka et al. | |

* cited by examiner

| TRANSITION | FROM | TO | CONDITION SET #1 | CONDITION SET #2 | CONDITION VARIABLES |
|---|---|---|---|---|---|
| 1 | IDLE | MONITOR | SMOKE>= SMOLE_T_LOW | SAME | |
| 2 | MONITOR | ALARM | SMOKE>= SMOKE_T_CUR | SAME | |
| 3 | ALARM | HUSH | HUSH EVENT AND SMOKE< SMOKE_T_HIGH | HUSH EVENT | |
| 4 | HUSH | ALARM | (T_HUSH>= MAX_HUSH_TIME AND SMOKE>= SMOKE_T_CUR-$K_S$) OR SMOKE>= SMOKE_T_HIGH | SAME, BUT BEGIN EVALUATING AFTER T_HUSH>= MIN_HUSH_TIME | T_HUSH= AMOUNT OF TIME ELAPSED SINCE ENTERED HUSH |
| 5 | HUSH | MONITOR | (T_HUSH>= MAX_HUSH_TIME AND SMOKE<SMOKE_T_CUR- -$K_S$) OR (T_HUSH>= MIN_HUSH_TIME AND SMOKE<SMOKE_T_BASE) | SAME | T_HUSH AMOUNT OF TIME ELAPSED SINCE ENTERED HUSH |
| 6 | ALARM | MONITOR | SMOKE<SMOKE_T_CUR- -$K_S$) | SAME | |
| 7 | MONITOR | IDLE | SMOKE< SMOKE_T_BASE | SAME | |

FIG. 4B

| TRANSITION | FROM | TO | CONDITION |
|---|---|---|---|
| 1 | IDLE | ALARM | ANY BUCKET FULL |
| 2 | ALARM | HUSH | HUSH EVENT |
| 3 | HUSH | ALARM | T_HUSHED>=MIN_ALARM_HUSH_TIME AND CO>=CO_B_LOW_LEVEL |
| 4 | HUSH | IDLE | T_HUSHED>=MIN_ALARM_HUSH_TIME AND CO<C0_B_LOW_LEVEL |
| 5 | ALARM | IDLE | CO<CO_B_LOW_LEVEL |

| TRANSITION | FROM | TO | CONDITION |
|---|---|---|---|
| 1 | IDLE | ALARM | TEMP >HEAT_T_FIRST |
| 2 | ALARM | HUSH | HUSH EVENT<br>AND<br>TEMP<HEAT_T_SECOND |
| 3 | HUSH | ALARM | TEMP >HEAT_T_SECOND<br>OR<br>(T_HUSHED>=MIN_T_HUSH_TIME<br>AND<br>TEMP>HEAT_T_THIRD) |
| 4 | ALARM | IDLE | TEMP<HEAT_T_THIRD |
| 5 | HUSH | IDLE | T_HUSHED>=MIN_T_HUSH_TIME<br>AND<br>TEMP< HEAT_T_THIRD |

| TRANSITION | FROM | TO | CONDITION | CONDITION VARIABLES |
|---|---|---|---|---|
| 1 | ANYWHERE | ALARM | CONTROLLED BY SMOKE SENSOR STATE MACHINE (TRANSITION 2) | |
| 2 | MONITOR | PRE-ALARM 1 | SMOKE>=SMOKE_PA1_THRESHOLD | |
| 3 | PRE-ALARM 1 | PRE-ALARM 2 | T_PA1>=MAX_HUSH_TIME AND SMOKE>=SMOKE_PA1_THRESHOLD+$K_S$ | |
| 4 | PRE-ALARM HUSHED | PRE-ALARM 2 | T_PA_HUSHED>=MAX_HUSH_TIME AND SMOKE>=SMOKE_HUSHED+$K_S$ | SMOKE_HUSHED= OBSCURATION% WHEN INITIALLY ENTERED PRE-ALARM HUSHED |
| 5 | ALARM HUSHED | ALARM | CONTROLLED BY SMOKE SENSOR STATE MACHINE (TRANSITION 4) | |
| 6 | PRE-ALARM 1 | MONITOR | SMOKE<SMOKE_PA1_THRESHOLD- -$K_S$ AND CO<CO_B_LOW_LEVEL AND TEMP<HEAT_T_THIRD | |
| 7 | ALARM/ALARM HUSHED | HOLDING | CONTROLLED BY SMOKE SENSOR STATE MACHINE (TRANSITIONS 5 & 6) | |
| 8 | IDLE | MONITOR | SMOKE>=(SMOKE_T_CUR /2) | |
| 9 | MONITOR/ ALARM MONITOR | IDLE | CONTROLLED BY SMOKE SENSOR STATE MACHINE (TRANSITION 7) OR IMMEDIATE IF COMING FROM ALARM MONITOR | |
| 10 | PRE-ALARM 1/ PRE-ALARM 2 | PRE-ALARM HUSHED | HUSH EVENT | |
| 11 | ALARM | ALARM HUSHED | HUSH EVENT | |
| 12 | PRE-ALARM 2/ PRE-ALARM HUSHED | MONITOR | SAME AS SYSTEM STATE MACHINE TRANSITION 6 | |
| 13 | HOLDING | ALARM MONITOR | CONTROLLED BY SMOKE SENSOR STATE MACHINE (TRANSITION 7) | |

FIG. 7B

| TRANSITION | FROM | TO | CONDITION | CONDITION VARIABLES |
|---|---|---|---|---|
| 1 | ANYWHERE | ALARM | CONTROLLED BY CO SENSOR STATE MACHINE (TRANSITION 1) | |
| 2 | MONITOR | PRE-ALARM 1 | CO_Bx_TIME>=CO_Bx_PA1_TIME | Bx IS ANY ONE OF THE BUCKETS |
| 3 | PRE-ALARM 1 | PRE-ALARM 2 | T_PA1>=MIN_PA_HUSH_TIME AND THE CO_PA1_BUCKET RESPONSIBLE FOR ENTERING INTO PRE-ALARM 1 HAS FILLED UP MORE THAN X | T_PA1=AMOUNT OF TIME SPENT PA 1 STATE; X= "LEVEL" OF BUCKET WHEN ENTERED INTO PA 1 STATE |
| 4 | PRE-ALARM1/ PRE-ALARM 2 HUSHED | PRE-ALARM 2 | T_PA_HUSHED>=MIN_PA_HUSH_TIME AND THE CO_PA1_RESPONSIBLE FOR ENTERING INTO PRE=ALARM 1 HAS FILLED UP MORE THAN X | T=AMOUNT OF TIME SPENT PA HUSHED STATE; X="LEVEL" OF BUCKET WHEN ENTERED INTO PA1 STATE |
| 5 | ALARM HUSHED | ALARM | CONTROLLED BY CO SENSOR STATE MACHINE (TRANSITION 3) | |
| 6 | PRE-ALARM 1 | MONITOR | T_PA1>=MIN_PA_TO_MONITOR_TIME AND (CO_B_LOW_TIME==0 OR (CO_B_LOW_TIME<X-MIN_ALARM_ CLEAR_TIME AND CO_B_LOW_TIME<CO_$B_{LOW}$_PA1_TIME | T_PA1=AMOUNT OF TIME SPENT PA 1 STATE; X= "LEVEL" OF BUCKET WHEN ENTERED PA 1 STATE |
| 7 | ALARM | HOLDING | CONTROLLED BY CO SENSOR STATE MACHINE (TRANSITIONS 4 & 5) | |
| 8 | IDLE | MONITOR | SAME CO SYSTEM STATE MACHINE TRANSITION 2 | |

FIG. 8B-1

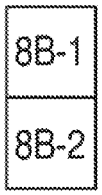

FIG. 8B

| | | | | |
|---|---|---|---|---|
| 9 | MONITOR/ ALARM MONITOR | IDLE | CO_B_LOW_TIME<45 MIN | |
| 10 | PRE-ALARM 1/ PRE-ALARM 2 | PRE-ALARM HUSHED | USER INTERACTION | |
| 11 | ALARM | ALARM HUSHED | USER INTERACTION | |
| 12 | PRE-ALARM 2/ PRE-ALARM HUSHED | MONITOR | T_PA2>=MIN_PA_TO_MONITOR_TIME AND (CO<CO_B_LOW_LEVEL*0.8) | T_PA2=AMOUNT OF TIME SPENT IN PA 2 STATE |
| 13 | HOLDING | ALARM MONITOR | T_HOLDING>=MIN_ALARM_CLEAR_TIME AND ((CO_B_LOW_TIME==0 OR (CO_B_LOW_TIME<X-MIN_ALARM_ CLEAR_TIME)) | T_HOLDING = AMOUNT OF TIME SPENT IN HOLDING STATE X="LEVEL" OF BUCKET WHEN ENTERED HUSH STATE |

FIG. 8B-2

MULTIPLE PROCESOR HAZARD DETECTION SYSTEM

CROSS-REFERENCE TO RELATED APPLICATIONS

This patent application claims priority to U.S. Provisional Patent Application No. 61/847,905, filed Jul. 18, 2013, U.S. Provisional Patent Application No. 61/847,916, filed Jul. 18, 2013, and U.S. Provisional Patent Application No. 61/847,937, filed Jul. 18, 2013. Each of the above-referenced patent applications is incorporated by reference in its entirety for all purposes.

TECHNICAL FIELD

This patent specification relates to systems and methods for controlling a hazard detection system. More particularly, this patent specification relates to systems and methods for managing alarming states and pre-alarming states of the hazard detection system.

BACKGROUND

Hazard detection systems, such as smoke detectors, carbon monoxide detectors, combination smoke and carbon monoxide detectors, as well as systems for detecting other conditions have been used in residential, commercial, and industrial settings for safety and security considerations. Many hazard detection systems operate according to a set of standards defined by a governing body (e.g., Occupational Safety and Health Administration), or companies approved to perform safety testing (e.g., Underwriters Laboratories (UL)). For example, UL defines thresholds for when a smoke detector should sound an alarm and for when a carbon monoxide detector should sound an alarm. Similar thresholds are set forth for how the alarms are expressed to occupants (e.g., as shrieking or shrill audible sounds having certain minimum loudness metrics and repetition patterns). Conventional hazard detection systems that operate solely based on these thresholds might be characterized as being relatively limited or simplistic in their modes of operation. For example, their mode of operation may be binary: either sound the alarm or do not sound the alarm, and the decision whether to sound the alarm may be based on a reading from only one type of sensor. These relatively simple and conventional systems can bring about one or more disadvantages. For example, users may be subjected to false alarms, or alarming associated with underlying causes or conditions that are not actually hazardous, that might have been avoided if there were a more complete assessment of the environment before the alarm were sounded. Alternatively, users may be subjected to certain conditions that may indeed be potentially hazardous or that may indeed be of genuine concern without the benefit of an associated alarm or warning, for the reason that while there may have been certain elevated levels of one or more hazard conditions, the binary thresholds for triggering the alarm may not have been met.

SUMMARY

Systems and methods for using multi-criteria state machines to manage alarming states and pre-alarming states of a hazard detection system are described herein. Alarming states refer to activation of an alarm, display, or other suitable mechanism to alert an occupant of a current dangerous condition. In an alarming state, a relatively loud alarm can be sounded to alert occupants. Pre-alarming states refer to activation of a speaker, display, or other suitable mechanism to warn an occupant that conditions are approaching that of alarming state conditions. In a pre-alarming state, a voice message can be played through a speaker to provide advanced warning to occupants that a dangerous condition may be imminent. In some cases, if a hazardous condition is actually present, the pre-alarm warning may be provided before the actual alarm goes off, thereby providing the occupant with additional time to take appropriate action. In other cases, the advanced warning can enable the occupant to take pre-emptive measures to prevent the actual alarm from sounding. For example, if the occupant is cooking and excessive steam and/or smoke is emanating from the kitchen, the pre-alarm warning can prompt the occupant to turn on a fan or open a window.

The multi-criteria state machines can include one or more sensor state machines and one or more system state machines. Each sensor state machine and each system state machine can be associated with a particular hazard such as, for example, a smoke hazard, a carbon monoxide hazard, or a heat hazard, and the multi-criteria state machines may leverage data acquired by one or more sensors in managing detection of a hazard. In some embodiments, a sensor state machine can be implemented for each hazard. In other embodiments, a system state machine may be implemented for each hazard or a subset of hazards. In managing detection of a hazard, each sensor state machine and each system state machine can transition among any one of its states based on sensor data values, hush events, and/or transition conditions. A hush event can be a user initiated command to hush a sounding alarm. The sensor data values, states, and transition conditions can vary from one state machine to the next.

The transition conditions can include a myriad of different conditions that may define how a state machine may transition from one state to another. The conditions may define thresholds that can be compared against any one or more of the following inputs: sensor data values, time clocks, and user interaction events (e.g., hush events). State change transitions can be governed by relatively simple conditions, referred to herein as single-criteria conditions, or relatively complex conditions, referred to herein as multi-criteria conditions. Single-criteria conditions may compare one input to one threshold. For example, a simple condition can be a comparison between a sensor data value and a threshold. If the sensor data value equals or exceeds the threshold, the state change transition may be executed. In contrast, a multi-criteria condition can be a comparison of at least one input to two or more thresholds or a comparison of two or more inputs to at least one threshold or a comparison of a first input to a first threshold and a second input to a second threshold. For example, a multi-criteria condition can be a comparison between a first sensor value and a first threshold and a comparison between a second sensor value and a second threshold. In some embodiments, both comparisons would need to be satisfied in order to effect a state change transition. In other embodiments, only one of the comparisons would need to be satisfied in order to effect a state change transition. As another example, a multi-criteria condition can be a comparison between a time clock and a time threshold and a comparison between a sensor value and a threshold.

In some embodiments, the threshold for a particular condition can be adjusted. Such thresholds are referred to herein as adjustable thresholds. Adjustable thresholds can be selected from one of at least two different selectable thresholds. Any suitable selection criteria can be used to select the appropriate threshold for the adjustable threshold. In one embodiment, the selection criteria can include several single-criteria conditions or a multi-criteria condition. In another embodiment, if the adjustable threshold is to be compared to sensor values of a first sensor, the selection criteria can include an analysis of at least one sensor other than the first sensor. For example, in one embodiment, the adjustable threshold can be the threshold used in a smoke alarm transition condition, and the adjustable threshold can be selected from one of three different thresholds. Selection of one of the three different thresholds can be based on sensor data values obtained from a carbon monoxide sensor, a heat sensor, and a humidity sensor. Thus, if evaluating the sensor data values indicate increased levels of carbon monoxide or heat, the smoke alarm threshold can be set to a lower threshold, however, if the sensor data values indicate increased humidity levels, the smoke alarm threshold can be raised to a higher threshold.

In some embodiments, the threshold for a particular transition condition can be a learned condition threshold. The learned condition threshold can be based on any suitable criteria, including, for example, heuristics, field report data, software updates, user preferences, device settings, etc. Based on these criteria, the learned condition threshold can be changed to alter trigger points for one or more pre-alarms.

The sensor state machines can be responsible for controlling relatively basic hazard detection system functions and the system state machines can be responsible for controlling relatively advanced hazard detection system functions. Each sensor state machine can be responsible for controlling an alarming state pertaining to a particular hazard and can operate independently of the other sensor state machines and the system state machines. The independent operation of each sensor state machine promotes reliability in detection and alarming for each hazard. Thus, collectively, the sensor state machines can manage the alarming states for all hazards being monitored by the hazard detection system.

In one embodiment, a smoke sensor state machine may manage the alarming state of a smoke hazard. In particular, the smoke sensor state machine can be implemented as a method in a hazard detection system including a smoke sensor, a processor, and an alarm. The method can include receiving smoke data values from the smoke sensor and receiving a hush event command. The method can include transitioning among a plurality of states based on the received smoke data values, the received hush event command, and a plurality of transition conditions, wherein the plurality of transition conditions may include a plurality of different smoke thresholds. The states can include idling, monitoring, alarming, and alarm hushing. In order for the smoke sensor state machine to effect a state transition, the smoke data values can be compared to one of the different smoke thresholds. The transition conditions can also include an adjustable alarm threshold, and the method can activate the alarm in response to the smoke data value meeting or exceeding the adjustable alarm threshold. In some embodiments, one of at least two of the different smoke thresholds can be selected as the adjustable alarm threshold.

In another embodiment, a carbon monoxide sensor state machine can control the alarming state of a carbon monoxide hazard. In particular, the carbon monoxide sensor state machine can be implemented as a method in a hazard detection system including a carbon monoxide sensor, a processor, and an alarm. The method can include receiving carbon monoxide ("CO") data values from the carbon monoxide sensor. The method can manage a plurality of CO time buckets by selectively adding and subtracting time units to one or more of the buckets based on the received CO data values, wherein each CO time bucket may include a time unit quantity, and wherein a time unit is added to one or more of the CO time buckets if the CO data value is equal to or greater than an implementation level associated with those one or more CO time buckets and a time unit is subtracted from one or more of the CO time buckets if the CO data value is less than a fraction of the implementation level associated with those one or more CO time buckets. The method can transition among a plurality of states based on the received CO data values and a plurality of transition conditions. The transition conditions can include at least one implementation level and an alarm time threshold for each CO time bucket. The method can sound the alarm if the time unit quantity of any CO time bucket meets the alarm time threshold for that CO time bucket.

In yet another embodiment, a heat sensor state machine can control the alarming state of a heat hazard. In particular, the heat sensor state machine can be implemented as a method in a hazard detection system including at least one heat sensor, a processor, and an alarm. The method can include receiving raw heat data values from the at least one heat sensor, using an acceleration function to convert the raw heat data values into scaled heat data values, and receiving a hush event command. The method can transition among a plurality of states based on the scaled heat data values, the received hush event command, and a plurality of transition conditions. The plurality of transition conditions can include several different heat thresholds. In order for the heat sensor state machine to execute a transition, the scaled data values can be compared to one of the different heat thresholds.

Each system state machine can be responsible for controlling a pre-alarming state pertaining to a particular hazard. For example, a smoke system state machine may provide pre-alarms in connection with a smoke hazard, and a carbon monoxide system state machine may provide pre-alarms in connection with a carbon monoxide hazard. In some embodiments, each system state machine can manage multiple pre-alarm states. Moreover, each system state machine can manage other states that cannot be managed by the sensor state machines. For example, these other states can include a monitoring state, a pre-alarm hushing state, and post-alarm states such as holding and alarm monitoring states.

In one embodiment, a hazard detection system can include several sensors, an alarm, a speaker, and multi-criteria state machines that may manage a plurality of states based on data acquired by at least one of the sensors and based on at least one condition parameter. The states can include at least one alarming state, which may control use of the alarm, and at least one pre-alarming state, which may control use of the speaker. The multi-criteria state machines can include at least one sensor state machine that may manage the at least one alarming state. The multi-criteria state machine can include at least one system state machine that may manage the at least one pre-alarming state.

The system state machines can co-manage one or more states with sensor state machines. These co-managed states, sometimes referred to herein as "shared states," may exist as states in both system state machines and sensor state machines for a particular hazard. For example, a smoke system state machine may share one or more states with a smoke sensor state machine, and a CO system state machine may share one or more states with a CO sensor state machine. In some embodiments, any state change transition to a shared state may be controlled by the sensor state machine. For example, the alarming state may be a shared state, and anytime a sensor state machine transitions to the alarming state, the system state machine that co-manages states with that sensor state machine also transitions to the alarming state.

In one embodiment, a hazard detection system can include at least one sensor and a sensor state machine that may be operative to transition to any one of a plurality of sensor states. The sensor state machine transitions can be based on data acquired by the at least one sensor, a first set of condition parameters, and hush events. The hazard detection system can include a system state machine that may be operative to transition to any one of a plurality of system states. The system states can include the sensor states and the system state machine transitions can be based on data acquired by the at least one sensor, the hush events, and a second set of condition parameters. The sensor states shared between the sensor state machine and the system state machine can be controlled by the sensor state machine.

The hazard detection system can use a bifurcated processor arrangement to execute the multi-criteria state machines according to various embodiments. The bifurcated processor arrangement may enable the hazard detection system to manage the multi-criteria states in a manner that promotes minimal power usage while simultaneously providing reliability in hazard detection and alarming functionalities. The system state machines can be executed by a system processor and the sensor state machines can be executed by a safety processor. Thus, in the event the system processor is in a sleep state or is not functioning (e.g., due to low power or other cause), the safety processor can still perform its hazard detection and alarming functionalities.

In one embodiment, a hazard detection system can include several sensors, including a smoke sensor, a carbon monoxide sensor, and a heat sensor, an alarm, a speaker, and a first processor that may be communicatively coupled to the sensors and the alarm. The first processor can include several sensor state machine operation conditions, wherein each of the smoke sensor, the carbon monoxide sensor, and the heat sensor may be associated with at least one alarm threshold. The first processor may be operative to acquire data values from the smoke sensor, the carbon monoxide sensor, and the heat sensor, and activate the alarm in response to determining that a data value associated with any one or more of the sensors meets or exceeds one of the sensor state machine operation conditions. The hazard detection system can include a second processor that may be communicatively coupled to the first processor and the speaker, and can include a plurality of system state machine operation conditions, including several pre-alarm thresholds. The second processor may be operative to receive the acquired data values, and playback a message using the speaker in response to determining that a received data value meets or exceeds one of the system state machine operation conditions.

The bifurcated processor arrangement further enables hazard detection systems according to various embodiments to minimize power consumption by enabling the relatively high power consuming system processor to transition between sleep and non-sleep states while the relatively low power consuming safety processor is maintained in a non-sleep state. The system processor can be kept in the sleep state until one of any number of suitable events occurs that wakes up the system processor. The safety processor can cause the system processor to wake up in response to a trigger event or a state change in a sensor state machine. Trigger events can occur when a data value associated with a sensor moves out of a trigger band associated with that sensor. A trigger band can define upper and lower boundaries of data values for each sensor and may be stored with the safety processor. The boundaries of the trigger band can be adjusted by the system processor, when it is awake, based on an operational state of the hazard detection system. The operational state can include the states of each of the system and sensor state machines, sensor data values, and other factors. The system processor may adjust the boundaries of one or more trigger bands to align with one or more system state machine states before transitioning back to sleep. Thus, by adjusting the boundaries of one more trigger bands, the system processor may effectively communicate "wake me" instructions to the safety processor.

In one embodiment, a hazard detection system can include several sensors, including a smoke sensor, a carbon monoxide sensor, and a heat sensor, a safety processor, and a system processor. The safety processor can be operative to access a trigger band of at least one of the sensors, monitor the sensors for trigger events, wherein a trigger event may occur when a data value associated with a monitored sensor moves out of the trigger band associated with that monitored sensor, and issue a signal to the system processor in response to each monitored trigger event. The system processor, responsive to the issued signal, can be operative to evaluate an operational state of the hazard detection system and selectively adjust at least one boundary of at least one trigger band based on the operational state.

A further understanding of the nature and advantages of the embodiments discussed herein may be realized by reference to the remaining portions of the specification and the drawings.

BRIEF DESCRIPTION OF THE DRAWINGS

FIG. 4B shows conditions associated with each transition of the smoke sensor state machine of FIG. 4A, according to some embodiments;

FIG. 7B shows conditions associated with each transition of the smoke system state machine of FIG. 7A, according to some embodiments;

FIGS. 8B-1 and 8B-2 show conditions associated with each transition of the CO sensor state machine of FIG. 8A, according to some embodiments;

DETAILED DESCRIPTION OF THE DISCLOSURE

In the following detailed description, for purposes of explanation, numerous specific details are set forth to provide a thorough understanding of the various embodiments. Those of ordinary skill in the art will realize that these various embodiments are illustrative only and are not intended to be limiting in any way. Other embodiments will readily suggest themselves to such skilled persons having the benefit of this disclosure.

In addition, for clarity purposes, not all of the routine features of the embodiments described herein are shown or described. One of ordinary skill in the art would readily appreciate that in the development of any such actual embodiment, numerous embodiment-specific decisions may be required to achieve specific design objectives. These design objectives will vary from one embodiment to another and from one developer to another. Moreover, it will be appreciated that such a development effort might be complex and time-consuming but would nevertheless be a routine engineering undertaking for those of ordinary skill in the art having the benefit of this disclosure.

It is to be appreciated that while one or more hazard detection embodiments are described further herein in the context of being used in a residential home, such as a single-family residential home, the scope of the present teachings is not so limited. More generally, hazard detection systems are applicable to a wide variety of enclosures such as, for example, duplexes, townhomes, multi-unit apartment buildings, hotels, retail stores, office buildings, and industrial buildings. Further, it is understood that while the terms user, customer, installer, homeowner, occupant, guest, tenant, landlord, repair person, and the like may be used to refer to the person or persons who are interacting with the hazard detector in the context of one or more scenarios described herein, these references are by no means to be considered as limiting the scope of the present teachings with respect to the person or persons who are performing such actions.

Figure 1:
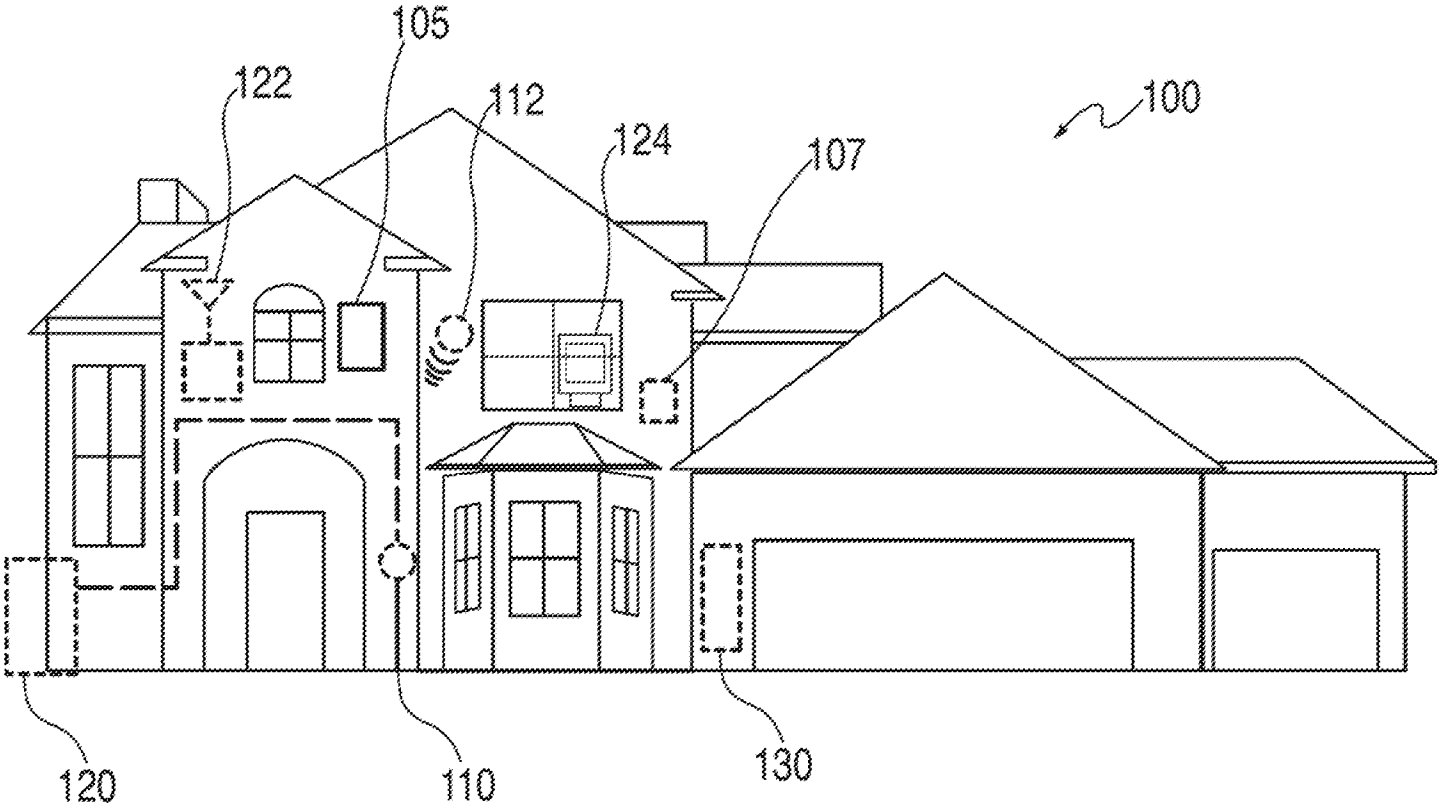
FIG. 1 is a diagram of an enclosure with a hazard detection system, according to some embodiments.

FIG. 1 is a diagram illustrating an exemplary enclosure 100 using hazard detection system 105, remote hazard detection system 107, thermostat 110, remote thermostat 112, heating, cooling, and ventilation (HVAC) system 120, router 122, computer 124, and central panel 130 in accordance with some embodiments. Enclosure 100 can be, for example, a single-family dwelling, a duplex, an apartment within an apartment building, a warehouse, or a commercial structure such as an office or retail store. Hazard detection system 105 can be battery powered, line powered, or line powered with a battery backup. Hazard detection system 105 can include one or more processors, multiple sensors, non-volatile storage, and other circuitry to provide desired safety monitoring and user interface features. Some user interface features may only be available in line powered embodiments due to physical limitations and power constraints. In addition, some features common to both line and battery powered embodiments may be implemented differently. Hazard detection system 105 can include the following components: low power wireless personal area network (LoWPAN) circuitry, a system processor, a safety processor, non-volatile memory (e.g., Flash), WiFi circuitry, an ambient light sensor (ALS), a smoke sensor, a carbon monoxide (CO) sensor, a temperature sensor, a humidity sensor, a noise sensor, one or more ultrasonic sensors, a passive infra-red (PIR) sensor, a speaker, one or more light emitting diodes (LED's), and an alarm buzzer.

Hazard detection system 105 can monitor environmental conditions associated with enclosure 100 and alarm occupants when an environmental condition exceeds a predetermined threshold. The monitored conditions can include, for example, smoke, heat, humidity, carbon monoxide, carbon dioxide, radon, and other gasses. In addition to monitoring the safety of the environment, hazard detection system 105 can provide several user interface features not found in conventional alarm systems. These user interface features can include, for example, vocal alarms, voice setup instructions, cloud communications (e.g. push monitored data to the cloud, or push notifications to a mobile telephone, or receive software updates from the cloud), device-to-device communications (e.g., communicate with other hazard detection systems in the enclosure, including the communication of software updates between hazard detection systems), visual safety indicators (e.g., display of a green light indicates it is safe and display of a red light indicates danger), tactile and non-tactile input command processing, and software updates.

It should be understood that hazard detection system 105 may be implemented as a smart home device. Thus, although the discussion of the hazard detection system is described primarily with reference to specific hazards (e.g., smoke, CO, heat), the hazard detection system may provide additional features and functionality unrelated to those hazards. For example, the hazard detection system may monitor many different conditions. These conditions can include motions, sounds, and smells. These conditions can also include data supplied by remote sensors (e.g., armbands, door sensors, window sensors, personal media devices).

Hazard detection system 105 can implement multi-criteria state machines according to various embodiments described herein to provide advanced hazard detection and advanced user interface features such as pre-alarms. In addition, the multi-criteria state machines can manage alarming states and pre-alarming states and can include one or more sensor state machines that can control the alarming states and one or more system state machines that control the pre-alarming states. Each state machine can transition among any one of its states based on sensor data values, hush events, and transition conditions. The transition conditions can define how a state machine transitions from one state to another, and ultimately, how hazard detection system 105 operates. Hazard detection system 105 can use a dual processor arrangement to execute the multi-criteria state machines according to various embodiments. The dual processor arrangement may enable hazard detection system 105 to manage the alarming and pre-alarming states in a manner that uses minimal power while simultaneously providing relatively failsafe hazard detection and alarming functionalities. Additional details of the various embodiments of hazard detection system 105 are discussed below.

Enclosure 100 can include any number of hazard detection systems. For example, as shown, hazard detection system 107 is another hazard detection system, which may be similar to system 105. In one embodiment, both systems 105 and 107 can be battery powered systems. In another embodiment, system 105 may be line powered, and system 107 may be battery powered. Moreover, a hazard detection system can be installed outside of enclosure 100.

Thermostat 110 can be one of several thermostats that may control HVAC system 120. Thermostat 110 can be referred to as the "primary" thermostat because it may be electrically connected to actuate all or part of an HVAC system, by virtue of an electrical connection to HVAC control wires (e.g. W, G, Y, etc.) leading to HVAC system 120. Thermostat 110 can include one or more sensors to gather data from the environment associated with enclosure 100. For example, a sensor may be used to detect occupancy, temperature, light and other environmental conditions within enclosure 100. Remote thermostat 112 can be referred to as an "auxiliary" thermostat because it may not be electrically connected to actuate HVAC system 120, but it too may include one or more sensors to gather data from the environment associated with enclosure 100 and can transmit data to thermostat 110 via a wired or wireless link. For example, thermostat 112 can wirelessly communicate with and cooperates with thermostat 110 for improved control of HVAC system 120. Thermostat 112 can provide additional temperature data indicative of its location within enclosure 100, provide additional occupancy information, or provide another user interface for the user (e.g., to adjust a temperature setpoint).

Hazard detection systems 105 and 107 can communicate with thermostat 110 or thermostat 112 via a wired or wireless link. For example, hazard detection system 105 can wirelessly transmit its monitored data (e.g., temperature and occupancy detection data) to thermostat 110 so that it is provided with additional data to make better informed decisions in controlling HVAC system 120. Moreover, in some embodiments, data may be transmitted from one or more of thermostats 110 and 112 to one or more of hazard detections systems 105 and 107 via a wired or wireless link.

Central panel 130 can be part of a security system or other master control system of enclosure 100. For example, central panel 130 may be a security system that may monitor windows and doors for break-ins, and monitor data provided by motion sensors. In some embodiments, central panel 130 can also communicate with one or more of thermostats 110 and 112 and hazard detection systems 105 and 107. Central panel 130 may perform these communications via wired link, wireless link, or a combination thereof. For example, if smoke is detected by hazard detection system 105, central panel 130 can be alerted to the presence of smoke and make the appropriate notification, such as displaying an indicator that a particular zone within enclosure 100 is experiencing a hazard condition.

Enclosure 100 may further include a private network accessible both wirelessly and through wired connections and may also be referred to as a Local Area Network or LAN. Network devices on the private network can include hazard detection systems 105 and 107, thermostats 110 and 112, computer 124, and central panel 130. In one embodiment, the private network is implemented using router 122, which can provide routing, wireless access point functionality, firewall and multiple wired connection ports for connecting to various wired network devices, such as computer 124. Wireless communications between router 122 and networked devices can be performed using an 802.11 protocol. Router 122 can further provide network devices access to a public network, such as the Internet or the Cloud, through a cable-modem, DSL modem and an Internet service provider or provider of other public network services. Public networks like the Internet are sometimes referred to as a Wide-Area Network or WAN.

Access to the Internet, for example, may enable networked devices such as system 105 or thermostat 110 to communicate with a device or server remote to enclosure 100. The remote server or remote device can host an account management program that manages various networked devices contained within enclosure 100. For example, in the context of hazard detection systems according to embodiments discussed herein, system 105 can periodically upload data to the remote server via router 122. In addition, if a hazard event is detected, the remote server or remote device can be notified of the event after system 105 communicates the notice via router 122. Similarly, system 105 can receive data (e.g., commands or software updates) from the account management program via router 122.

Hazard detection system 105 can operate in one of several different power consumption modes. Each mode can be characterized by the features performed by system 105 and the configuration of system 105 to consume different amounts of power. Each power consumption mode corresponds to a quantity of power consumed by hazard detection system 105, and the quantity of power consumed can range from a lowest quantity to a highest quantity. One of the power consumption modes corresponds to the lowest quantity of power consumption, and another power consumption mode corresponds to the highest quantity of power consumption, and all other power consumption modes fall somewhere between the lowest and the highest quantities of power consumption. Examples of power consumption modes can include an Idle mode, a Log Update mode, a Software Update mode, an Alarm mode, a Pre-Alarm mode, a Hush mode, and a Night Light mode. These power consumption modes are merely illustrative and are not meant to be limiting. Additional or fewer power consumption modes may exist. Moreover, any definitional characterization of the different modes described herein is not meant to be all inclusive, but rather, is meant to provide a general context of each mode.

Although one or more states of the sensor state machines and system state machines may be implemented in one or more of the power consumption modes, the power consumption modes and states may be different. For example, the power consumption mode nomenclature is used in connection with various power budgeting systems and methods that are explained in more detail in commonly assigned, U.S. Publication No. 2015/0022349 and U.S. Publication No. 2015/0021993, each of which is incorporated by reference herein in its entirety.

Figure 2:
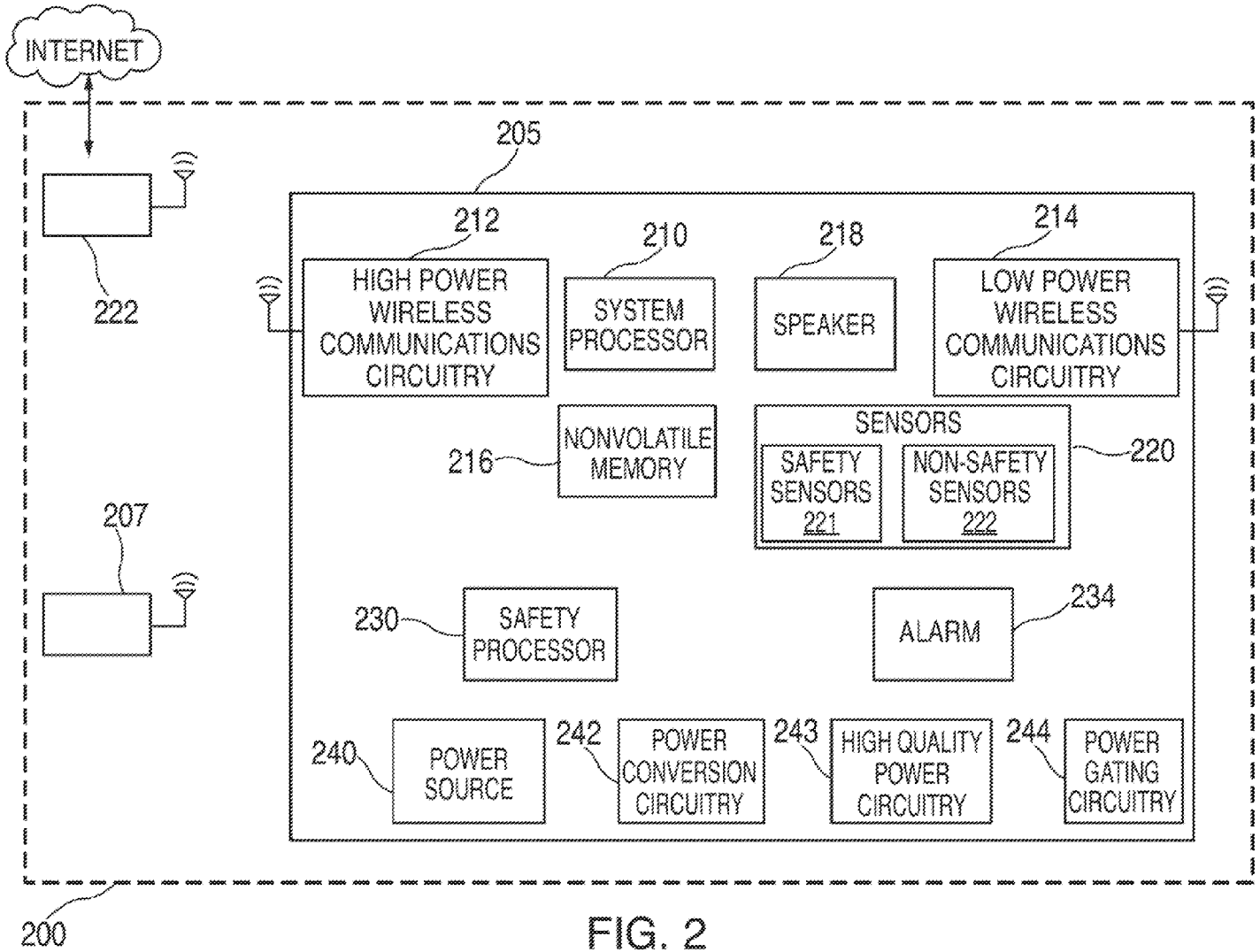
FIG. 2 shows an illustrative block diagram of a hazard detection system being used in an illustrative enclosure, according to some embodiments.

FIG. 2 shows an illustrative block diagram of hazard detection system 205 being used in an illustrative enclosure 200 in accordance with some embodiments. FIG. 2 also shows optional hazard detection system 207 and router 222. Hazard detection systems 205 and 207 can be similar to hazard detection systems 105 and 107 in FIG. 1, enclosure 200 can be similar to enclosure 100 in FIG. 1, and router 222 can be similar to router 122 in FIG. 1. Hazard detection system 205 can include several components, including system processor 210, high-power wireless communications circuitry 212 and antenna, low-power wireless communications circuitry 214 and antenna, non-volatile memory 216, speaker 218, sensors 220, which can include one or more safety sensors 221 and one or more non-safety sensors 222, safety processor 230, alarm 234, power source 240, power conversion circuitry 242, high quality power circuitry 243, and power gating circuitry 244. Hazard detection system 205 may be operative to provide failsafe safety detection features and user interface features using circuit topology and power budgeting methods that may minimize power consumption.

Hazard detection system 205 can use a bifurcated processor circuit topology for handling the features of system 205. Both system processor 210 and safety processor 230 can exist on the same circuit board within system 205, but perform different tasks. System processor 210 is a larger more capable processor that can consume more power than safety processor 230. That is, when both processors 210 and 230 are active, processor 210 consumes more power than processor 230. Similarly, when both processors are inactive, processor 210 may consume more power than processor 230. System processor 210 can be operative to process user interface features. For example, processor 210 can direct wireless data traffic on both high and low power wireless communications circuitries 212 and 214, access non-volatile memory 216, communicate with processor 230, and cause audio to be emitted from speaker 218. As another example, processor 210 can monitor data acquired by one or more sensors 220 to determine whether any actions need to be taken (e.g., shut off a blaring alarm in response to a user detected action to hush the alarm).

Safety processor 230 can be operative to handle safety related tasks of system 205, or other types of tasks that involve monitoring environmental conditions (such as temperature, humidity, smoke, carbon monoxide, movement, light intensity, etc.) exterior to the hazard detection system 205. Safety processor 230 can poll one or more of sensors 220 and activate alarm 234 when one or more of sensors 220 indicate a hazard event is detected. Processor 230 can operate independently of processor 210 and can activate alarm 234 regardless of what state processor 210 is in. For example, if processor 210 is performing an active function (e.g., performing a WiFi update) or is shut down due to power constraints, processor 230 can activate alarm 234 when a hazard event is detected. In some embodiments, the software running on processor 230 may be permanently fixed and may never be updated via a software or firmware update after system 205 leaves the factory.

Compared to processor 210, processor 230 is a less power consuming processor. Thus by using processor 230 in lieu of processor 210 to monitor a subset of sensors 220 yields a power savings. If processor 210 were to constantly monitor sensors 220, the power savings may not be realized. In addition to the power savings realized by using processor 230 for monitoring the subset of sensors 220, bifurcating the processors also ensures that the safety monitoring and core monitoring and alarming features of system 205 will operate regardless of whether processor 210 is functioning. By way of example and not by way of limitation, system processor 210 may comprise a relatively high-powered processor such as Freescale Semiconductor K60 Microcontroller, while safety processor 230 may comprise a relatively low-powered processor such as a Freescale Semiconductor KL15 Microcontroller. Overall operation of hazard detection system 205 entails a judiciously architected functional overlay of system processor 210 and safety processor 230, with system processor 210 performing selected higher-level, advanced functions that may not have been conventionally associated with hazard detection units (for example: more advanced user interface and communications functions; various computationally-intensive algorithms to sense patterns in user behavior or patterns in ambient conditions; algorithms for governing, for example, the brightness of an LED night light as a function of ambient brightness levels; algorithms for governing, for example, the sound level of an onboard speaker for home intercom functionality; algorithms for governing, for example, the issuance of voice commands to users; algorithms for uploading logged data to a central server; algorithms for establishing network membership; algorithms for facilitating updates to the programmed functionality of one or more elements of the hazard detection system 205 such as the safety processor 230, the high power wireless communications circuitry 212, the low power wireless communications circuitry 214, the system processor 210 itself, etc., and so forth), and with safety processor 230 performing the more basic functions that may have been more conventionally associated with hazard detection units (e.g., smoke and CO monitoring, actuation of shrieking/buzzer alarms upon alarm detection). By way of example and not by way of limitation, system processor 210 may consume on the order of 18 mW when it is in a relatively high-power active state and performing one or more of its assigned advanced functionalities, whereas safety processor 230 may only consume on the order of 0.05 mW when it is performing its basic monitoring functionalities. However, again by way of example and not by way of limitation, system processor 210 may consume only on the order of 0.005 mW when in a relatively low-power inactive state, and the advanced functions that it performs are judiciously selected and timed such that the system processor is in the relatively high power active state only about 0.05% of the time, and spends the rest of the time in the relatively low-power inactive state. Safety processor 230, while only requiring an average power draw of 0.05 mW when it is performing its basic monitoring functionalities, should of course be performing its basic monitoring functionalities 100% of the time. According to one or more embodiments, the judiciously architected functional overlay of system processor 210 and safety processor 230 is designed such that hazard detection system 205 can perform basic monitoring and shriek/buzzer alarming for hazard conditions even in the event that system processor 210 is inactivated or incapacitated, by virtue of the ongoing operation of safety processor 230. Therefore, while system processor 210 is configured and programmed to provide many different capabilities for making hazard detection unit 205 an appealing, desirable, updatable, easy-to-use, intelligent, network-connected sensing and communications node for enhancing the smart-home environment, its functionalities are advantageously provided in the sense of an overlay or adjunct to the core safety operations governed by safety processor 230, such that even in the event there are operational issues or problems with system processor 210 and its advanced functionalities, the underlying safety-related purpose and functionality of hazard detector 205 by virtue of the operation of safety processor 230 will continue on, with or without system processor 210 and its advanced functionalities.

High power wireless communications circuitry 212 can be, for example, a Wi-Fi module capable of communicating according to any of the 802.11 protocols. For example, circuitry 212 may be implemented using WiFi part number BCM43362, available from Murata. Depending on an operating mode of system 205, circuitry 212 can operate in a low power "sleep" state or a high power "active" state. For example, when system 205 is in an Idle mode, circuitry 212 can be in the "sleep" state. When system 205 is in a non-Idle mode such as a Wi-Fi update mode, software update mode, or alarm mode, circuitry 212 can be in an "active" state. For example, when system 205 is in an active alarm mode, high power circuitry 212 may communicate with router 222 so that a message can be sent to a remote server or device.

Low power wireless communications circuitry 214 can be a low power Wireless Personal Area Network (6LoWPAN) module or a ZigBee module capable of communicating according to a 802.15.4 protocol. For example, in one embodiment, circuitry 214 can be part number EM357 SoC available from Silicon Laboratories. Depending on the operating mode of system 205, circuitry 214 can operate in a relatively low power "listen" state or a relatively high power "transmit" state. When system 205 is in the Idle mode, WiFi update mode (which may require use of the high power communication circuitry 212), or software update mode, circuitry 214 can be in the "listen" state. When system 205 is in the Alarm mode, circuitry 214 can transmit data so that the low power wireless communications circuitry in system 207 can receive data indicating that system 205 is alarming. Thus, even though it is possible for high power wireless communications circuitry 212 to be used for listening for alarm events, it can be more power efficient to use low power circuitry 214 for this purpose. Power savings may be further realized when several hazard detection systems or other systems having low power circuitry 214 form an interconnected wireless network.

Power savings may also be realized because in order for low power circuitry 214 to continually listen for data transmitted from other low power circuitry, circuitry 214 may constantly be operating in its "listening" state. This state consumes power, and although it may consume more power than high power circuitry 212 operating in its sleep state, the power saved versus having to periodically activate high power circuitry 214 can be substantial. When high power circuitry 212 is in its active state and low power circuitry 214 is in its transmit state, high power circuitry 212 can consume substantially more power than low power circuitry 214.

In some embodiments, low power wireless communications circuitry 214 can be characterized by its relatively low power consumption and its ability to wirelessly communicate according to a first protocol characterized by relatively low data rates, and high power wireless communications circuitry 212 can be characterized by its relatively high power consumption and its ability to wirelessly communicate according to a second protocol characterized by relatively high data rates. The second protocol can have a much more complicated modulation than the first protocol.

In some embodiments, low power wireless communications circuitry 214 may be a mesh network compatible module that does not require an access point or a router in order to communicate to devices in a network. Mesh network compatibility can include provisions that enable mesh network compatible modules to keep track of other nearby mesh network compatible modules so that data can be passed through neighboring modules. Mesh network compatibility is essentially the hallmark of the 802.15.4 protocol. In contrast, high power wireless communications circuitry 212 is not a mesh network compatible module and requires an access point or router in order to communicate to devices in a network. Thus, if a first device having circuitry 212 wants to communicate data to another device having circuitry 212, the first device has to communicate with the router, which then transmits the data to the second device. Thus, there is no device-to-device communication per se when circuitry 212 requires use of a router. In other embodiments, circuitry 212 can perform device-to-device communication using a Wi-Fi Direct communications protocol. The Wi-Fi Direct communications standard can enable devices to connect easily with each other without requiring a router. For example, an exemplary use of Wi-Fi Direct can enable hazard detection system 105 to directly communicate with thermostat 110.

Non-volatile memory 216 can be any suitable permanent memory storage such as, for example, NAND Flash, a hard disk drive, NOR, ROM, or phase change memory. In one embodiment, non-volatile memory 216 can store audio clips that can be played back by speaker 218. The audio clips can include installation instructions or warnings in one or more languages. Speaker 218 can be any suitable speaker operable to playback sounds or audio files. Speaker 218 can include an amplifier (not shown).

Sensors 220 can be monitored by system processor 210 and safety processor 230, and can include safety sensors 221 and non-safety sensors 222. One or more of sensors 220 may be exclusively monitored by one of system processor 210 and safety processor 230. As defined herein, monitoring a sensor refers to a processor's ability to acquire data from that monitored sensor. That is, one particular processor may be responsible for acquiring sensor data, and possibly storing it in a sensor log, but once the data is acquired, it can be made available to another processor either in the form of logged data or real-time data. For example, in one embodiment, system processor 210 may monitor one of non-safety sensors 222, but safety processor 230 cannot monitor that same non-safety sensor. In another embodiment, safety processor 230 may monitor each of the safety sensors 221, but may provide the acquired sensor data to system processor 210.

Safety sensors 221 can include sensors necessary for ensuring that hazard detection system 205 can monitor its environment for hazardous conditions and alert users when hazardous conditions are detected, and all other sensors not necessary for detecting a hazardous condition are non-safety sensors 222. In some embodiments, safety sensors 221 include only those sensors necessary for detecting a hazardous condition. For example, if the hazardous condition includes smoke and fire, then the safety sensors might only include a smoke sensor and at least one heat sensor. Other sensors, such as non-safety sensors, could be included as part of system 205, but might not be needed to detect smoke or fire. As another example, if the hazardous condition includes carbon monoxide, then the safety sensor might be a carbon monoxide sensor, and no other sensor might be needed to perform this task.

Thus, sensors deemed necessary can vary based on the functionality and features of hazard detection system 205. In one embodiment, hazard detection system 205 can be a combination smoke, fire, and carbon monoxide alarm system. In such an embodiment, detection system 205 can include the following necessary safety sensors 221: a smoke detector, a carbon monoxide (CO) sensor, and one or more heat sensors. Smoke detectors can detect smoke and typically use optical detection, ionization, or air sampling techniques. A CO sensor can detect the presence of carbon monoxide gas, which, in the home, is typically generated by open flames, space heaters, water heaters, blocked chimneys, and automobiles. The material used in electrochemical CO sensors typically has a 5-7 year lifespan. Thus, after a 5-7 year period has expired, the CO sensor should be replaced. A heat sensor can be a thermistor, which is a type of resistor whose resistance varies based on temperature. Thermistors can include negative temperature coefficient (NTC) type thermistors or positive temperature coefficient (PTC) type thermistors. Furthermore, in this embodiment, detection system 205 can include the following non-safety sensors 222: a humidity sensor, an ambient light sensor, a push-button sensor, a passive infra-red (PIR) sensor, and one or more ultrasonic sensors. A temperature and humidity sensor can provide relatively accurate readings of temperature and relative humidity. An ambient light sensor (ALS) can detect ambient light and the push-button sensor can be a switch, for example, that detects a user's press of the switch. A PIR sensor can be used for various motion detection features. A PIR sensor can measure infrared light radiating from objects in its field of view. Ultrasonic sensors can be used to detect the presence of an object. Such sensors can generate high frequency sound waves and determine which wave(s) are received back by the sensor. Sensors 220 can be mounted to a printed circuit board (e.g., the same board that processors 210 and 230 may be mounted to), a flexible printed circuit board, a housing of system 205, or a combination thereof.

In some embodiments, data acquired from one or more non-safety sensors 222 can be acquired by the same processor used to acquire data from one or more safety sensors 221. For example, safety processor 230 may be operative to monitor both safety and non-safety sensors 221 and 222 for power savings reasons, as discussed above. Although safety processor 230 may not need any of the data acquired from non-safety sensor 222 to perform its hazard monitoring and alerting functions, the non-safety sensor data can be utilized to provide enhanced hazard system 205 functionality. The enhanced functionality can be realized in alarming algorithms according to various embodiments discussed herein. For example, the non-sensor data can be utilized by system processor 210 to implement system state machines that may interface with one or more sensor state machines, all of which are discussed in more detail below in connection with the description accompanying FIGS. 3-23.

Alarm 234 can be any suitable alarm that alerts users in the vicinity of system 205 of the presence of a hazard condition. Alarm 234 can also be activated during testing scenarios. Alarm 234 can be a piezo-electric buzzer, for example.

Power source 240 can supply power to enable operation of system 205 and can include any suitable source of energy. Embodiments discussed herein can include AC line powered, battery powered, a combination of AC line powered with a battery backup, and externally supplied DC power (e.g., USB supplied power). Embodiments that use AC line power, AC line power with battery backup, or externally supplied DC power may be subject to different power conservation constraints than battery only embodiments. Battery powered embodiments are designed to manage power consumption of its finite energy supply such that hazard detection system 205 operates for a minimum period of time. In some embodiments, the minimum period of time can be one (1) year, three (3) years, or seven (7) years. In other embodiments, the minimum period of time can be at least seven (7) years, eight (8) years, nine (9) years, or ten (10) years. Line powered embodiments are not as constrained because their energy supply is virtually unlimited. Line powered with battery backup embodiments may employ power conservation methods to prolong the life of the backup battery.

In battery only embodiments, power source 240 can include one or more batteries or a battery pack. The batteries can be constructed from different compositions (e.g., alkaline or lithium iron disulfide) and different end-user configurations (e.g., permanent, user replaceable, or non-user replaceable) can be used. In one embodiment, six cells of Li—$FeS_2$ can be arranged in two stacks of three. Such an arrangement can yield about 27000 mWh of total available power for system 205.

Power conversion circuitry 242 includes circuitry that converts power from one level to another. Multiple instances of power conversion circuitry 242 may be used to provide the different power levels needed for the components within system 205. One or more instances of power conversion circuitry 242 can be operative to convert a signal supplied by power source 240 to a different signal. Such instances of power conversion circuitry 242 can exist in the form of buck converters or boost converters. For example, alarm 234 may require a higher operating voltage than high power wireless communications circuitry 212, which may require a higher operating voltage than processor 210, such that all required voltages are different than the voltage supplied by power source 240. Thus, as can be appreciated in this example, at least three different instances of power conversion circuitry 242 are required.

High quality power circuitry 243 is operative to condition a signal supplied from a particular instance of power conversion circuitry 242 (e.g., a buck converter) to another signal. High quality power circuitry 243 may exist in the form of a low-dropout regulator. The low-dropout regulator may be able to provide a higher quality signal than that provided by power conversion circuitry 242. Thus, certain components may be provided with "higher" quality power than other components. For example, certain safety sensors 221 such as smoke detectors and CO sensors may require a relatively stable voltage in order to operate properly.

Power gating circuitry 244 can be used to selectively couple and de-couple components from a power bus. De-coupling a component from a power bus insures that the component does not incur any quiescent current loss, and therefore can extend battery life beyond that which it would be if the component were not so de-coupled from the power bus. Power gating circuitry 244 can be a switch such as, for example, a MOSFET transistor. Even though a component is de-coupled from a power bus and does not incur any current loss, power gating circuitry 244 itself may consume a finite amount of power. This finite power consumption, however, is less than the quiescent power loss of the component.

It is understood that although hazard detection system 205 is described as having two separate processors, system processor 210 and safety processor 230, which may provide certain advantages as described hereinabove and hereinbelow, including advantages with regard to power consumption as well as with regard to survivability of core safety monitoring and alarming in the event of advanced feature provision issues, it is not outside the scope of the present teachings for one or more of the various embodiments discussed herein to be executed by one processor or by more than two processors.

Figure 3:
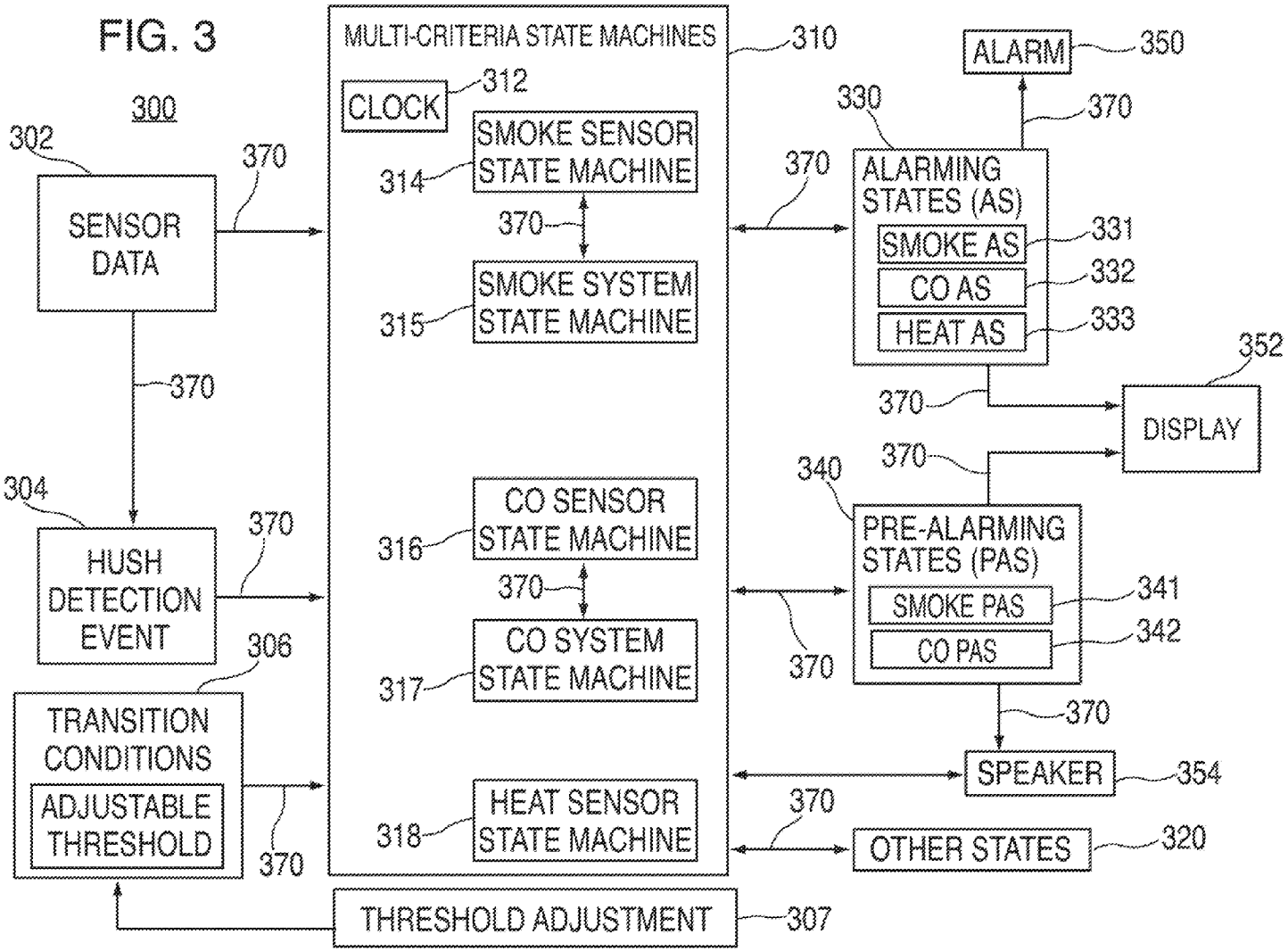
FIG. 3 shows an illustrative block diagram showing various components of a hazard detection system working together to provide multi-criteria alarming and pre-alarming functionality, according to some embodiments.

FIG. 3 shows an illustrative block diagram showing various components of hazard detection system 300 working together to provide multi-criteria alarming and pre-alarming functionalities according to various embodiments. As shown, system 300 can include sensor data 302, hush detection events 304, transition conditions 306, threshold adjustment parameter 307, multi-criteria state machines 310, clock 312, other states 320, alarming states 330, pre-alarming states 340, alarm 350, display 352, and speaker 354. Also shown are several communication links 370, each of which may have unidirectional or bidirectional data and/or signal communications capabilities. Multi-criteria state machines 310 can control alarming states 330, pre-alarming states 340, and all other state machine states 320 based on sensor data 302, hush detection events 304, transition conditions 306, clock 312, and other criteria, and alarming and pre-alarming states 330 and 340 can control the output of alarm 350, display 352, and speaker 354. Alarming states 330 can include multiple alarming states (e.g., one for each hazard, such as smoke alarming state 331, CO alarming state 332, and heat alarming state 333) and pre-alarming states 340 can include multiple pre-alarming states (e.g., one or more for each hazard, such as smoke pre-alarming state 341 and CO pre-alarming state 342. Other states can include, for example, idling states, monitoring states, alarm hushing states, pre-alarm hushing states, post-alarm states, holding states, and alarm monitoring states.

Alarming states 330 can control activation and deactivation of alarm 350 and display 352 in response to determinations made by multi-criteria state machines 310. Alarm 350 can provide audible cues (e.g., in the form of buzzer beeps) that a dangerous condition is present. Display 352 can provide a visual cue (e.g., such as flashing light or change in color) that a dangerous condition is present. If desired, alarming states 330 can control playback of messages over speaker 354 in conjunction with the audible and/or visual cues. For example, combined usage of alarm 350 and speaker 354 can repeat the following sequence: "BEEP, BEEP, BEEP—Smoke Detected In Bedroom—BEEP BEEP BEEP," where the "BEEPS" emanate from alarm 350 and "smoke detected in bedroom" emanates from speaker 354. As another example, usage of alarm 350 and speaker 354 can repeat the following sequence: "BEEP, BEEP, BEEP—Wave to Hush Alarm—BEEP BEEP BEEP," in which speaker 354 is used to provide alarming hush instructions. Any one of the alarming states 330 (e.g., smoke alarm state 331, CO alarm state 332, and heat alarm state 333) can independently control alarm 350 and/or display 352 and/or speaker 354. In some embodiments, alarming states 330 can cause alarm 350 or display 352 or speaker 354 to emit different cues based on which specific alarm state is active. For example, if a smoke alarm state is active, alarm 350 may emit a sound having a first characteristic, but if a CO alarm state is active, alarm 350 may emit a sound having a second characteristic. In other embodiments, alarming states 330 can cause alarm 350 and display 352 and speaker 354 to emit the same cue regardless of which specific alarm state is active.

Pre-alarming states 340 can control activation and deactivation of speaker 354 and display 352 in response to determinations made by multi-criteria state machines 310. Pre-alarming can serve as a warning that a dangerous condition may be imminent. Speaker 354 may be utilized to playback voice warnings that a dangerous condition may be imminent. Different pre-alarm messages may be played back over speaker 354 for each type of detected pre-alarm event. For example, if a smoke pre-alarm state is active, a smoke related message may be played back over speaker 354. If a CO pre-alarm state is active, a CO related message may be played back. Furthermore, different messages may be played back for each one of the multiple pre-alarms associated with each hazard (e.g., smoke and CO). For example, the smoke hazard may have two associated pre-alarms, one associated with a first smoke pre-alarming state (e.g., suggesting that an alarming state may be moderately imminent) and another one associated with a second smoke pre-alarming state (e.g., suggesting that an alarming state may be highly imminent). Pre-alarm messages may also include voice instructions on how to hush pre-alarm messages. Display 352 may also be utilized in a similar fashion to provide visual cues of an imminent alarming state. In some embodiments, the pre-alarm messages can specify the location of the pre-alarming conditions. For example, if hazard system 300 knows it is located in the bedroom, it can incorporate the location in the pre-alarm message: "Smoke Detected In Bedroom."

Hazard detection system 300 can enforce alarm and pre-alarm priorities depending on which conditions are present. For example, if elevated smoke and CO conditions exist at the same time, the smoke alarm state and/or pre-alarm smoke state may take precedence over the CO alarm state and/or CO pre-alarm state. If a user silences the smoke alarm or smoke pre-alarm, and the CO alarm state or CO pre-alarm state is still active, system 300 may provide an indication (e.g., a voice notification) that a CO alarm or pre-alarm has also been silenced. If a smoke condition ends and the CO alarm or pre-alarm is event is still active, the CO alarm or pre-alarm may be presented to the user.

Multi-criteria state machines 310 can transition to an idling state when it determines that relatively little or no dangerous conditions exist. The idling state can enforce a relatively low level of hazard detection system activity. For example, in the idle state, the data sampling rates of one or more sensors may be set at relatively slow intervals. Multi-criteria state machines 310 can transition to a monitoring state when it determines that sensor data values have risen to a level that warrants closer scrutiny, but not to a level that transitions to a pre-alarming or alarming state. The monitoring state can enforce a relatively high level of hazard detection system activity. For example, the data sampling rates of one or more sensors may be set at relatively fast intervals. In addition, the data sampling rates of one or more sensors may be set at relatively fast intervals for alarming states 330, pre-alarming states 340, or both.

Alarm hushing and pre-alarm hushing states may refer to a user-instructed deactivation of an alarm or a pre-alarm. For example, in one embodiment, a user can press a button (not shown) to silence an alarm or pre-alarm. In another embodiment, a user can perform a hush gesture in the presence of the hazard detection system. A hush gesture can be a user initiated action in which he or she performs a gesture (e.g., a wave motion) in the vicinity of system 300 with the intent to turn off or silence a blaring alarm. One or more ultrasonic sensors, a PIR sensor, or a combination thereof can be used to detect this gesture. The gesture hush feature and systems and methods for detecting and processing the gesture hush feature are discussed in more detail in co-pending, commonly assigned U.S. Publication No. 2015/0029019, the disclosure of which is incorporated by reference herein its entirety.

Post-alarming states may refer to states that multi-criteria state machines 310 can transition to after having been in one of alarming states 330 or one of pre-alarming states 340. In one post-alarming state, hazard detection system 300 can provide an "all clear" message to indicate that the alarm or pre-alarm condition is no longer present. This can be especially useful, for example, for CO because humans cannot detect CO. Another post-alarming state can be a holding state, which can serve as a system debounce state. This state can prevent hazard detection system 300 from immediately transitioning back to a pre-alarming state 340 after having just transitioned from an alarming state 330.

Multi-criteria state machines 310 can include several different state machines: sensor state machines and system state machines. Each state machine can be associated with a particular hazard such as, for example, a smoke hazard, a carbon monoxide hazard, or a heat hazard, and the multi-criteria state machines may leverage data acquired by one or more sensors in managing detection of a hazard. In some embodiments, a sensor state machine can be implemented for each hazard. In other embodiments, a system state machine may be implemented for each hazard or a subset of hazards. The sensor state machines can be responsible for controlling relatively basic hazard detection system functions and the system state machines can be responsible for controlling relatively advanced hazard detection system functions. In managing detection of a hazard, each sensor state machine and each system state machine can transition among any one of its states based on sensor data 302, hush events 304, and transition conditions 306. A hush event can be a user initiated command to hush, for example, a sounding alarm or pre-alarm voice instruction.

Transition conditions 306 can include a myriad of different conditions that may define how a state machine transitions from one state to another. Each state machine can have its own set of transition conditions, and examples of state machine specific transition conditions can be found in FIGS. 4B, 5B, 6B, 7B, and 8B. The conditions can define thresholds that may be compared against any one or more of the following inputs: sensor data values, time clocks, and user interaction events (e.g., hush events). State change transitions can be governed by relatively simple conditions (e.g., single-criteria conditions), or relatively complex conditions (e.g., multi-criteria conditions). Single-criteria conditions may compare one input to one threshold. For example, a simple condition can be a comparison between a sensor data value and a threshold. If the sensor data value equals or exceeds the threshold, the state change transition may be executed. In contrast, a multi-criteria condition can be a comparison of one or more inputs to one or more thresholds. For example, a multi-criteria condition can be a comparison between a first sensor value and a first threshold and a comparison between a second sensor value and a second threshold. In some embodiments, both comparisons would need to be satisfied in order to effect a state change transition. In other embodiments, only one of the comparisons would need to be satisfied in order to effect a state change transition. As another example, a multi-criteria condition can be a comparison between a time clock and a time threshold and a comparison between a sensor value and a threshold.

In some embodiments, the threshold for a particular transition condition can be adjusted. Such thresholds are referred to herein as adjustable thresholds (e.g., shown as part of transition conditions 306). The adjustable threshold can be changed in response to threshold adjustment parameter 307, which may be provided, for example, by an alarm threshold setting module according to an embodiment. Adjustable thresholds can be selected from one of at least two different selectable thresholds, and any suitable selection criteria can be used to select the appropriate threshold for the adjustable threshold. In one embodiment, the selection criteria can include several single-criteria conditions or a multi-criteria condition. In another embodiment, if the adjustable threshold is compared to sensor values of a first sensor, the selection criteria can include an analysis of at least one sensor other than the first sensor. In another embodiment, the adjustable threshold can be the threshold used in a smoke alarm transition condition, and the adjustable threshold can be selected from one of three different thresholds.

In some embodiments, the threshold for a particular transition condition can be a learned condition threshold (not shown). The learned condition threshold can be the result of a difference function, which may subtract a constant from an initial threshold. The constant can be changed, if desired, based on any suitable number of criteria, including, for example, heuristics, field report data, software updates, user preferences, device settings, etc. Changing the constant can provide a mechanism for changing the transition condition for one or more states (e.g., a pre-alarming state). This constant can be provided to transition conditions 306 to make adjustments to the learned condition threshold. In one embodiment, the constant can be selected based on installation and setup of hazard detection system 300. For example, the home owner can indicate that hazard detection system 300 has been installed in a particular room of an enclosure. Depending on which room it is, system 300 can select an appropriate constant. For example, a first constant can be selected if the room is a bedroom and a second constant can be selected if the room is a kitchen. The first constant may be a value that makes hazard detection system 300 more sensitive to potential hazards than the second constant because the bedroom is in a location that is generally further away from an exit and/or is not generally susceptible to factors that may otherwise cause a false alarm. In contrast, the kitchen, for example, is generally closer to an exit than a bedroom and can generate conditions (e.g., steam or smoke from cooking) that may cause a false alarm. Other installation factors can also be taken into account in selecting the appropriate constant. For example, the home owner can specify that the room is adjacent to a bathroom. Since humidity stemming from a bathroom can cause false alarms, hazard system 300 can select a constant that takes this into account. As another example, the home owner can specify that the room includes a fireplace. Similarly, hazard system 300 can select a constant that takes this factor into account.

In another embodiment, hazard detection system 300 can apply heuristics to self-adjust the constant. For example, conditions may persist that keep triggering pre-alarms, but the conditions do not rise to alarming levels. In response to such persistent pre-alarm triggering, hazard detection system 300 can modify the constant so that the pre-alarms are not so easily triggered. In yet another embodiment, the constant can be changed in response to a software update.

For example, a remote server may analyze data acquired from several other hazard detection systems and adjust the constant accordingly, and push the new constant to hazard detection system 300 via a software update. In addition, the remote server can also push down constants based on user settings or user preferences to hazard detection system 300. For example, the home owner may be able to define a limited number of settings by directly interacting with hazard detection system 300. However, the home owner may be able to define an unlimited number of settings by interacting with, for example, a web-based program hosted by the remote server. Based on the settings, the remote server can push down one or more appropriate constants.

The sensor state machines can control alarming states 330 and one or more of other states 320. In particular, smoke sensor state machine 314 can control smoke alarm state 331, CO sensor state machine 316 can control CO alarming state 332, and heat sensor state machine 318 can control heat alarming state 333. For example, smoke sensor state machine 314 may be operative to sound alarm 350 in response to a detected smoke event. As another example, CO sensor state machine 316 can sound alarm 350 in response to a detected CO event. As yet another example, heat sensor state machine 318 can sound alarm 350 in response to a detected heat event. In some embodiments, a sensor state machine can exercise exclusive control over one or more alarming states 330.

The system state machines can control pre-alarming states 340 and one or more of other states 320. In particular, smoke system state machine 315 may control smoke pre-alarm state 341, and CO system state machine 317 may control CO pre-alarm state 342. In some embodiments, each system state machine can manage multiple pre-alarm states. For example, a first pre-alarm state may warn a user that an abnormal condition exists, and a second pre-alarm state may warn the user that the abnormal condition continues to exist. Moreover, each system state machine can manage other states that cannot be managed by the sensor state machines. For example, these other states can include a monitoring state, a pre-alarm hushing state, and post-alarm states such as holding and alarm monitoring states.

The system state machines can co-manage one or more states with sensor state machines. These co-managed states ("shared states") can exist as states in both system and sensor state machines for a particular hazard. For example, smoke system state machine 315 may share one or more states with smoke sensor state machine 314, and CO system state machine 317 may share one or more states with CO sensor state machine 316. The joint collaboration between system and sensor state machines for a particular hazard is shown by communications link 370, which connects the two state machines. In some embodiments, any state change transition to a shared state may be controlled by the sensor state machine. For example, the alarming state may be a shared state, and anytime a sensor state machine transitions to the alarming state, the system state machine that co-manages states with that sensor state machine may also transition to the alarming state. In some embodiments, shared states can include idling states, alarming states, and alarm hushing states. The parameters by which multi-criteria state machines 310 may function are discussed in more detail in connection with the description accompanying FIGS. 4A-8B, below.

Figure 4A:
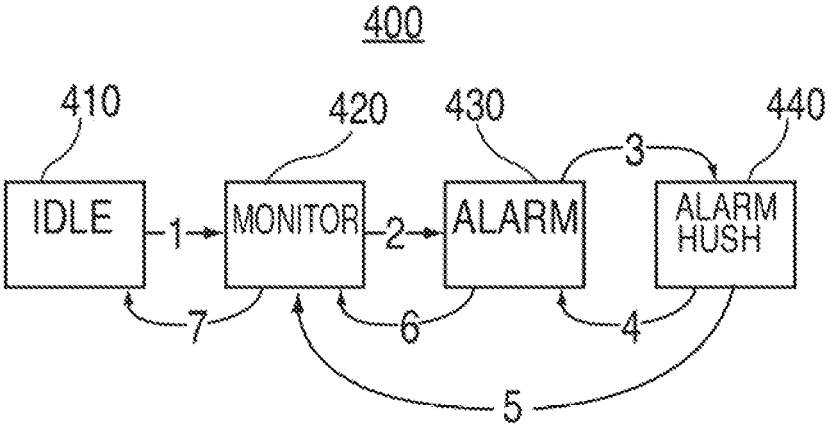
FIG. 4A shows an illustrative smoke sensor state machine, according to some embodiments.

FIG. 4A shows an illustrative smoke sensor state machine 400 according to an embodiment. For example, smoke sensor state machine 400 can be one of the multi-criteria state machines (of FIG. 3) that manages a smoke detector. Smoke sensor state machine 400 can include idle state 410, monitor state 420, alarm state 430, and alarm hush state 440. State machine 400 can transition between states 410, 420, 430, and 440 based on one or more conditions. As shown, seven (7) different state transitions can exist in state machine 400. FIG. 4B shows the conditions associated with each transition. In particular, FIG. 4B includes several columns of information labeled as Transition, From, To, Condition Set #1, Condition Set #2, and Condition Variables. Each row corresponds to one of the transitions of FIG. 4A, identifies the "From" state and the "To" state, and one or more conditions that may need to be met in order for the transition to take place, and the condition variables, if any. Two condition sets, condition set #1 and condition set #2, are shown to illustrate that different conditions can be imposed on state machine 400. Condition set #1 may apply to a first geographic region such as the United States and condition set #2 may apply to a second geographic region such as Europe. Referring collectively to FIGS. 4A and 4B, each transition is discussed, primarily in reference with condition set #1.

In transition 1, state machine 400 transitions from idle state 410 to monitor state 420 when the monitored smoke data value (referred to herein as "Smoke") is greater than or equal to a relatively low smoke alarm threshold value (referred to herein as Smoke_T_Low). The monitored smoke data value can be measured in terms of obscuration percentage or dBm. More particularly, the monitored smoke data value can be a measure of obscuration percentage per meter (e.g., obs % /meter), obscuration per foot (e.g., obs % /foot) or dBm per meter (e.g., obs %/meter). Obscuration is the effect that smoke has on reducing sensor "visibility," where higher concentrations of smoke result in higher obscuration levels. dBm is a sensitivity measurement of a smoke sensor.

A smoke sensor can include a photoelectric smoke chamber, which may be dark inside and which may include vents that permit air to enter and exit. The chamber can include a laser diode that may transmit an infrared beam of light across the chamber in a particular direction. The chamber can also include a sensor that may operate to 'see' the light. When there is no smoke in the chamber, the beam of light may just get absorbed and the sensor may not 'see' any light. However, when smoke enters the chamber, the particulate of the smoke can cause the light to scatter and thereby cause some light to hit the sensor. The amount of light sensed by the sensor can be directly proportional to the obscuration value: the more light, the higher the obscuration. At 100% obscuration, the chamber may be filled with smoke, and a substantial amount of light may be hitting the sensor. At 0%, there may be no smoke in the chamber and no light may reach the sensor. Per UL requirements for sounding an alarm, anything that exceeds 4% may be considered an alarm condition.

The relatively low smoke alarm threshold value, Smoke_T_Low, can be one of several smoke alarm threshold values. Other smoke alarm values can include base level smoke alarm threshold level, Smoke_T_Base, relatively moderate smoke alarm threshold level, Smoke_T_Mid, and relatively high smoke alarm threshold level, Smoke_T_High. Each of these smoke alarm values can be accessible by smoke state machine 400 when making state machine transition decisions. For example, Smoke_T_Base can define to a smoke threshold for exiting an alarm state, and Smoke_T_Low, Smoke_T_Mid, and Smoke_T_High can define thresholds for triggering an alarm. Table 1, below, shows illustrative values associated with each smoke alarm threshold.

TABLE 1

| Level | Condition Set #1 - (OBS %/m) | Condition Set #2 - (dBm/m) |
|---|---|---|
| Smoke_T_Base | 0.8-1.0 | 0.05 |
| Smoke_T_Low | 2.0-2.2 | 0.07 |
| Smoke_T_Mid | 2.5-2.7 | 0.11 |
| Smoke_T_High | 3.6-3.7 | 0.18 |

In monitor state 420, the hazard detection system may poll several of its sensors at a faster rate than it was in idle state 410. For example, instead of polling the smoke sensor (e.g., smoke sensor 1324) every 10 seconds, it may poll the smoke sensor every 2 seconds. Faster polling can enable the hazard detection system to acquire data at a faster rate so that it can more quickly make an informed decision on whether to sound the alarm.

In transition 2, state machine 400 transitions from monitor state 420 to alarm state 430 when Smoke is greater than or equal to the currently selected smoke alarm threshold, Smoke_T_Cur. The currently selected smoke alarm threshold can be set to any one of the smoke alarm threshold values (e.g., Smoke_T_Base, Smoke_T_Low, Smoke_T_Mid, or Smoke_T_High). In one embodiment, Smoke_T_Cur can be set to Smoke_T_Low, Smoke_T_Mid, or Smoke_T_High by alarm/pre-alarm threshold setting module 900, discussed below. In another embodiment, Smoke_T_Cur can be set to Smoke_T_Low as a default setting unless alarm/pre-alarm threshold setting module 900 instructs state machine 400 otherwise.

In transition 3, and according to condition set #1, state machine 400 transitions from alarm state 430 to alarm hush state 440 when a hush event is detected and Smoke is less than Smoke_T_High. The hush event may be a gesture recognized hush event processed by hush module 1307 (discussed below in connection with FIGS. 13 and 15) or a button press event of button 1340 (discussed below in connection with FIGS. 13 and 15). If Smoke is greater than or equal to Smoke_T_High, then state machine 400 remains in alarm state 430. According to condition set #2, only a hush event need be detected in order to effect transition 3. Thus, even if Smoke is greater than Smoke_T_High, the detected hush event is sufficient to silence the alarm.

In transition 4, and according to condition set #1, state machine 400 can transition from alarm hush state 440 to alarm state 430 when Smoke is greater than or equal to Smoke_T_High. This particular condition requires that state machine 400 be in alarm state 440 if the monitored smoke data value exceeds the relatively high smoke alarm threshold level, regardless of whether a hush event is detected. Thus, the alarm will continue to sound if Smoke exceeds Smoke_T_High and a hush event is detected. Also, according to condition set #1, state machine 400 can transition from alarm hush state 440 to alarm state 430 when the time elapsed since entering state 440 (hereinafter T_Hush) is greater than or equal to a maximum allowable hush time period (hereinafter Max_Hush_Time) and Smoke is greater than or equal to Smoke_T_Cur minus a constant, $K_s$. This condition can cover the situation where the Smoke level has not decreased by a predetermined amount after a predetermined period of time has elapsed. Alternatively, state machine 400 can transition from alarm hush state 440 to alarm state 430 when the time elapsed since entering state 440 (hereinafter T_Hush) is greater than or equal to a maximum allowable hush time period (hereinafter Max_Hush_Time) and Smoke is greater than or equal to Smoke_T_Base. According to condition set #2, state machine 400 is essentially the same as condition set #1, but forces the alarm to be silenced for a minimum allowable hush time period (herein after Min_Hush_Time). Only after T_Hush exceeds (or equals) Min_Hush_Time can state machine 400 evaluate the conditions to make a potential state change transition.

$K_s$ is the constant used in determining a learned condition threshold. As discussed above, $K_s$ can be changed based on any suitable number of factors. For example, $K_s$ can be changed based on learned device behavior. Learned device behavior can be based on one hazard detection device or an aggregate of hazard detection devices. It will be appreciate that $K_s$ can be set to zero.

In transition 5, state machine 400 can transition from alarm hush state 440 to monitor state 420 when T_Hush is greater than or equal to Max_Hush_Time and Smoke is less than Smoke_T_Cur minus $K_s$. This covers the condition where the Smoke level decreased by a predetermined amount after a first predetermined period of time has elapsed. State machine 400 can also transition from alarm hush state 440 to monitor state 430 when T_Hush is greater than or equal to Min_Hush_Time and Smoke is less than Smoke_T_Base. This can cover the condition where the Smoke level decreased to an extremely low level after a second predetermined period of time has elapsed.

In transition 6, state machine 400 can transition from alarm state 430 to monitor state 420 when smoke is less than Smoke_T_Cur minus $K_s$, or alternatively, when smoke is less than Smoke_T_Base. In transition 7, state machine 400 can transition from monitor state 420 to idle state 410 when Smoke is less than Smoke_T_Base.

As known in the art, because of the way CO harms the human body only upon build-up over a period of time, CO detectors may not operate by simple thresholding of a measured CO level condition. Instead, CO detectors may work on a time-integral methodology in which different "time buckets" begin to fill when the CO level rises above certain thresholds, and then a CO alarm may only be sounded when there has been sustained CO levels for certain periods of time. In some embodiments, the time buckets can empty when the CO level falls below certain thresholds. These CO "time buckets" are shown in Table 2, below. Table 2 has several columns including Bucket, U.S. Regulation Level (ppm), U.S. Implementation level (ppm), U.S. Pre-Alarm Time (min), U.S. Alarm Time (min), Europe Regulation Level (ppm), Europe Implementation Level (ppm), Europe Pre-Alarm Time (min), and Europe Time (min). The U.S. parameters are shown grouped together as condition 1 and the Europe parameters are shown grouped together as condition 2. There are four CO time buckets: CO_B_Low, CO_B_Mid, CO_B_High, and CO_B_VeryHigh. The U.S. and Europe Regulation Level (ppm) columns define government mandated threshold for managing the different CO time buckets. For example, for CO_B_Low bucket, this bucket should begin to fill when CO levels exceed 70+/−5 ppm for the U.S. and 50 ppm for Europe.

TABLE 2

| | Condition Set #1 - U.S. | | | | Condition Set #2 - Europe | | | |
|---|---|---|---|---|---|---|---|---|
| Bucket | Reg. (ppm) | Imp. (ppm) | PA Time (min) | Alarm Time (min) | Reg. (ppm) | Imp. (ppm) | PA Time (min) | Alarm Time (min) |
| CO_B_Low | 70 ± 5 | 58 | 63 | 120 | 50 | 48 | 63 | 75 |
| CO_B_Mid | 150 ± 5 | 131 | 13 | 30 | 100 | 98 | 13 | 25 |
| CO_B_High | 400 ± 5 | 351 | 7 | 10 | 300 | 298 | 1 | 2 |
| CO_B_VH | 1000 | 675 | 0.5 | 1 | 1000 | 748 | 0.5 | 1 |

The U.S. and Europe Implementation Level (ppm) may define hazard detection system implementation thresholds for managing the different CO buckets, according to embodiments discussed herein. As shown, the implementation levels can be set to thresholds that are more conservative than the government mandated levels. For example, the implementation level for the CO_B_Low bucket can be initially set to a value below the minimum U.S. Regulation value such as value of 64 or less. In addition, a variable safety factor (not shown) can be incorporated into a function used to define the implementation levels so that the implementation level can be changed, for example, once the hazard detection device enters the field. The function can be a subtraction function that reduces an initial level by a certain percentage. For example, an initial implementation level may be selected that satisfies the government regulation level, and this initial level can be reduced by a percentage. As a specific example, for the U.S. CO_B_Low bucket, the initial implementation level can be set to 65 and the reduction percentage can be set to 10%. The resultant implementation level is 58: 65-10% of 65=58.

During operation, the CO time buckets can be managed by selectively adding and subtracting time units to one or more of the buckets based on the CO data values received from a CO sensor. Time units can be represented by any suitable time factor, such as minutes or hours. For ease of discussion, assume that time units are in minutes. A time unit quantity indicates the number of time units that are in a CO time bucket. In some embodiments, the time unity quantity for each CO bucket may be initially set to zero (0), and the time unit quantity does not drop below zero (0), nor does it increase above the alarm time designated for that particular CO time bucket. A time unit can be added to one or more of the CO time buckets if the CO data value is equal to or greater than the implementation level associated with that CO time bucket. For example, assuming the implementation level for the CO_B_Low bucket is 58, a time unit is added to the CO_B_Low bucket for each minute the CO level meets or exceeds 58. A time unit may be subtracted from one or more of the CO time buckets if the CO data value is less than a fraction of the implementation level associated with each CO time bucket. For example, if CO<CO_B_X_Level−(CO_B_X_Level*0.2), where CO_B_X_Level is the time unit quantity for CO time bucket X, and where X is one of the four time buckets, a time unit can be subtracted from time bucket X. Buckets may not be cleared to zero.

The U.S. and EU Alarm Times are time values that can define when an alarm should be sounded for a particular bucket. Thus, when the time unit quantity of one CO time bucket equals or exceeds the alarm time for that CO time bucket, the alarm can be activated. These alarm time parameters are generally defined by a government entity or other official safety organization. For example, regarding U.S. conditions, if monitored CO levels have exceeded 80 ppm for more than 120 minutes, an alarm should be sounded because the CO_B_Low bucket has filled up (i.e., the time unit quantity for the low CO bucket is 120). As another example, regarding U.S. conditions, if monitored CO levels exceed 450 ppm for more than 50 minutes, the CO_B_Mid and CO_B_High buckets may be filled. The CO_B_Low bucket may or may not be filled depending on CO levels prior to the 50 minute time period in which CO levels exceeded 450 ppm.

The U.S. and Europe Pre-Alarm Time parameters can define when a pre-alarm should be sounded for a particular bucket. Thus, when the time unit quantity of one CO time bucket equals or exceeds the pre-alarm time for that CO time bucket, a pre-alarm can be activated (e.g., as discussed below in connection with FIGS. 8A and 8B). These parameters can be set to thresholds below the U.S. and Europe Alarm Time parameters so that the pre-alarm may be sounded before the actual alarm is sounded. It is understood that while the U.S. and Europe Regulation Levels and Alarm Times are substantially fixed parameters, the parameters associated with the U.S. and Europe Implementation levels and the pre-alarm hush times are illustrative.

The CO time buckets can maintain their respective time unit quantity even after a time unit quantity reaches its alarm time parameter. This is in contrast to conventional CO detectors that simply "flush" their buckets and start all over again. Maintaining the time unit quantities throughout the alarming process, and not "flushing" the buckets, may be much more appropriate for safety reasons, because the human body certainly does not "flush" its CO levels upon hearing an alarm and then hushing it. Thus, in a hypothetical scenario in which there is a persistent level (say "70") of CO in the room, then for a conventional CO alarm that is silenced by the user, it may take over an hour until it alarms again, even though the CO continues to build up in the blood. Thus, based on the operation of the CO sensor state machine according to embodiments discussed, even after a hushing event, it may be the case that the CO alarm continues to sound, because this may be the right thing to do for the health of the occupant.

Figures 5A, 5B:
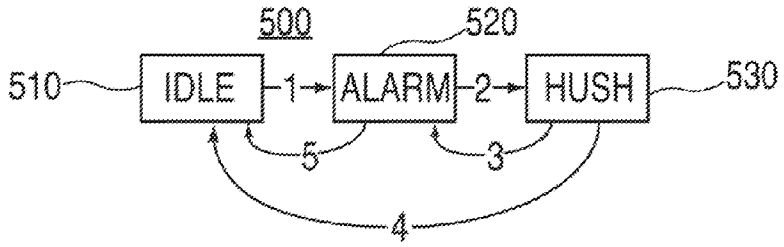
FIG. 5A shows an illustrative CO sensor state machine, according to some embodiments.
FIG. 5B shows conditions associated with each transition of the CO sensor state machine of FIG. 5A, according to some embodiments.

FIG. 5A shows an illustrative CO sensor state machine 500 according to an embodiment. CO sensor state machine 500 can include idle state 510, alarm state 520, and hush state 530. State machine 500 can transition between states 510, 520, and 530 based on one or more conditions. As shown, five (5) different state transitions can exist in state machine 500. FIG. 5B shows the conditions associated with each transition. In particular, FIG. 5B includes several columns of information labeled as Transition, From, To, and Condition. Each row corresponds to one of the transitions of FIG. 5A, identifies the "From" state and the "To" state, and one or more conditions that may need to be met in order for the transition to take place. The transitions of state machine 500 are now discussed with reference to FIGS. 5A and 5B.

In transition 1, state machine 500 can transition from idle state 510 to alarm state 520 when any CO bucket is full. Referring to Table 2, above, a CO bucket is full when the monitored CO data value (referred to herein as "CO") exceeds the implementation threshold for a time duration exceeding the alarm time. The monitored CO data value can be a raw data value or a filtered data value. In transition 2, state machine 500 can transition from alarm state 520 to hush state 530 in response to a detected hush event. The detected hush event can be a gesture hush or a button press.

In transition 3, state machine 500 can transition from hush state 530 to alarm state 520 if the hush time duration (referred to herein as "T_Hushed") is greater than or equal to a minimum hush time duration (referred to herein as "Min_Alarm_Hush_Time") and the monitored CO level (CO) is greater than or equal to a minimum CO threshold (referred to herein as "CO_B_Low_Level"). In one embodiment, CO_B_Low_Level is the implementation level of the CO_B_Low bucket.

In transition 4, state machine 500 can transition from hush state 530 to idle state 510 if the hush time duration (T_Hushed) is greater than or equal to the minimum hush time duration (Min_Alarm_Hush_Time) and the monitored CO level is less than the minimum CO threshold (CO_B_Low_Level). In transition 5, state machine 500 can transition from alarm state 520 to idle state 510 if the monitored CO level is less than the minimum CO threshold CO_B_Low_Level.

Figures 6A, 6B:
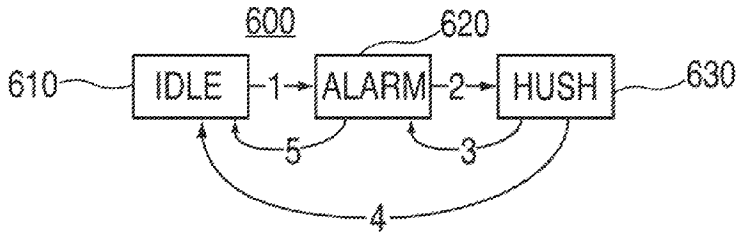
FIG. 6A shows an illustrative heat sensor state machine, according to some embodiments.
FIG. 6B shows conditions associated with each transition of the heat sensor state machine of FIG. 6A, according to some embodiments.

FIG. 6A shows an illustrative heat sensor state machine 600 according to an embodiment. Heat sensor state machine 600 can include idle state 610, alarm state 620, and hush state 630. State machine 600 can transition between states 610, 620, and 630 based on one or more conditions. As shown, five (5) different state transitions can exist in state machine 600. FIG. 6B shows the conditions associated with each transition. In particular, FIG. 6B includes several columns of information labeled as Transition, From, To, and Condition. Each row corresponds to one of the transitions of FIG. 5A, identifies the "From" state and the "To" state, and one or more conditions that may need to be met in order for the transition to take place. The transition between states is discussed in reference to FIGS. 6A and 6B.

In transition 1, state machine 600 transitions from idle state 610 to alarm state 620 when a heat data value (referred to herein as "Temp") is greater than a first heat alarm threshold value (referred to herein as "Heat_T_First"). In one embodiment, the heat data value can be a monitored heat value measured directly from a heat sensor (e.g., temperature sensor 1326) within the hazard detection system. In another embodiment, the heat data value can be a function of the monitored heat value. The function can apply an accelerated temperature algorithm to the monitored heat value to produce an estimate of the actual temperature of the region surrounding the hazard detection system. The application of such an algorithm can compensate for a temperature sensor's relatively slow rise time in response to monitored changes in temperature. Additional details on this algorithm are discussed below.

In transition 2, state machine 600 can transition from alarm state 620 to hush state 630 when Temp is less than a second heat alarm threshold (referred to herein as "Heat_T_Second") and a hush event is detected. Heat_T_Second can have a higher value than Heat_T_First. In transition 3, state machine 600 can transition from hush state 630 to alarm state 620 when the Temp is greater than Heat_T_Second. State machine 600 can also transition from hush state 630 to alarm state 620 when the hush time duration (referred to herein as "T_Hushed") is equal to or greater than a minimum hush duration (referred to herein as "Min_T_Hush_Time") and the Temp is greater than a third heat alarm threshold (referred to herein as "Heat_T_Third). The third heat alarm threshold is less than the first heat alarm threshold.

In transition 4, state machine 600 can transition from hush state 630 to idle state 610 when Temp is less than Heat_T_Third. In transition 5, state machine 600 can transition from alarm state 620 to idle state 610 when T_Hushed is equal to or greater than Min_T_Hush_Time and the Temp is less than Heat_T_Third.

As discussed above, an accelerated temperature algorithm can be used to estimate the actual temperature being sensed by a temperature sensor. In some embodiments, the raw temperature data may be acquired by a NTC thermistor at regular intervals (e.g., every second or every other second). The acquired raw data may be provided to a single-pole infinite impulse response low pass filter to obtain a filter data reading. The filtered data reading can be obtained using the following equation (1):

$$y_i=\alpha x_i+(1-\alpha)y_{i-1} \tag{1}$$

where $y_i$ is a filtered value, $\alpha$ is a smoothing factor, $x_i$ is raw data received from the sensor, and $y_{i-1}$ is the previously filtered value. The smoothing factor, by definition, may exist between $0\leq\alpha\leq1$. In particular a may be defined the by the following equation (2):

$$\alpha=\frac{\Delta_T}{RC+\Delta_T} \tag{2}$$

where RC may be defined by the following equation (3):

$$RC=\Delta_T\left(\frac{1-\alpha}{\alpha}\right). \tag{3}$$

In one embodiment, when $\Delta_T$ is 1 second, $\alpha$ can be 0.01. The accelerated temperature can be calculated based on the following equation (4):

$$\text{Accelerated_Temp}_i=y_i+(x_i-y_i)*\text{Gain} \tag{4}$$

where the Gain may be 10. It is understood that, in some embodiments, the accelerated temperature can be the parameter used by other state machines and modules. For example, smoke sensor state machine 400 can use the accelerated temperature in transition 6. As another example, alarm threshold setting module 900 (discussed below) can use the accelerated temperature.

In some embodiments, additional conditions can be imposed on heat sensor state machine 600. For example, state machine 600 can transition from any state to alarm state 620 if a rate of change of Temp meets or exceeds a predetermined rate of change threshold. The predetermined rate of change threshold can be, for example, a six degree change per minute. In other embodiments, data values acquired from two or more heat sensors can be used by state machine 600. For example, an average or median of the data values acquired by two or more heat sensors can be used as the Temp parameter in FIG. 6B. The two or more heat sensors can be of the same type (e.g., two thermistor type heat sensors) or different types. As another example, data values from two heat sensors may be compared against each other and if the difference between the two exceeds a predetermined number, state machine 600 may be temporarily disabled.

Figure 7A:
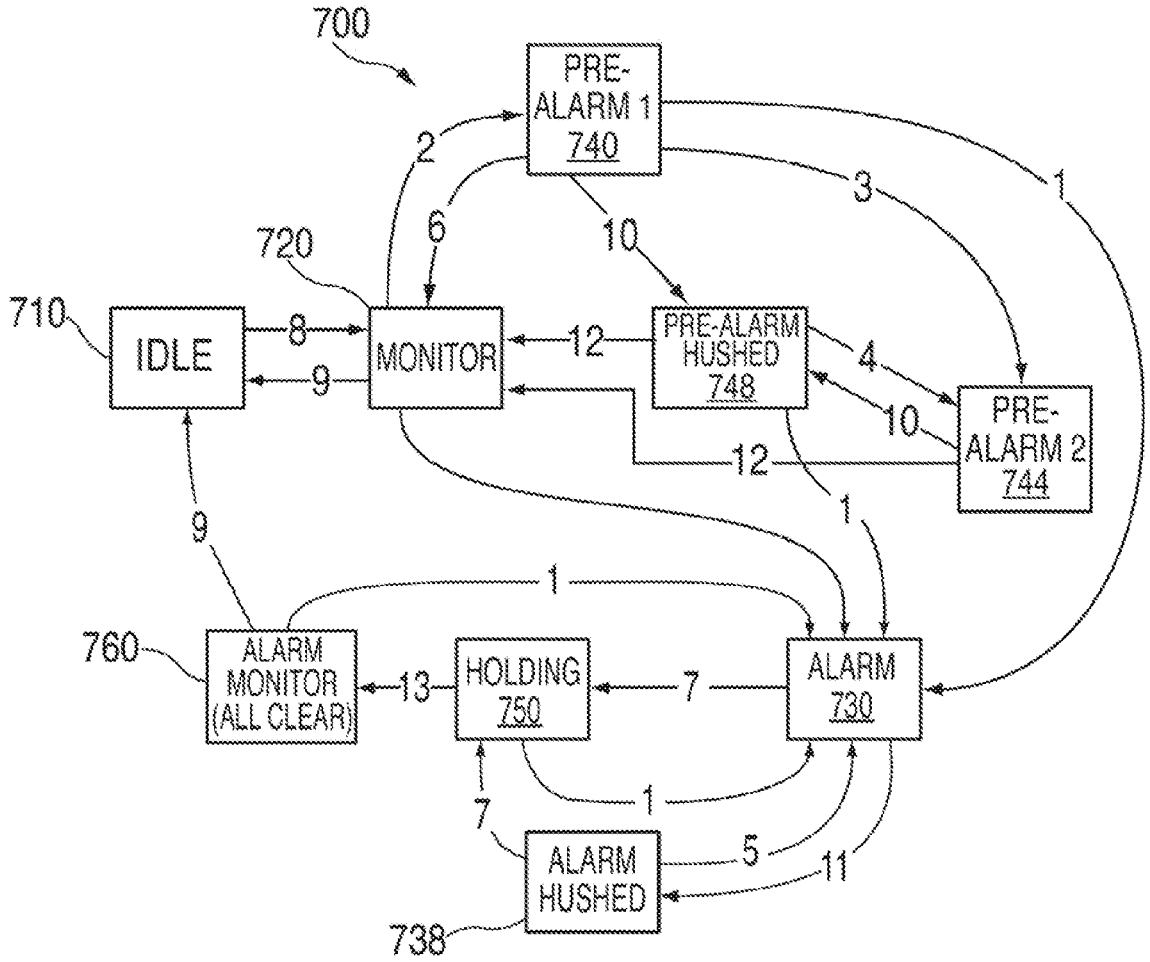
FIG. 7A shows an illustrative smoke system state machine, according to some embodiments.

FIG. 7A shows illustrative smoke system state machine 700 according to an embodiment. Smoke system state machine 700 can include idle state 710, monitor state 720, alarm state 730, alarm hushed state 738, first pre-alarm state 740, second pre-alarm state 744, pre-alarm hushed state 748, holding state 750, and alarm monitor state 760. It is understood that additional states may be incorporated into state machine 700 and/or that one or more states can be omitted. State machine 700 can transition among these states based on conditions set forth in FIG. 7B, according to an embodiment. FIG. 7B includes several columns of information labeled as Transition, From, To, Condition, and Condition Variables. Each row corresponds to one of the transitions of FIG. 7A, identifies the "From" state and the "To" state, and one or more conditions that may need to be met in order for the transition to take place, and the condition variables, if any. Reference will be made to FIGS. 7A and 7B collectively in the following discussion.

Smoke system state machine 700 can permit smoke sensor state machine 400 to control one or more of its state transitions. In particular, smoke sensor state machine 400 can control smoke system state machine 700's transitions to idle state 710, alarm state 730, holding state 750, and alarm monitor state 760. This shared arrangement permits smoke sensor state machine 400 to control the smoke detector's alarming state and permits smoke system state machine 700 to control the pre-alarming states. Thus, regardless of which non-alarm state (e.g., first pre-alarm state 740, pre-alarm hushed state 748, etc.) smoke system state machine 700 is in, smoke sensor state machine 400 can cause the alarm to sound if the monitored smoke levels exceed the smoke alarm threshold.

In transition 1, smoke system state machine 700 can transition from any state to alarm state 730 when Smoke is greater than or equal to Smoke_T_Cur. This transition is controlled by transition 2 of smoke sensor state machine 400 (as discussed above).

In transition 2, smoke system state machine 700 can transition from monitor state 720 to first pre-alarm state 740 when Smoke is greater than or equal to a first pre-alarm threshold (referred to herein as "Smoke_PA1_Threshold"). Smoke_PA1_Threshold may be determined by alarm/pre-alarm threshold setting module 1312, which is discussed in more detail below. First pre-alarm state 740 can represent a condition in which elevated smoke levels are detected, but at a level less than that required to sound the alarm. In this state, smoke system state machine 700 can playback a warning over a speaker (e.g., speaker 354) or cause a display (e.g., display 352) to flash. In transition 3, smoke system state machine 700 can transition from first pre-alarm state 740 to second pre-alarm state 744 when elapsed time since entering first pre-alarm state 740 (referred to herein as "T_PA1") equals or exceeds a maximum hush time threshold (referred to herein as "Max_Hush_Time") and Smoke is greater than or equal to Smoke_PA1_Threshold plus a constant, $K_s$. Second pre-alarm state 744 can represent a condition in which very elevated smoke levels are detected. Such a smoke level may be greater than that smoke level in first pre-alarm state 740, but may be less than that required to sound the alarm. In this state, state machine 700 may playback another message over the speaker and/or flash different lights.

In transition 4, state machine 700 can transition from pre-alarm hushed state 748 to second pre-alarm state 744 when elapsed time since entering pre-alarm hushed state 748 (referred to herein as "T_PA_Hushed") equals or exceeds the Max_Hush_Time and Smoke is greater than or equal to Smoke_Hushed plus $K_s$, where Smoke_Hushed is the Smoke level when state machine 700 initially transitioned to pre-alarm hushed state 748.

In transition 5, state machine 700 can transition from alarm hushed state 738 to alarm state 730 when a condition of smoke sensor state machine 400 transition 4 is satisfied. See the conditions of transition 4 in FIG. 4B as discussed above.

In transitions 6 and 12, state machine 700 can transition from first pre-alarm state 740 or from second pre-alarm state 744 to monitor state 720 or from pre-alarm hushed state 748 to monitor state 720 when (1) Smoke is less than Smoke_PA1_Threshold minus $K_s$ and (2) CO is less than the CO_B_Low_Level and (3) Temp is less than third heat threshold, which is less than the first heat threshold.

In transition 7, state machine 700 can transition from alarm state 730 or alarm hushed state 738 to holding state 750 when the conditions of either transitions 5 or 6 of smoke sensor state machine 400 are satisfied. See conditions of transitions 5 and 6 in FIG. 4B as discussed above. If the hazard detection system has experienced an alarm event, and conditions exist that enable it to safely exit from alarm state 730 or alarm hushed state 738, state machine 700 may transition to holding state 750. Holding state 750 can serve as a de-bounce state to prevent activation of a pre-alarm (e.g., either first or second pre-alarms).

In transition 8, state machine 700 can transition from idle state 710 to monitor state 720 when Smoke is greater than or equal to one half of Smoke_T_Cur. In monitor state 720, state machine 700 may instruct the hazard detection system to increase the sampling rate of one more sensors. Alternatively, transition 8 may be controlled by transition 2 of smoke state machine 400.

In transition 9, state machine 700 can transition from monitor state 720 to idle state 710 when the condition of transition 7 of smoke sensor state machine 400 is satisfied. In addition, state machine 700 can automatically transition from alarm monitor state 760 to idle state 710 immediately after state machine 700 transitions to alarm monitor state 760. In alarm monitor state 760, state machine 700 may playback a "condition cleared" message via a speaker. The "condition cleared" message can indicate, for example, that the smoke levels are no longer detected to be at anomalous levels.

In transition 10, state machine 700 can transition from first pre-alarm state 740 or from second pre-alarm state 744 to pre-alarm hushed state 748 in response to a detected hush event. In transition 11, state machine 700 can transition from alarm state 730 to alarm hushed state 738 in response to a detected hush event. In transition 13, state machine 700 can transition from holding state 750 to alarm monitor state 760 when the condition of transition 7 of smoke sensor state machine 400 is satisfied.

Figure 8A:
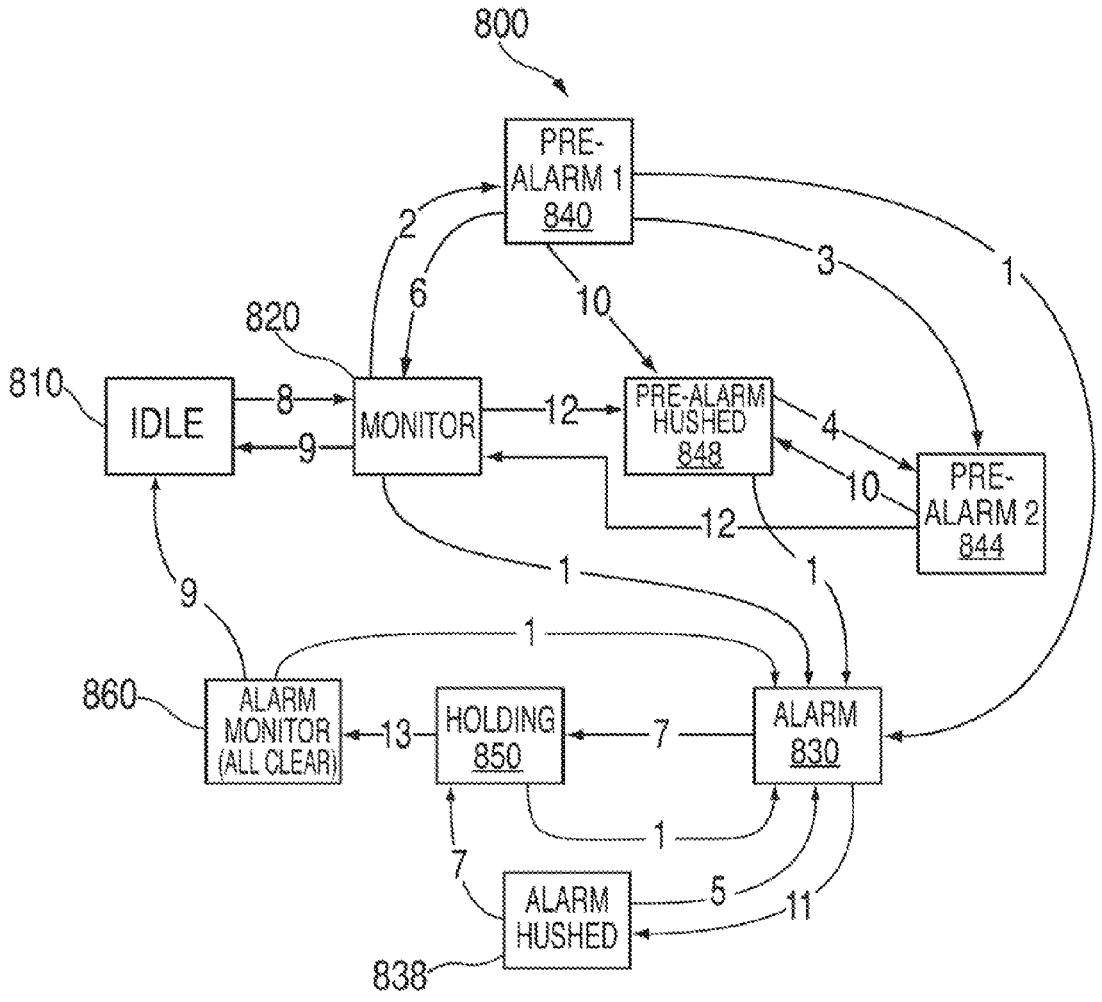
FIG. 8A shows an illustrative CO system state machine, according to some embodiments.

FIG. 8A shows illustrative CO system state machine 800 according to an embodiment. CO system state machine 800 can include idle state 810, monitor state 820, alarm state 830, alarm hushed state 838, first pre-alarm state 840, second pre-alarm state 844, pre-alarm hushed state 848, holding state 850, and alarm monitor state 860. It is understood that additional states may be incorporated into state machine 800 and that one or more states can be omitted. CO state machine 800 can embody many or all of the same states as smoke system state machine 700, and any action executed by the hazard detection system in response to entering any one of CO states can be similar to the action taken by the hazard detection system in response to entering any one of the smoke states. Thus, definitions applied to various smoke system sensor states are applicable to CO system sensor states. For example, if either Smoke system state machine 700 or CO system state machine 800 go into an alarm state, the hazard detection system will sound the alarm. The alarm may be characterized as a CO alarm if the CO state machine goes to alarm, or the alarm may be characterized as a smoke alarm if the smoke state machine goes to alarm, or the alarm may be characterized as both smoke and CO alarms if both the smoke and CO state machines go into alarm. Similarly, as another example, if either state machine goes to a pre-alarm state, the hazard detection system can playback a pre-alarm message. The message can be generic or it can be specific to the system state machine that entered into the pre-alarm state. Although many of the CO system states may be the same as the smoke system states, the transitions between those states are based on different conditions. In particular, state machine 800 can transition among states based on conditions set forth in FIG. 8B, according to an embodiment. FIG. 8B includes several columns of information labeled as Transition, From, To, Condition, and Condition Variables. Each row corresponds to one of the transitions of FIG. 8A, identifies the "From" state and the "To" state, and one or more conditions that may need to be met in order for the transition to take place, and the condition variables, if any. Reference will be made to FIGS. 8A and 8B collectively in the following discussion.

CO system state machine 800 can permit CO sensor state machine 500 to control one or more of its state transitions. In particular, CO sensor state machine 500 can control CO system state machine 800's transitions to alarm state 830 and holding state 850. This shared arrangement permits CO sensor state machine 500 to control the CO detector's alarming state and permits CO system state machine 800 to control the pre-alarms. Thus, regardless of which non-alarm state (e.g., first pre-alarm state 840, pre-alarm hushed state 848, etc.) CO system state machine 800 is in, CO sensor state machine 500 can cause the alarm to sound if the monitored CO levels exceed the CO alarm threshold.

In transition 1, CO system state machine 800 can transition from any state to alarm state 830 when the condition of transition 1 of CO sensor state machine 500 is satisfied. This transition is controlled by transition 1 of CO sensor state machine 500 (as discussed above). As defined herein, CO_Bx_Time, is the current time level of the CO_Bx bucket, where Bx denotes a particular bucket. As defined herein, CO_Bx_Level, is the implementation level for the bucket corresponding to Bx. For example, referring to Table 2 (above), if Bx is High, then CO_Bx_Level is 388. Continuing with this example, if CO_Bx_Time is 433, then CO_B_High bucket is full.

In transition 2, CO system state machine 800 can transition from monitor state 820 to first pre-alarm state 840 when any one of the CO buckets fills up to a time value (CO_Bx_Time) that meets or exceeds its respective pre-alarm bucket threshold (referred to herein as "CO_Bx_PA1_Time"), where Bx denotes one of the buckets. This same condition can also control transition 8, in which state machine 800 transitions from idle mode 810 to monitor mode 820. The parameters of the pre-alarm CO buckets are shown in Table 2 (above) in the PA Time columns for conditions 1 and 2. For example, if the bucket for CO_B_Low exceeds 63, then state machine 800 can transition to first pre-alarm state 840. When state machine 800 enters first pre-alarm state 840, it may instruct the hazard detection system to playback a pre-alarm message. CO system state machine 800 can transition from first pre-alarm state 840 to second pre-alarm state 844 in transition 3. Transition 3 can occur when the time spent in first pre-alarm state 840 (referred to herein as "T_PA1") is equal to or greater than a minimum hush time threshold (referred to herein as "Min_PA_Hush_Time") and the bucket responsible for entering into first pre-alarm state 840 has continued to fill up beyond the point it was at when state machine 800 entered into first pre-alarm state 840.

CO system state machine 800 can transition from pre-alarm hushed state 848 to second pre-alarm state 844 in transition 4. Transition 4 can occur when the time spent in pre-alarm hushed state 848 (referred to herein as "T_PA_Hushed") is equal to or greater than a minimum hush time threshold (referred to herein as "Min_PA_Hush_Time") and the bucket responsible for entering into first pre-alarm state 840 has continued to fill up beyond the point it was at when state machine 800 entered into first pre-alarm state 840.

In transition 5, CO system state machine 800 can transition from alarm hushed state 838 to alarm state 830 when the condition of transition 3 of CO sensor state machine 500 is satisfied (as discussed above). In transition 7, CO system state machine 800 can transition from alarm state 830 to holding state 850 when the conditions of transition 4 or transition 5 of CO sensor state machine 500 are satisfied.

In transition 6, CO system state machine 800 can transition from first pre-alarm state 840 to monitor state 820 when two of three condition parameters are satisfied. Satisfaction of the first parameter is mandatory and satisfaction of either the second condition or third condition is needed to effect transition 6. The first condition parameter is satisfied when T_PA1 is equal to or exceeds a predetermined time threshold (referred to as Min_PA_to_Monitor_Time). The second condition is satisfied when the time value associated with one of the buckets is equal to zero. The bucket can be, for example, the CO_B_Low bucket, though any bucket can be used. The time value associated with the Low CO bucket is referred to herein as CO_B_Low_Time. The third condition is satisfied when (1) CO_B_Low_Time is less than a result of a difference function and (2) CO_B_Low_Time is less than the time value of the low bucket pre-alarm threshold (referred to as $CO_B_{Low}$_PA1_Time). The difference function may be the result of the difference of (1) the time value of the bucket that caused the system state machine to enter into first pre-alarm state 840 (referred to herein as "X") and (2) a predetermined threshold (referred to herein as "Min_ALARM_Clear_Time").

In transition 9, state machine 800 can transition from monitor state 820 or alarm monitor state 860 to idle state 810 when $CO_B_{Low}$_Time is less than a predetermined threshold (e.g., 45 minutes). In transition 10, state machine 800 can transition from first pre-alarm state 840 or from second pre-alarm state 844 to pre-alarm hushed state 848 in response to a detected hush event. In transition 11, state machine 800 can transition from alarm state 830 to alarm hushed state 838 in response to a detected hush event.

In transition 12, state machine 800 can transition from second pre-alarm state 844 or pre-alarm hushed state 848 to monitor state 820 when (1) the amount of time spent in second pre-alarm state 844 (referred to has T_PA2) is equal to or greater than Min_PA_to_Monitor_Time and (2) CO is less than a fraction of CO_B_Low_Level (e.g., 80% of CO_B_Low_Level).

In transition 13, state machine 800 can transition from holding state 850 to alarm monitor state 860 when (1) the amount of time spent in holding state 850 (T_Holding) is equal to or greater than Min_Alarm_Clear_Time and one of (2) CO_B_Low_Time is equal to zero and (3) CO_B_Low_Time is less than a result of a difference function. The difference function may be the result of the difference of (1) the time value of the bucket that caused the system state machine to enter into first pre-alarm state 840 (e.g., "X") and (2) Min_ALARM_Clear_Time.

Mid is the default smoke alarm threshold. Thus, provided that none of the sensor data values meet any of the entry conditions of the other smoke alarm thresholds, selection engine 920 can select Smoke_T_Mid as Smoke_T_Cur 922. In addition, selection engine 920 can select Smoke_T_Mid upon initial startup of the hazard detection system.

TABLE 3

| Smoke_Alarm_Threshold Value | Enter Condition | Exit Condition |
|---|---|---|
| Smoke_T_Mid | Default | |
| Smoke_T_Low | CO >= 70 (ppm) | CO < 20 (ppm) |
| Smoke_T_Low | Heat >= 120 (F.) | Heat < 100 (F.) |
| Smoke_T_High | Hum >= Hum_Recent + 25 | Hum < Hum_Recent_at_Entry + 10 OR One Minute Elapsed |

Figure 9:
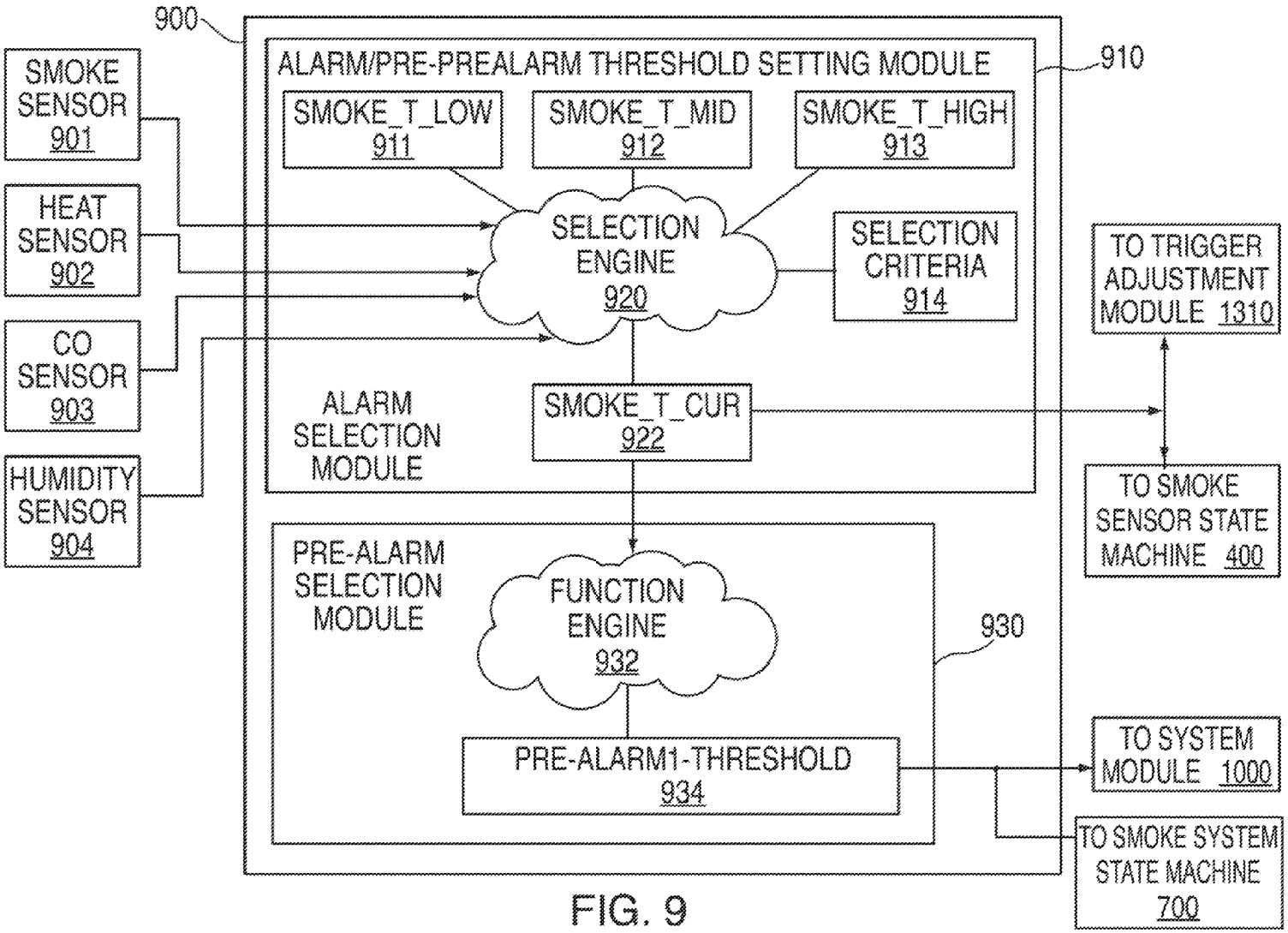
FIG. 9 shows an illustrative alarm/pre-alarm threshold setting module, according to some embodiments.

FIG. 9 shows an illustrative alarm/pre-alarm threshold setting module 900 according to an embodiment. Module 900 can include two sub modules: alarm selection module 910 and pre-alarm selection module 930. Module 910 may be operative to set the smoke alarm threshold, Smoke_T_Cur, that is used by smoke sensor state machine 400 in making a determination whether to enter into an alarming state. In addition, module 930 is also operative to set the smoke pre-alarm threshold, Pre_Alarm1_Threshold, that is used by smoke system state machine 700 in making a determination whether to enter into a pre-alarming state.

Alarm selection module 910 includes selection engine 920, which receives inputs from smoke sensor 901, heat sensor 902, CO sensor 903, humidity sensor 904, smoke alarm thresholds Smoke_T_Low 911, Smoke_T_Mid 912, and Smoke_T_High 913, and selection criteria 914. Selection engine 920 can produce output, Smoke_T_Cur 922, based on the received inputs. The inputs received from sensors 901-904 can be raw data values or processed data values. For example, data received from sensor 901 can be the instantaneously monitored smoke data value, Smoke. Data received from sensor 903 can be the instantaneously monitored CO data value, CO. Data received from sensor 904 can be the instantaneously monitored relative humidity data value, Hum. Data received from heat sensor 902 may be processed through an accelerated temperature algorithm (discussed above in connection with FIGS. 6A and 6B) before being provided to selection engine 920. The accelerated temperature value may be referred to as Heat. Other sensor data values (not shown) can be provided to selection engine 920. Smoke alarm thresholds Smoke_T_Low 911, Smoke_T_Mid 912, and Smoke_T_High 913 can correspond to the thresholds defined in Table 1, above.

Selection criteria 914 may define the parameters by which selection engine 920 selects one of smoke alarm thresholds Smoke_T_Low 911, Smoke_T_Mid 912, and Smoke_T_High 913 as Smoke_T_Cur 922 based on data received by sensors 901-904. Table 3, below, shows the conditions that dictate which smoke alarm threshold is selected for Smoke_T_Cur 922. Table 3 has three columns: smoke alarm threshold, enter condition, and exit condition. Each row specifies a particular smoke alarm threshold and the parameter(s) that causes selection engine 920 to select that particular smoke alarm threshold and the parameter(s) that enables selection 920 to deselect that particular smoke alarm threshold. The values presented in Table 3 are illustrative and can be modified or changed as desired by the hazard detection system. As shown in Table 3, Smoke_T_

Selection engine 920 can select Smoke_T_Low when CO meets or exceeds a first CO threshold (illustrated in Table 3 as 70 ppm) and selection of Smoke_T_Low is held until CO falls below a second CO threshold (illustrated in Table 3 as 20 ppm). The second CO threshold is less than the first CO threshold. The selection of Smoke_T_Low as an alarm threshold based on CO values illustrates an example of how multi-criteria state machines can be implemented according to various embodiments. Thus, if elevated CO levels are detected, then the smoke alarm threshold is lowered to Smoke_T_Low (as opposed to Smoke_T_Mid or Smoke_T_High), thereby "pre-arming" the smoke detector with pre-emptive smoke alarm sensitivity because non-smoke conditions are present that are more likely than not to correlate to a smoke condition. Selection engine 920 can also select Smoke_T_Low when Heat is equal to or exceeds a first heat threshold (illustrated in Table 3 as 120 F) and selection of Smoke_T_Low is held until Heat falls below a second heat threshold (shown as 100 F). The second heat threshold is less than the first heat threshold.

Selection engine 920 can select Smoke_T_High when Hum is greater than or equal to the sum of (1) Hum_Recent and (2) a first predetermined humidity constant (e.g., 25). Hum_Recent is an average or median of historical humidity readings. Hum_Recent can be a moving value that is updated at regular intervals. For example, in one embodiment, Hum_Recent can be the average or median humidity over the past 5 hours and updated every 30 minutes. Selection engine 920 can deselect Smoke_T_High when (1) Hum is less than the sum of Hum_Recent_at_entry (which may be the Hum_Recent value at the time the entry condition was satisfied) and a second predetermined humidity constant (e.g., 10) or (2) a predetermined period of time has elapsed since selecting Smoke_T_High (illustrated in Table 3 as one minute). The second predetermined humidity constant may be less than the first predetermined humidity constant. Selection of Smoke_T_High may at least temporarily set the smoke alarm threshold to a higher value in response to sudden increases in humidity. Because relatively sudden changes in humidity can sometimes cause the smoke sensor to falsely think it is reading elevated smoke levels, setting the alarm threshold to Smoke_T_High can prevent false alarms.

Selection engine 920 can perform its evaluation of the sensor data at regular intervals or in response to one or more events. The events can include state change events in one or more of the sensor state machines or system state machines, or the events can include trigger events. Trigger events can occur when a data value associated with a sensor moves out of a trigger band associated with that sensor. As defined herein, a trigger band can define upper and lower boundaries of data values for each sensor. Regardless of what triggers selection engine 920 to perform an evaluation, after all conditions are evaluated, selection engine 920 sets Smoke_T_Cur to the lowest alarm threshold satisfying the conditions. For example, assume that entry conditions for Smoke_T_High and Smoke_T_Low (for Heat) are satisfied. In this situation, selection engine 920 may select Smoke_T_Low for Smoke_T_Cur. If no conditions are satisfied, selection engine 920 may set Smoke_T_Cur to Smoke_T_Mid.

After selection 920 selects an alarm threshold for Smoke_T_Cur, this alarm threshold can be provided to trigger adjustment module 1310 (of FIG. 13), smoke sensor state machine 400, and pre-alarm selection module 930. Pre-alarm selection module 930 can apply Smoke_T_Cur to function engine 932 to generate Pre-Alarm1_Threshold 934. Function engine 932 can apply a multiplication factor ranging between 0.01 and 0.99 to Smoke_T_Cur to generate Pre-Alarm1_Threshold 934. For example, in one embodiment, the multiplication factor may be 0.75. As shown, Pre-Alarm1_Threshold 934 can be provided to system module 1000 (of FIG. 10) and smoke system state machine 700.

Figure 10:
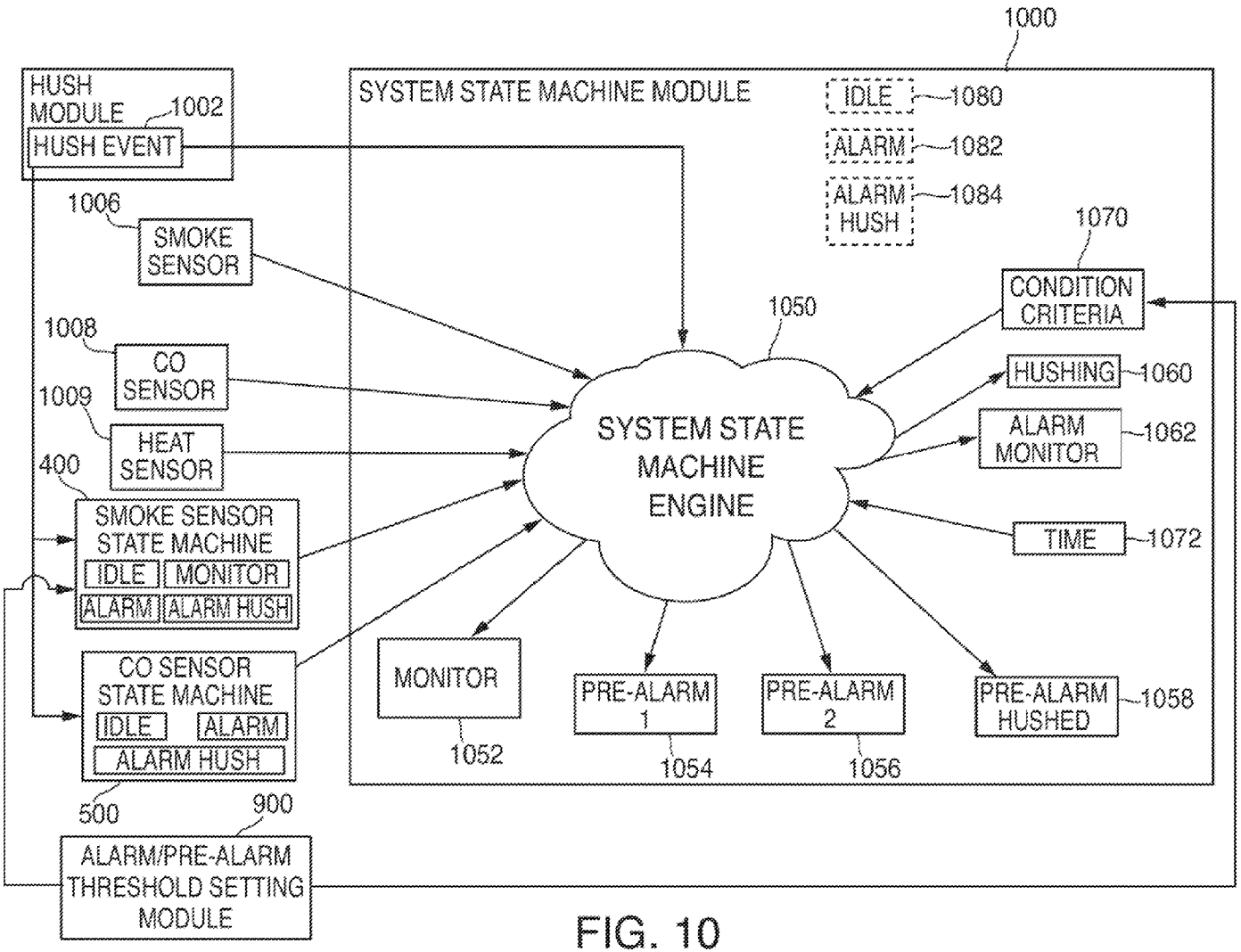
FIG. 10 shows an illustrative system state machine module, according to some embodiments.

FIG. 10 shows an illustrative system state machine module 1000 according to an embodiment. System state machine module 1000 may be a generic representation of system state machines 700 and 800, and in particular, shows inputs being provided to system state machine engine 1050, and outputs thereof. Engine 1050 is operative to control the system states of the smoke system state machine and the CO system state machine. The outputs of engine 1050 can include the following system states: monitor state 1052, first pre-alarm state 1054, second pre-alarm state 1056, pre-alarm hushed state 1058, hushing state 1060, and alarm monitoring state 1062. Engine 1050 can select one of these outputs based on one or more of the following inputs: hush event 1002, smoke sensor data 1006, CO sensor data 1008, heat sensor data 1009, smoke sensor state machine 400, CO sensor state machine 500, condition criteria 1070, and time 1072. Other inputs (not shown) can also be provided to engine 1050.

FIG. 10 also illustrates which states may be shared between the sensor state machines and the system state machines. As shown, system state machine module 1000 includes dashed line representations of idle state 1080, alarm state 1082, and alarm hush state 1084. States 1080, 1082, and 1084 may be shared with the respective same states in smoke sensor state machine 400 and CO sensor state machine 500. Thus, although module 1000 may be aware of the status of idle state 1080, alarm state 1082, and alarm hush state 1084, engine 1050 does not control these states; sensor state machines 400 and 500 control these states. This is illustrated by arrows stemming from sensor state machines 400 and 500 and delivered to engine 1050. Two different monitor states can exist among smoke sensor state machine 400 and module 1000 because different conditions can be used to control respective state machine transitions to that state.

Condition criteria 1070 can include the conditions embodied in FIGS. 7B and 8B. In addition, condition criteria 1070 can receive the Pre_Alarm1_Threshold from alarm/pre-alarm threshold setting module 900. Thus, for example, by referencing FIG. 10 in connection with FIGS. 7A and 7B, the reader can readily discern the operating principles of smoke system state machine 700, and by referencing FIG. 10 in connection with FIGS. 8A and 8B, the reader can readily discern the operating principles of CO system state machine 800.

Figure 11:
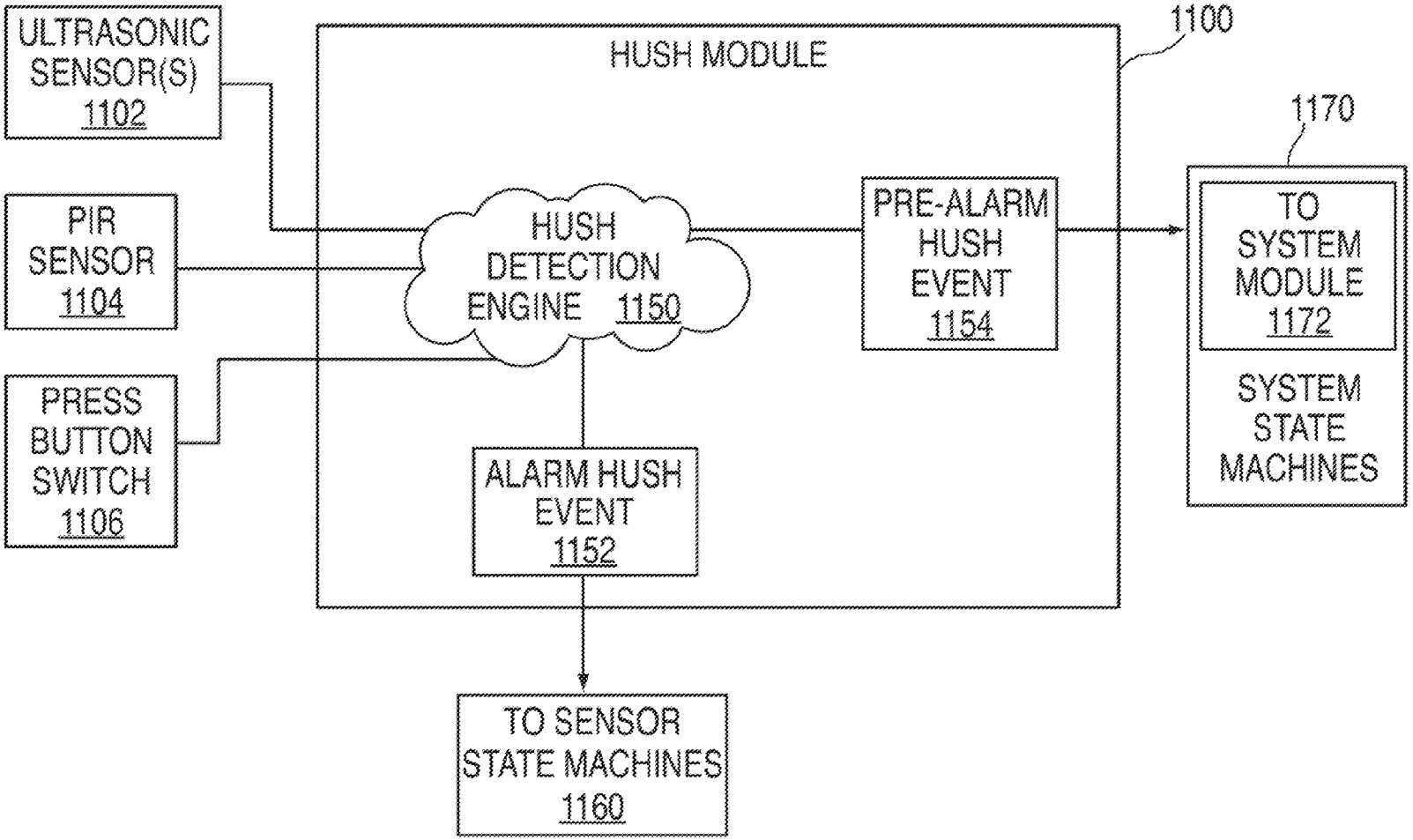
FIG. 11 shows an illustrative hush module, in accordance with some embodiments.

FIG. 11 shows an illustrative hush module 1100 in accordance with an embodiment. Hush module 1100 is operative to process data received from one or more sensors, determine whether a hush event is detected, and provide indications of detected hush events to the system and/or sensor state machines. For example, as shown, hush detection engine 1150 can make a determination whether data received from any one or more of ultrasonic sensors 1102, PIR sensor 1104, and button 1106 include a hush event. Data from other sensors (not shown) may also be provided to hush detection engine 1150. In response to determining that a hush event is detected, engine 1150 can provide alarm hush event notification 1152 to sensor state machines 1160 and pre-alarm hush event notification 1154 to system state machines 1170, and, in particular to system module 1172. Alarm hush event 1152 can be provided to and processed based on the conditions defined in each sensor state machine (e.g., sensor state machines 400, 500, and 600). Similarly, pre-alarm hush event 1154 can be provided to and processed based on the conditions defined in each system state machine (e.g., system state machines 700 and 800). In some embodiments, hush detection engine 1150 can provide a generic hush event notification to sensor state machines 1160 and system state machines 1170. The generic hush event notification may not be specific to any particular state machine or state, but rather may be an input that can be processed by each state machine based on the conditions defined therein.

Figure 12:
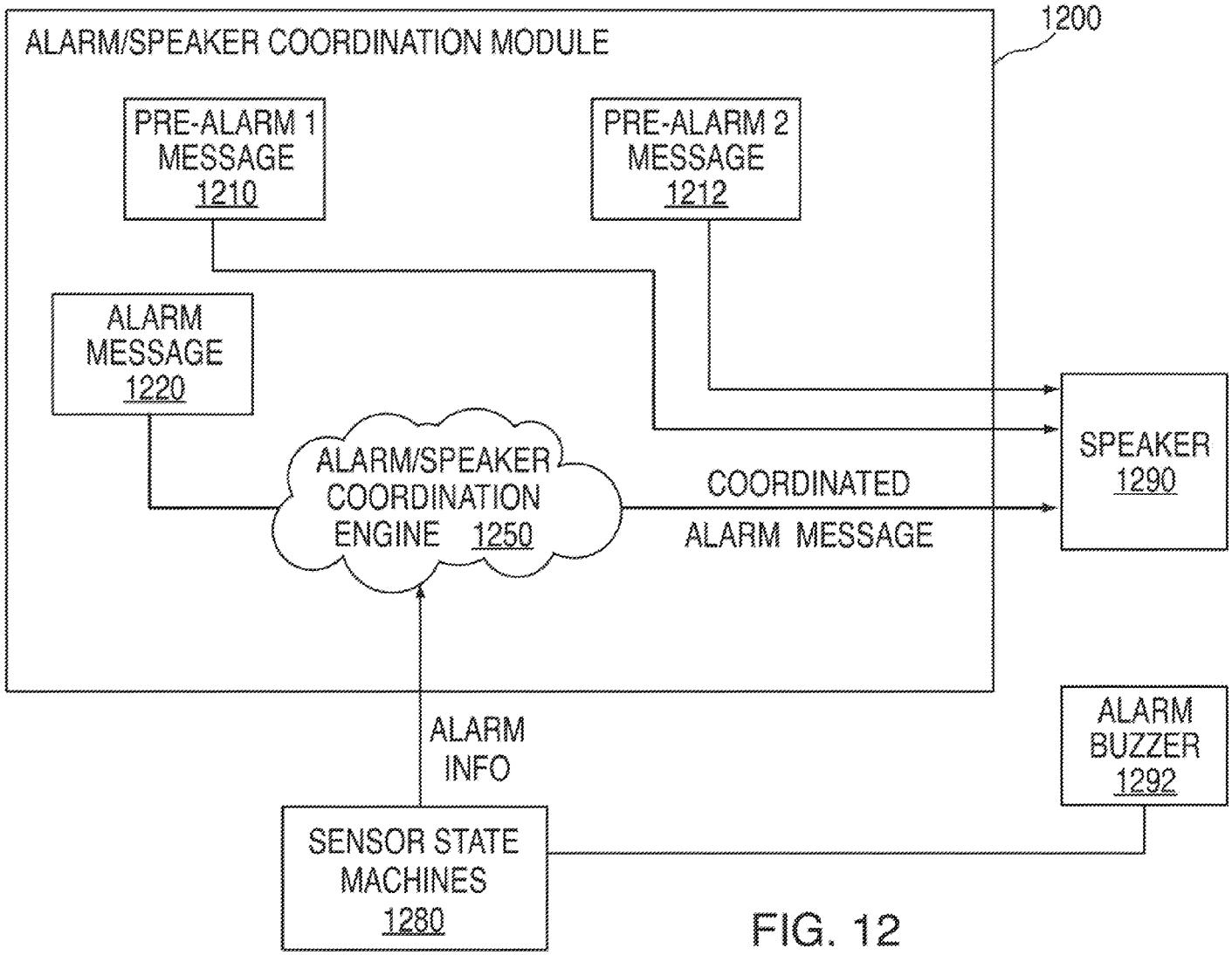
FIG. 12 shows an illustrative alarm/speaker coordination module, in accordance with some embodiments.

FIG. 12 shows an illustrative alarm/speaker coordination module 1200 in accordance with an embodiment. Module 1200 can coordinate playback of messages through speaker 1290 in a manner that does not interfere or overlap with any sounds being emitted by alarm buzzer 1292. As shown, module 1200 can include pre-alarm 1 message 1210, pre-alarm 2 message 1212, alarm message 1220, and alarm/speaker coordination engine 1250. Also shown in FIG. 12 are sensor state machines 1280, which may provide alarm info to coordination engine 1250 and can control operation of alarm buzzer 1292. Messages 1210, 1212, and 1220 may represent messages that can be played back through speaker 1290. Each of messages 1210, 1212, and 1220 can include one more messages that can be played back. The messages can include warnings and/or instructions on how to hush the alarm or pre-alarm. For example message 1210 may pertain to the first pre-alarm state of a system state machine, and message 1212 may pertain to the second pre-alarm state of a system state machine. When a system state machine enters into a first pre-alarm state, pre-alarm 1 message 1210 may be played back through speaker 1290 (as indicated by the line connecting message 1210 to speaker 1290). In some embodiments, the message played may be specific to the particular system state machine that is in the first pre-alarm state (e.g., a smoke system state machine may playback a message related to "smoke"). In other embodiments, the message played back can be generic, and the generic message may be played back regardless of which system state machine entered into the first pre-alarm state. Pre-alarm 2 message 1212 can be played back in a manner similar as to how pre-alarm 1 message 1210 may be played backed (as indicated by the line connecting message 1212 to speaker 1290).

Alarm message 1220 may pertain to the alarm state of a system state machine (e.g., smoke system state machine 700 or CO system state machine 800). When a system state machine wishes to playback alarm message 1220, it is first provided to coordination engine 1250, which determines when message 1220 can be played back based on the alarm info being received from sensor state machines 1280. Since sensor state machines 1280 control the operation of alarm buzzer 1292, it can inform coordination engine 1250 (via the alarm info) when the alarm buzzer will be emitting sounds. Coordination engine 1250 can use the alarm info to determine periods of time in which alarm buzzer 1292 will be silent and that are sufficient duration suitable for alarm message 1220 to be played back. For example, when alarm buzzer 1292 is being used, it may sound a "buzz," then remain silent for a predetermined period of time, and, then sound another "buzz." Alarm message 1220 can be played back during the alarm's silent predetermined period of time.

Figure 13:
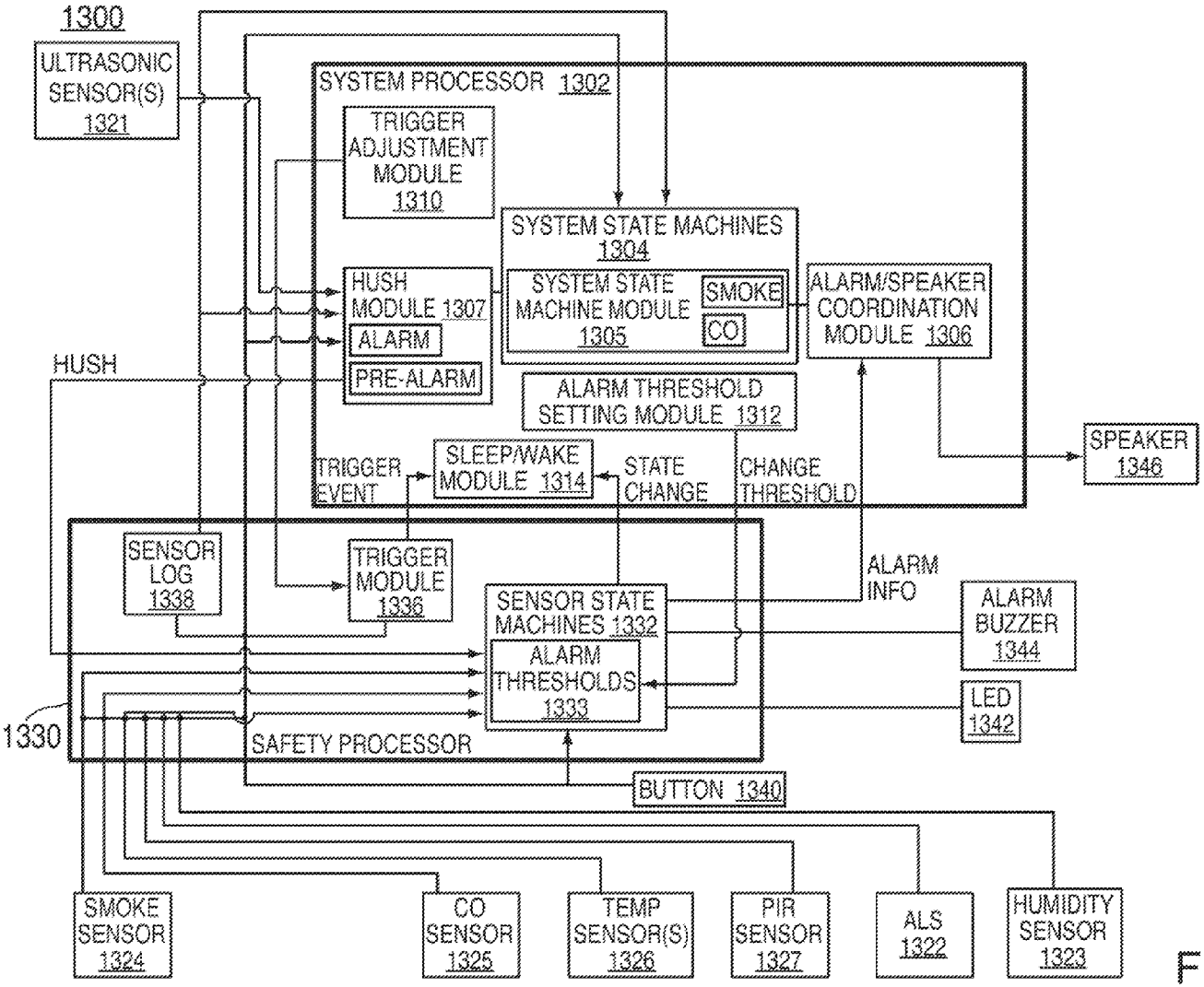
FIG. 13 shows an illustrative schematic of a hazard detection system, according to some embodiments.

FIG. 13 shows an illustrative schematic of hazard detection system 1300 according to an embodiment and shows, among other things, signal paths among various components, state machines, and illustrative modules being executed by different processors. System 1300 can include system processor 1302, safety processor 1330, ultrasonic sensors 1321, ALS sensor 1322 humidity sensor 1323, smoke sensor 1324, CO sensor 1325, temperatures sensors 1326, and PIR sensor 1327, button 1340, LED(s) 1342, alarm 1344, and speaker 1346. System processor 1302 can be similar to system processor 210 of FIG. 2. System processor 1302 can operate system state machines 1304, system state machine module 1305, alarm/speaker coordination module 1306, hush module 1307, trigger adjustment module 1310, and sleep/wake module 1314. System state machines 1304 can access system state machine module 1305, alarm/speaker coordination module 1306, and hush module 1307 in making state change determinations. System processor 1302 can receive data values acquired by ultrasonic sensors 1321 and other inputs from safety processor 1330. System processor 1302 may receive data from sensors 1322-1327, data from sensor log 1338, trigger events from trigger module 1336, state change events and alarm information from sensor state machines 1332, and button press events from button 1340.

Safety processor 1330 can be similar to safety processor 230 of FIG. 2. Safety processor 1330 can operate sensor state machines 1332, alarm thresholds 1333, trigger module 1336, and sensor log 1338. Safety processor 1330 can control operation of LEDs 1342 and alarm 1344. Safety processor 1330 can receive data values acquired by sensors 1322-1327 and button 1340. All or a portion of acquired sensor data can be provided to sensor state machines 1332. For example, as illustrated in FIG. 13, smoke, CO, and heat sensor data is shown being directly provided to sensor state machines 1332. Sensor log 1338 can store chunks of acquired data that can be provided to system processor 1302 on a periodic basis or in response to an event such as a state change in one of sensor state machines 1332 or a trigger event detected by trigger module 1336. In addition, in some embodiments, even though the sensor data may be stored in sensor log 1338, it can also be provided directly to system processor 1302, as shown in FIG. 13.

Alarm thresholds 1333 can store the alarming thresholds in a memory (e.g., Flash memory) that is accessible by sensor state machines 1332. As discussed above, sensor state machines 1332 can compare monitored sensor data values against alarm thresholds 1333 that may be stored within safety processor 1330 to determine whether a hazard event exists, and upon determining that the hazard event exists, may cause the alarm to sound. Each sensor (e.g., smoke sensor, CO sensor, and heat sensor) may have one or more alarm thresholds. When multiple alarm thresholds are available for a sensor, safety processor 1330 may initially select a default alarm threshold, but responsive to an instruction received from system processor 1302 (e.g., from Alarm/Pre-Alarm Threshold Setting Module 1312), it can select one of the multiple alarm thresholds as the alarm threshold for that sensor. Safety processor 1330 may automatically revert back to the default alarm threshold if certain conditions are not met (e.g., a predetermined period of time elapses in which an alarm setting threshold instruction is not received from system processor 1302).

Safety processor 1330 and/or system processor 1302 can monitor button 1340 for button press events. Button 1340 can be an externally accessible button that can be depressed by a user. For example, a user may press button 1340 to test the alarming function or to hush an alarm. Safety processor 1330 can control the operation of alarm 1344 and LEDs 1342. Processor 1330 can provide alarm information to alarm/speaker coordination module 1306 so that module 1306 can coordinate speaker voice notification with alarm sounds. In some embodiments, safety processor 1330 is the only processor that controls alarm 1344. Safety processor 1330 can also receive inputs from system processor 1302 such as hush events from hush module 1307, trigger band boundary adjustment instructions from trigger adjustment module 1310, and change threshold instructions from alarm/pre-alarm threshold setting module 1312.

As shown, hazard detection system 1300 may use a bifurcated processor arrangement to execute the multi-criteria state machines to control the alarming and pre-alarming states, according to various embodiments. The system state machines can be executed by system processor 1302 and the sensor state machines can be executed by safety processor 1330. As shown, sensor state machines 1332 may reside within safety processor 1330. This shows that safety processor 1330 can operate sensor state machines such as smoke sensor state machine 400, CO sensor state machine 500, and heat sensor state machine 600, as discussed above. Thus, the functionality of the sensor state machines (as discussed above) are embodied and executed by safety processor 1330. As also shown, system state machines 1304 may reside within system processor 1302. This shows that system processor 1302 can operate system state machines such as smoke system state machine 700 and CO system state machine 800, as discussed above. Thus, the functionality of the system state machines (as discussed above) are embodied and executed by system processor 1302. Moreover, modules 1305, 1306, and 1307 can correspond to system state machine module 1000 of FIG. 10, alarm/speaker coordination module 1200 of FIG. 12, and hush module 1100 of FIG. 11, respectively.

In the bifurcated approach, safety processor 1330 can serve as the "brain stem" of hazard detection system 1300 and system processor 1302 can serve as the "frontal cortex." In human terms, even when a person goes to sleep (i.e., the frontal cortex is sleeping) the brain stem maintains basic life functions such as breathing and heart beating. Comparatively speaking, safety processor 1330 is always awake and operating; it is constantly monitoring one or more of sensors 1322-1327, even if system processor 1302 is asleep or non-functioning, and managing the sensor state machines of hazard detection system 1300. When the person is awake, the frontal cortex is used to processes higher order functions such as thinking and speaking. Comparatively speaking, system processor 1302 performs higher order functions implemented by system state machines 1304, alarm/speaker coordination module 1306, hush module 1307, trigger adjustment module 1310, and alarm/pre-alarm threshold setting module 1312. In some embodiments, safety processor 1330 can operate autonomously and independently of system processor 1302. Thus, in the event system processor 1302 is not functioning (e.g., due to low power or other cause), safety processor 1330 can still perform its hazard detection and alarming functionality.

The bifurcated processor arrangement may further enable hazard detection system 1300 to minimize power consumption by enabling the relatively high power consuming system processor 1302 to transition between sleep and non-sleep states while the relatively low power consuming safety processor 1330 is maintained in a non-sleep state. To save power, system processor 1302 can be kept in the sleep state until one of any number of suitable events occurs that wakes up system processor 1302. Sleep/wake module 1314 can control the sleep and non-sleep states of system processor 1302. Safety processor 1330 can instruct sleep/wake module 1314 to wake system processor 1302 in response to a trigger event (e.g., as detected by trigger module 1336) or a state change in sensor state machines 1332. Trigger events can occur when a data value associated with a sensor moves out of a trigger band associated with that sensor. A trigger band can define upper and lower boundaries of data values for each sensor and are stored with safety processor 1330 in trigger module 1336. See, for example, FIG. 14A, which shows timing diagram 1410 of sensor data values changing over time, and trigger band 1412. The sensor data values can be acquired from a particular sensor (e.g., a smoke sensor). Trigger band 1412 has lower boundary (LB) at position 0 and upper boundary (UB) at position 1. Trigger module 1336 can monitor sensor data values and compare them against the boundaries set for that particular sensor's trigger band. Thus, when a sensor data value moves out of band, trigger module 1336 registers this as a trigger event (shown in FIG. 14A when the sensor data value crosses over the upper boundary) and notifies system processor 1302 of the trigger event (e.g., by sending a signal to sleep/wake module 1314).

The boundaries of the trigger band can be adjusted by system processor 1302, when it is awake, based on an operational state of hazard detection system 1300. The operational state can include the states of each of the system and sensor state machines, sensor data values, and other factors. System processor 1302 may adjust the boundaries of one or more trigger bands to align with one or more system state machine states before transitioning back to sleep. Thus, by adjusting the boundaries of one or more trigger bands, system processor 1302 effectively communicates "wake me" instructions to safety processor 1330.

Figure 14A:
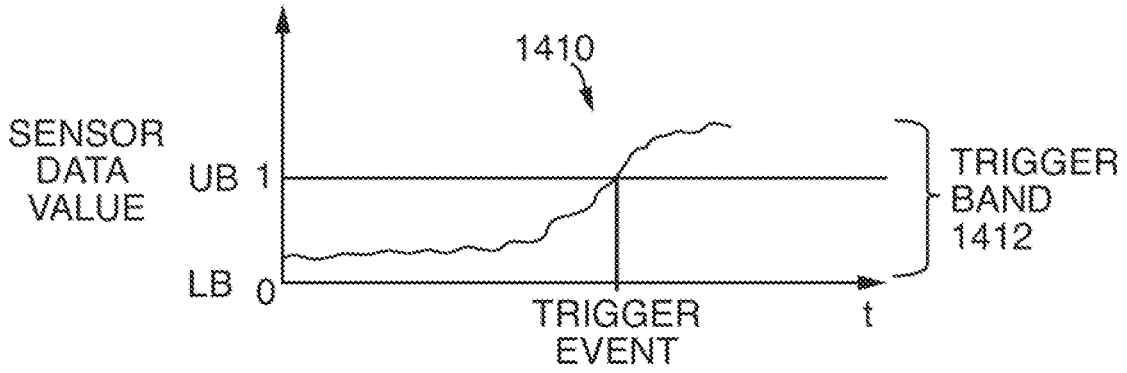
FIGS. 14A-14C show illustrative timing diagrams of different trigger bands, according to some embodiments.
Figure 14B:
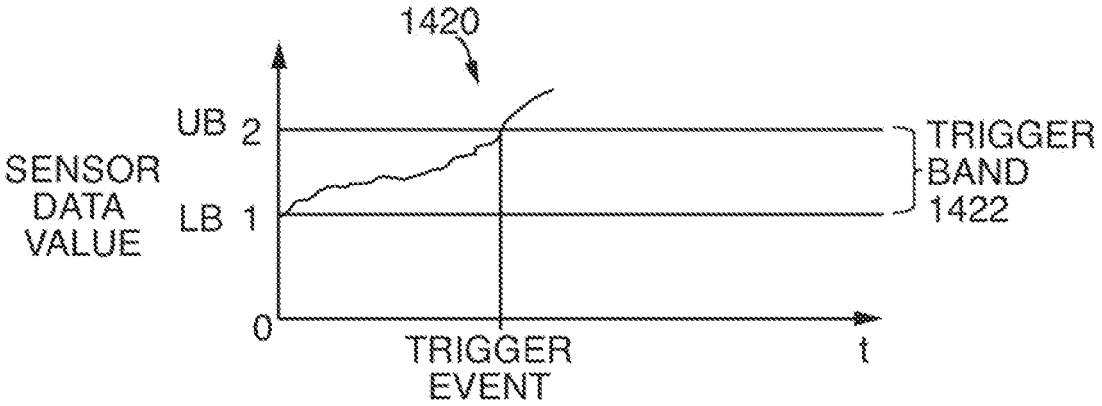
Figure 14C:
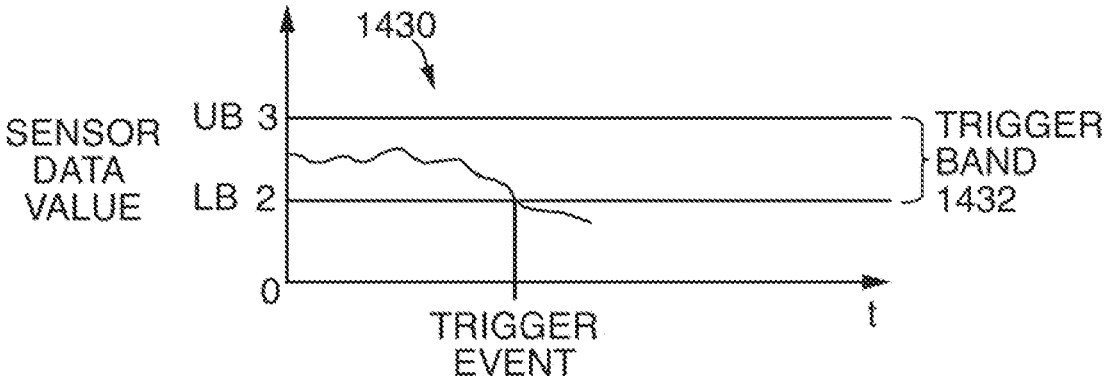

The "wake me" instructions can be generated by trigger adjustment module 1310 and transmitted to trigger module 1336, as shown in FIG. 13. The "wake me" instructions can cause module 1336 to adjust a boundary of one or more trigger bands. For example, as a result of receiving instructions to adjust the boundary of one or more bands, trigger module 1336 may change the trigger band as illustrated in FIGS. 14B and 14C. FIGS. 14B and 14C show timing diagrams 1420 and 1430, respectively, in which the upper and lower boundaries of trigger bands 1422 and 1432 have changed relative to timing diagram 1410 and with respect to each other. In particular, trigger band 1422 has lower boundary (LB) at position 1 and upper boundary (UB) at position 2. In some embodiments, the upper and lower boundaries can be the same. Trigger band 1432 has LB at position 2 and UB at position 3.

Figure 15:
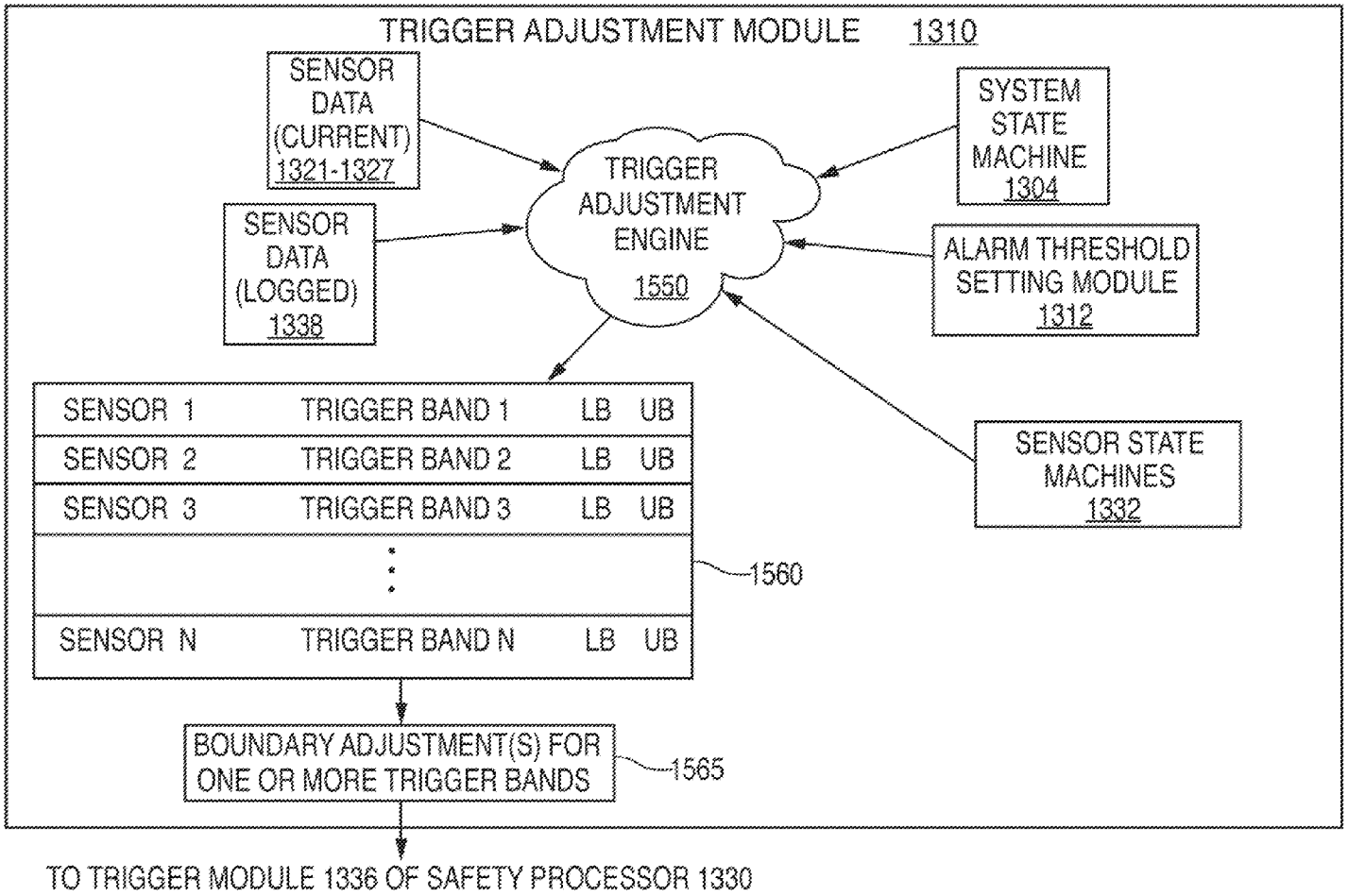
FIG. 15 shows a more detailed block diagram of a trigger adjustment module of FIG. 13, according to some embodiments.

FIG. 15 shows a more detailed block diagram of trigger adjustment module 1310 according to an embodiment. Trigger adjustment module 1310 can include trigger adjustment engine 1550 that can adjust boundaries of one or more trigger bands based on any suitable number of different factors, including, for example, sensor data obtained from sensors 1321-1327, logged sensor data 1338, system state machines 1304, alarm/pre-alarm threshold setting module 1312, and sensor state machines 1332. Any boundary adjustments 1565 are updated in trigger band boundary table 1560 and transmitted to trigger module 1336 in safety processor 1330. As shown, trigger band boundary table 1560 can maintain the upper and lower trigger band boundaries for several different sensors. In some embodiments, a separate trigger band can be maintained for each one of sensors 1321-1327.

By maintaining a trigger band for one or more sensors, and transmitting the trigger band boundaries to trigger module 1336, system processor 1302 is able to inform safety processor 1330 of when it wants to be woken up. Since system processor 1302 is preferably maintained in a sleep state, the trigger bands provide a mechanism that enables system processor 1302 to remain asleep until a sensor data value moves out of band. Once a sensor value moves out of band, the trigger event causes system processor 1302 to wake up and evaluate its operational state, and as a result of that evaluation, a state change transition may occur and/or a trigger band adjustment can be made.

In some embodiments, there may be a correlation between the trigger band boundaries of one or more sensors and the conditions defining state transitions (e.g., conditions in FIGS. 4B, 5B, 6B, 7B, and/or 8B) set forth in the multi-criteria state machines. In other embodiments, the correlation between the trigger band boundaries of one or more sensors can be based on the conditions defining system state machine transitions (e.g., such as those defined in FIGS. 7B and 8B). For example, assume that smoke system state machine 700 is in its monitor state, the trigger band for the smoke sensor is defined by trigger band 1422 (of FIG. 14B), and system processor 1302 is asleep. When the sensor data value crosses the UB of trigger band 1422, trigger module 1336 registers this as a trigger event and causes system processor 1302 to wake up. Once awake, system processor 1302 can evaluate its operational state (e.g., the sensor data, time data, and other suitable data). Now, further assume that the smoke data value has risen to a value greater than a first pre-alarm threshold. In response to this determination, smoke system state machine 700 may transition to the first pre-alarm state. After having transitioned to the first pre-alarm state, trigger adjustment module 1310 may adjust the boundaries of the smoke sensor's trigger band to have the boundaries of trigger band 1432 (of FIG. 14C). The adjustment 1565 to the boundaries are transmitted to trigger module 1336 and system processor 1302 goes back to sleep, and can remain asleep until a boundary of trigger band 1422 is crossed or some other event occurs that causes system processor 1302 to wake up.

Figure 16:
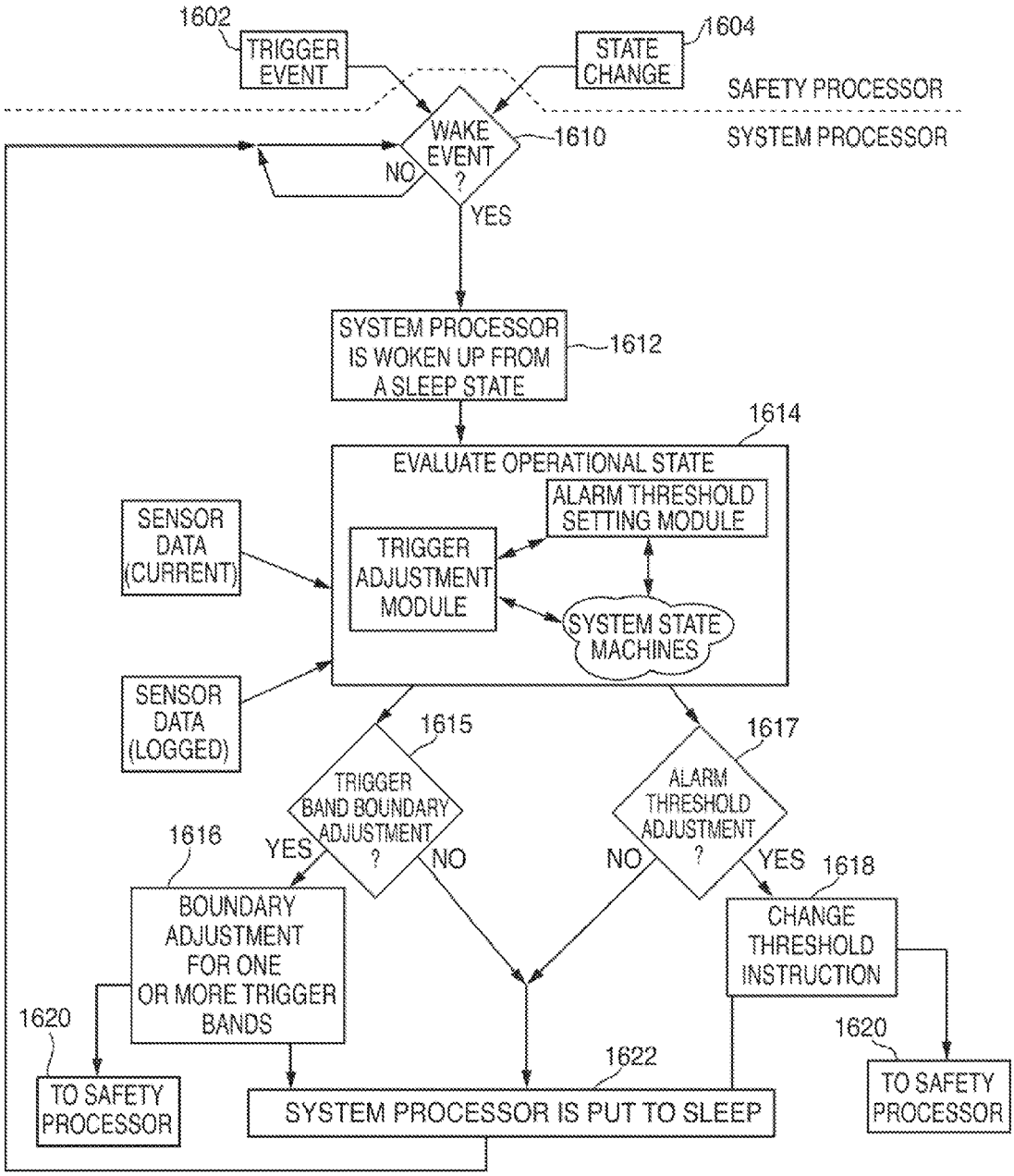
FIG. 16 shows an illustrative flowchart of steps that may be taken when a system processor transitions to a non-sleep state, according to some embodiments.

FIG. 16 shows an illustrative flowchart of steps that may be taken when a system processor transitions to a non-sleep state. A dashed line is shown to illustratively demarcate which processor (i.e., the safety processor or system processor) is executing the step. Either one of trigger event 1602 and state change event 1604 can be registered as a wake event at step 1610. In response to wake event at step 1610, the system processor is woken up from a sleep state, at step 1612. At step 1614, the operational state of the hazard detection system is evaluated. The evaluation of the operational state can encompass many aspects of the hazard detection system. In some embodiments, this evaluation may encompass all system processor executed operations such as multi-criteria state machines (e.g., sensor state machines 400, 500, and 600 and system state machines 700 and 800), alarm threshold setting module (e.g., alarm/pre-alarm threshold setting module 900), and trigger adjustment module (e.g., trigger adjustment module 1310). In addition, the evaluation may take into account sensor data, which can be logged sensor data, current sensor data, or both. After step 1614, the flowchart proceeds to steps 1615 and 1617.

At step 1615, a determination is made whether a trigger band adjustment is needed. If the determination is YES, boundary adjustments for one or more trigger bands are made (at step 1616) and transmitted to the safety processor (at step 1620). If the determination is NO, the system processor is put back to sleep (at step 1622). At step 1617, a determination is made whether an alarm threshold adjustment is needed. If the determination is YES, change alarm threshold instructions are made (at step 1618) and transmitted to the safety processor (at step 1620). If the determination is NO, the system processor is put back to sleep (at step 1622). In addition, after steps 1616 and 1618 are complete, the system processor is put back to sleep (at step 1622).

Figure 17:
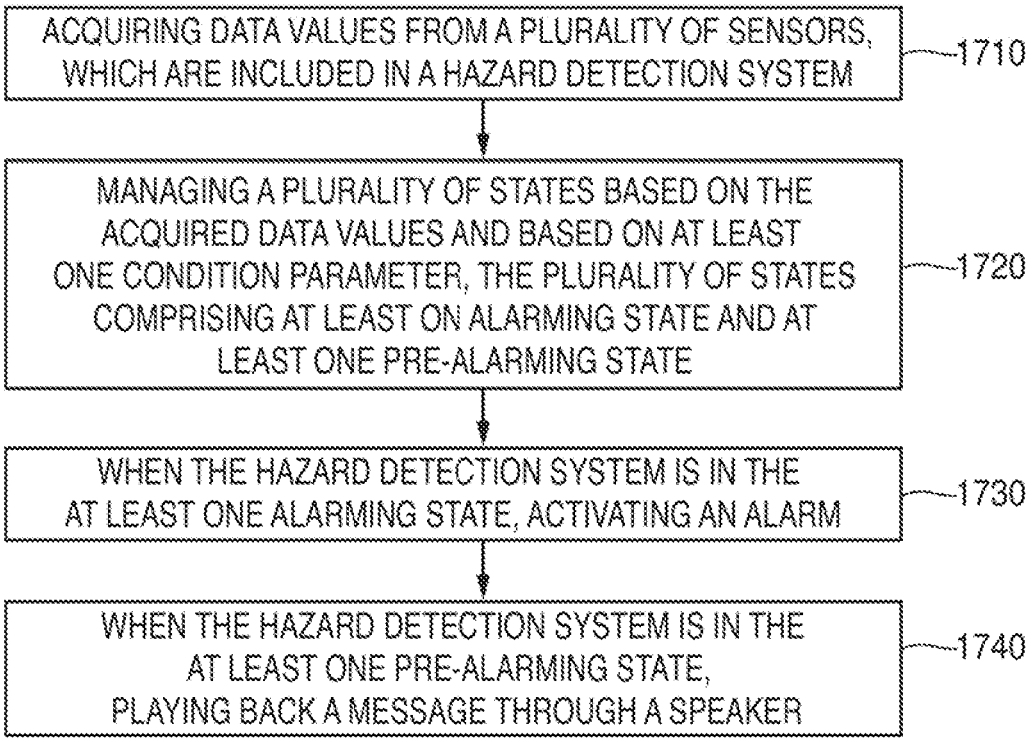
FIG. 17 shows an illustrative flowchart of steps for implementing multi-criteria alarming and pre-alarming functionalities, according to some embodiments.

FIG. 17 shows an illustrative flowchart of steps for implementing multi-criteria alarming and pre-alarming functionality according to an embodiment. Beginning at step 1710, data values can be acquired from several sensors, which are included in a hazard detection system. For example, data values can be obtained from sensors 1321-1327 of FIG. 13. At step 1720, a plurality of states can be managed based on the acquired data values and based on at least one condition parameter. The plurality of states can include at least one alarming state and at least one pre-alarming state. At step 1730, when the hazard detection system is in the at least one alarming state, an alarm is activated. At step 1740, when the hazard detection system is in the at least one pre-alarming state, a message is played back through the speaker.

Figure 18:
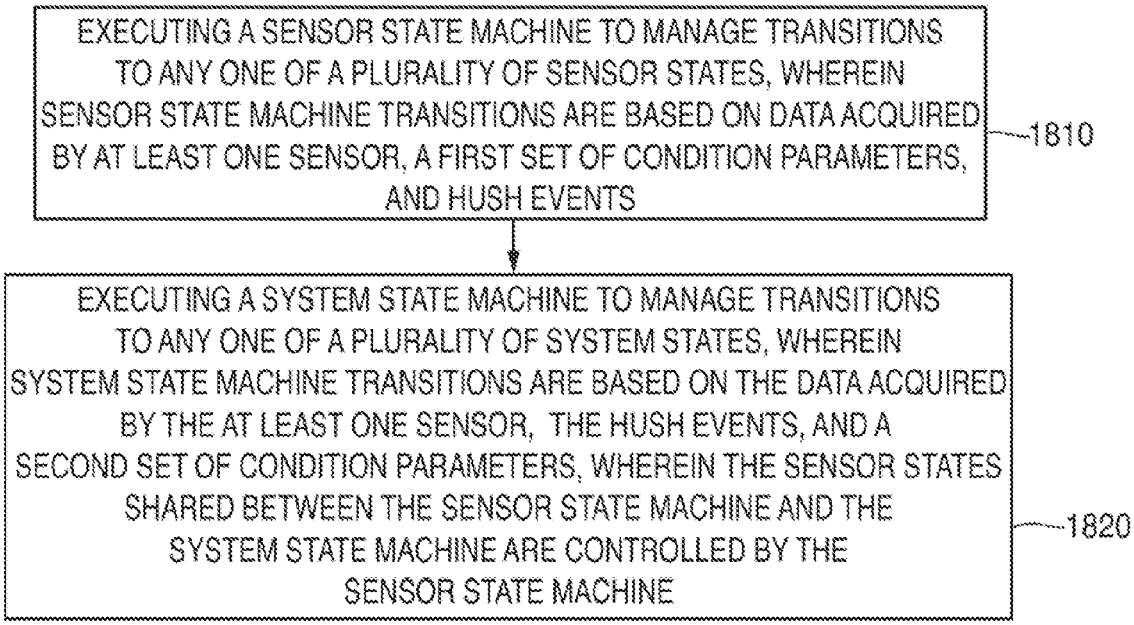
FIG. 18 shows an illustrative flowchart of steps for sharing states among multi-criteria machines, according to some embodiments.

FIG. 18 shows an illustrative flowchart of steps for sharing states among multi-criteria machines according to an embodiment. At step 1810, a sensor state machine can be executed to manage transitions to any one of a plurality of sensor states, wherein sensor state machine transitions may be based on data acquired by at least one sensor, a first set of condition parameters, and hush events. At step 1820, a system state machine can be executed to manage transitions to any one of a plurality of system states. The system states can include the sensor states and the system state machine transitions may be based on the data acquired by the at least one sensor, the hush events, and a second set of condition parameters, and sensor states shared between the sensor state machine and the system state machine may be controlled by the sensor state machine.

Figure 19:
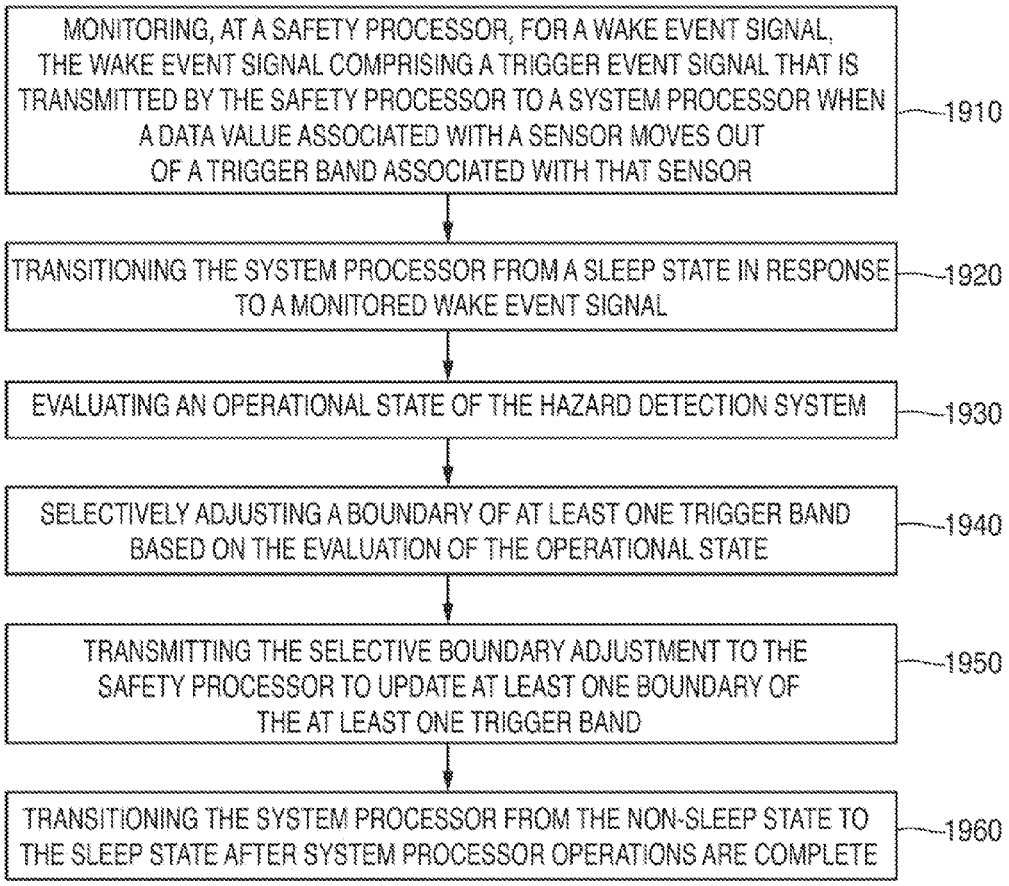
FIG. 19 shows an illustrative flowchart of steps for managing trigger bands, according to some embodiments.

FIG. 19 shows an illustrative flowchart of steps for managing trigger bands according to an embodiment. At step 1910, a safety processor can monitor for a wake event signal. The wake event signal can include a trigger event signal that is transmitted by the safety processor to a system processor when a data value associated with a sensor moves out of a trigger band associated with that sensor. At step 1920, the system processor may transition from a sleep state to a non-sleep state in response to a monitored wake event signal. At step 1930, an operational state of the hazard detection system may be evaluated. At step 1940, a boundary of at least one trigger band may be selectively adjusted based on the evaluation of the operational state. At step 1950, the selective boundary adjustment may be transmitted to the safety processor to update at least one boundary of the at least one trigger band. Then, at step 1960, the system processor can transition from the non-sleep state to the sleep state after system processor operations are complete.

Figure 20:
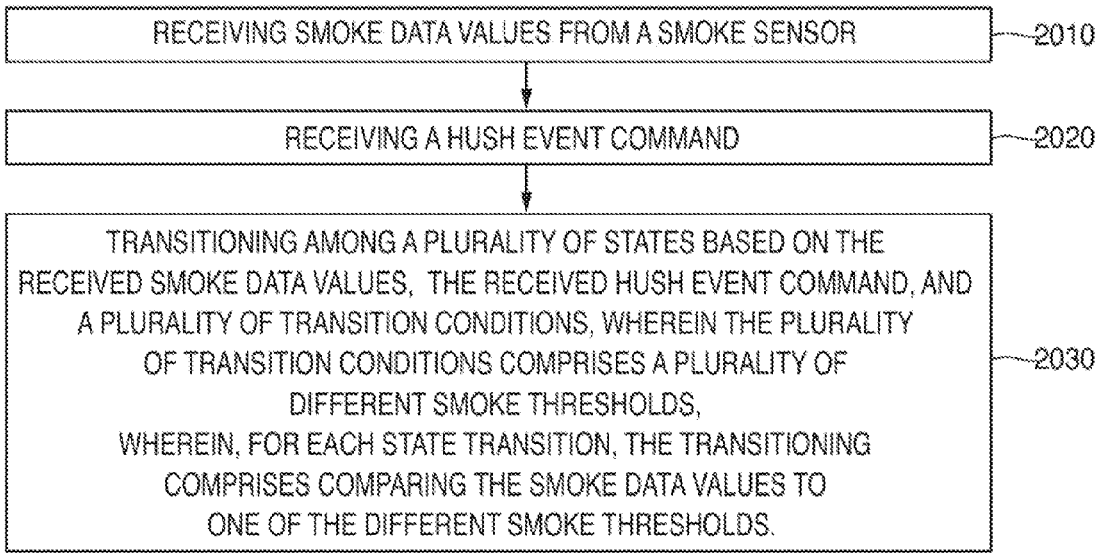
FIG. 20 shows an illustrative flowchart of steps for implementing a smoke sensor state machine, according to some embodiments.

FIG. 20 shows an illustrative flowchart of steps for implementing a smoke sensor state machine according to an embodiment. Beginning at step 2010, smoke data values may be received from a smoke sensor. At step 2020, a hush event command can be received. Receipt of the hush event command can be based on a user interaction such as a gesture interaction or a press of a button. At step 2030, the smoke sensor state machine can transition among a plurality of states based on the received smoke data values, the received hush event command, and a plurality of transition conditions. The plurality of transition conditions can include a plurality of different smoke thresholds, and, for each state transition, a comparison may be made between the smoke data values and one of the different smoke thresholds.

Figure 21:
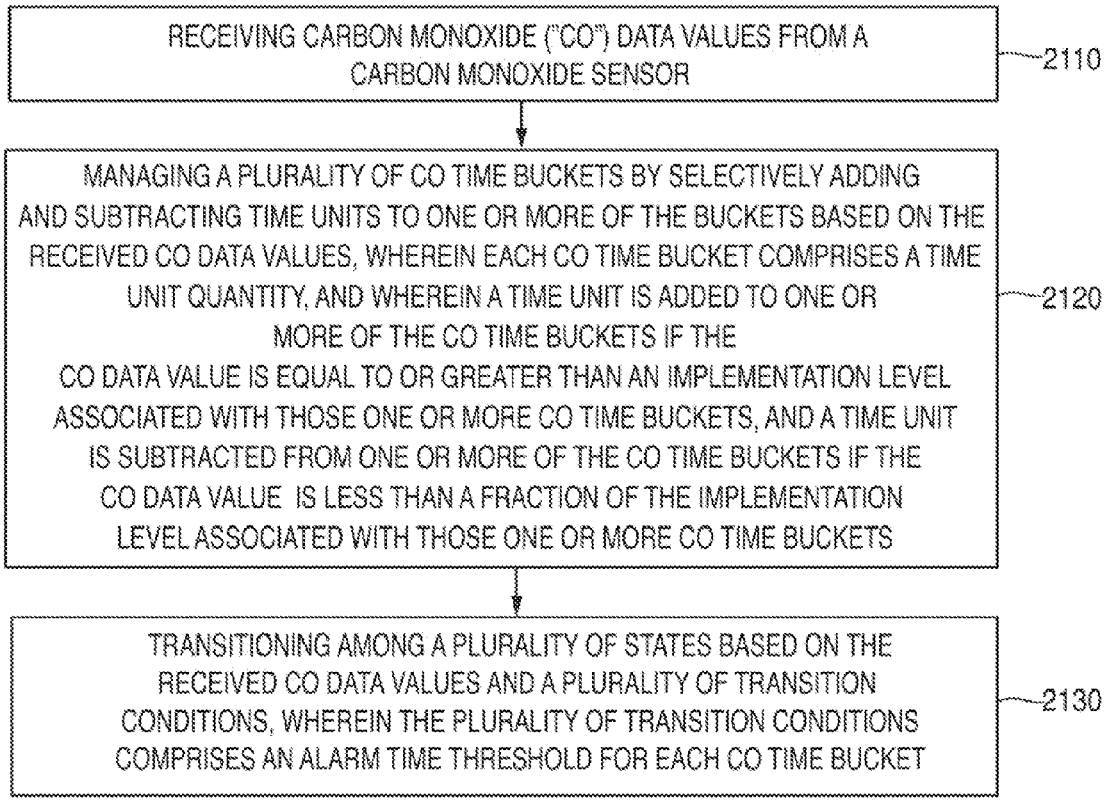
FIG. 21 shows an illustrative flowchart of steps for implementing a CO sensor state machine, according to some embodiments.

FIG. 21 shows an illustrative flowchart of steps for implementing a CO sensor state machine according to an embodiment. Beginning at step 2110, carbon monoxide ("CO") data values may be received from a carbon monoxide sensor. At step 2120, the CO sensor state machine can manage several CO time buckets by selectively adding and subtracting time units to one or more of the buckets based on the received CO data values. Each CO time bucket may include a time unit quantity, and a time unit may be added to one or more of the CO time buckets if the CO data value is equal to or greater than an implementation level associated with those one or more CO time buckets and a time unit may be subtracted from one or more of the CO time buckets if the CO data value is less than a fraction of the implementation level associated with those one or more CO time buckets. At step 2130, the CO sensor state machine can transition among a plurality of states based on the received CO data values and a plurality of transition conditions, wherein the plurality of transition conditions may include an alarm time threshold for each CO time bucket.

Figure 22:
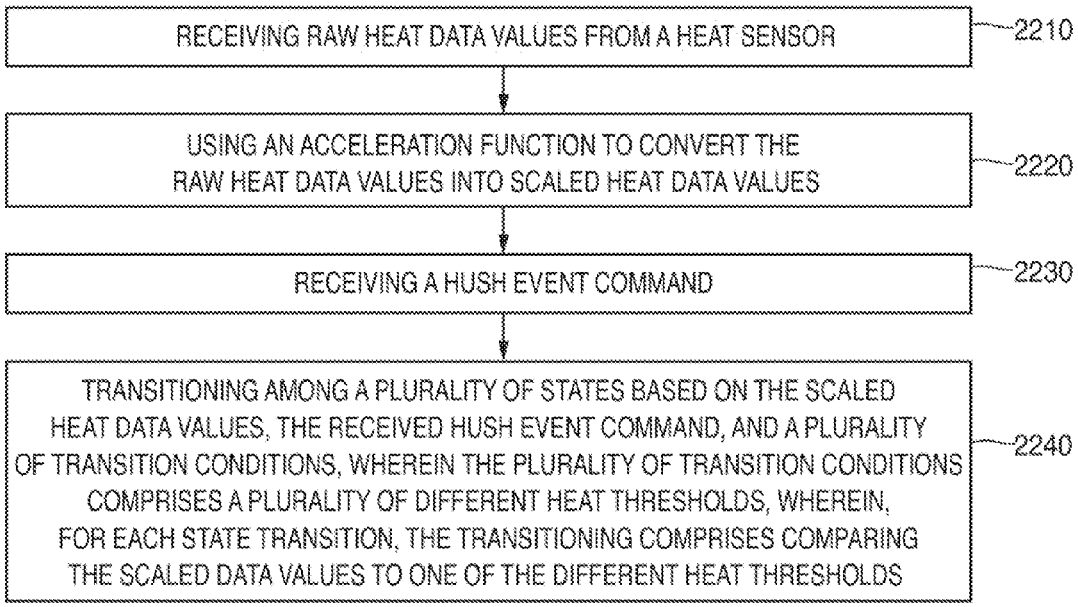
FIG. 22 shows an illustrative flowchart of steps for implementing a heat sensor state machine, according to some embodiments.

FIG. 22 shows an illustrative flowchart of steps for implementing a heat sensor state machine according to an embodiment. Beginning at step 2210, raw heat data values are received from a heat sensor. At step 2220, the heat sensor state machine can use an acceleration function to convert the raw heat data values into scaled heat data values. A hush event command can be received at step 2230. At step 2240, the heat sensor state machine can transition among a plurality of states based on the scaled heat data values, the received hush event command, and a plurality of transition conditions. The transition conditions can include several different heat thresholds, wherein, for each state transition, the scaled data values are compared to one of the different heat thresholds.

Figure 23:
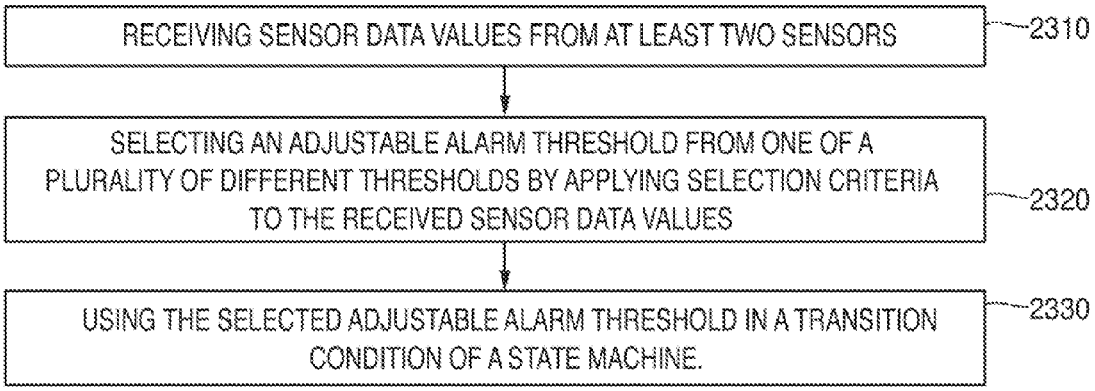
FIG. 23 shows an illustrative flowchart of steps for adjusting alarm thresholds, according to some embodiments.

FIG. 23 shows an illustrative flowchart of steps for adjusting alarm thresholds according to an embodiment. Beginning at step 2310, sensor data values from at least two sensors are received. At step 2320, the adjustable alarm threshold is selected form one of a plurality of different thresholds by applying selection criteria to the received sensor data values. Then, at step 2330, the selected adjustable alarm threshold is used in a transition condition of a state machine.

It is to be understood that the steps shown in the flowcharts of one or more of FIGS. 16-23 are merely illustrative and that existing steps may be modified or omitted, additional steps may be added, and the order of certain steps may be altered.

The smoke sensor used by various embodiments described herein may be calibrated at regular intervals to ensure accurate smoke sensor data are obtained. For example, the smoke sensor may be calibrated by taking readings of a dark (unlit) chamber and subtracting it from readings taken from bright (lit) chamber. This differential reading can be defined by:

$$R=\text{SMOKE}_{light}-\text{SMOKE}_{dark}$$

where $\text{SMOKE}_{light}$ is the reading of the bright chamber and $\text{SMOKE}_{dark}$ is the reading of the dark chamber. If each "R" value is below Smoke_T_Base, it is added to a filter, which is used to determine a clear air offset—the value that is used to calibrate the smoke sensor. The filter can be defined by:

$$F_n=(0.0029*R)+(0.9971*F_{n-1})$$

where n can define a pre-determined number of samples. In some embodiments, the filter can include four days of R values. Thus, Fn can maintain a running average of filtered R values. The clear air offset can be defined by:

$$C_{cur}=C_{last}*(R-F_n)$$

where $C_{cur}$ is the current value of the clear air offset, $C_{last}$ is the previous value of the clear air offset, R is the current differential reading, and $F_n$ is the filtered average of R values. $C_{cur}$ can be used to calibrate the smoke sensor. In some embodiments, $C_{cur}$ can be stored in non-volatile memory every predetermined number of days. Out of the box, the initial $C_{cur}$ may be set to the value defined by the manufacturer of the smoke sensor, which may be stored in the non-volatile memory.

In some embodiments, if $C_{cur}$ exceeds a predetermined number, an error signal may be triggered to indicate that the smoke sensor has drifted past a maximum sensor drift threshold. In addition, separate low pass filters of $\text{SMOKE}_{light}$ and $\text{SMOKE}_{dark}$ may be maintained to monitor for smoke sensor performance issues. An error signal may be triggered if the average data value associated with $\text{SMOKE}_{dark}$ exceeds a predetermined threshold. An error signal may be triggered if the average R value is less than a predetermined threshold, where the average R value is derived from the low pass filters of $\text{SMOKE}_{light}$ and $\text{SMOKE}_{dark}$.

The CO sensor may also be calibrated. The CO sensor manufacturer's gain setting may be programmed into non-volatile memory. In addition, locally measured clean air offset readings may be stored in the non-volatile memory. The hazard detection system can compensate for temperature changes by applying a gain correction based on temperature sensor data obtained from one or more temperature sensors.

The CO sensor may have a useful life of approximately seven years. The hazard detection system according to various embodiments may be able to keep track of how long the CO sensor has been in use. This can be accomplished, for example, by writing elapsed time data to non-volatile memory. When the elapsed time data exceeds an end-of-life threshold for the CO sensor, an alarm may be sounded to indicate that the CO sensor is no longer functional.

It is understood that although the embodiments described herein with respect to a hazard detection system, these embodiments may also be used in any system or device where it is desired to maintain sensing and monitoring of other events while updating the operational capabilities of one of more components of that system or device. For example, the other events can include events that are not necessarily tied to hazards such as smoke, CO, and heat, but can include motion detection, sound detection, and the like. Events reported by remote devices may also be taken into account. For example, security device such as window and door sensor, and motion detection sensors that provide feedback to a system may quality as other events.

Moreover, the processes described with respect to FIGS. 1-23, as well as any other aspects of the invention, may each be implemented by software, but may also be implemented in hardware, firmware, or any combination of software, hardware, and firmware. They each may also be embodied as machine- or computer-readable code recorded on a machine- or computer-readable medium. The computer-readable medium may be any data storage device that can store data or instructions which can thereafter be read by a computer system. Examples of the computer-readable medium may include, but are not limited to, read-only memory, random-access memory, flash memory, CD-ROMs, DVDs, magnetic tape, and optical data storage devices. The computer-readable medium can also be distributed over network-coupled computer systems so that the computer readable code is stored and executed in a distributed fashion. For example, the computer-readable medium may be communicated from one electronic subsystem or device to another electronic subsystem or device using any suitable communications protocol. The computer-readable medium may embody computer-readable code, instructions, data structures, program modules, or other data in a modulated data signal, such as a carrier wave or other transport mechanism, and may include any information delivery media. A modulated data signal may be a signal that has one or more of its characteristics set or changed in such a manner as to encode information in the signal.

It is to be understood that any or each module or state machine discussed herein may be provided as a software construct, firmware construct, one or more hardware components, or a combination thereof. For example, any one or more of the state machines or modules may be described in the general context of computer-executable instructions, such as program modules, that may be executed by one or more computers or other devices. Generally, a program module may include one or more routines, programs, objects, components, and/or data structures that may perform one or more particular tasks or that may implement one or more particular abstract data types. It is also to be understood that the number, configuration, functionality, and interconnection of the modules or state machines are merely illustrative, and that the number, configuration, functionality, and interconnection of existing modules may be modified or omitted, additional modules may be added, and the interconnection of certain modules may be altered.

Whereas many alterations and modifications of the present invention will no doubt become apparent to a person of ordinary skill in the art after having read the foregoing description, it is to be understood that the particular embodiments shown and described by way of illustration are in no way intended to be considered limiting. Therefore, reference to the details of the preferred embodiments is not intended to limit their scope.

What is claimed is:

1. A hazard detection system, comprising:

at least one sensor;

a sensor state machine operative to transition to any one of a plurality of sensor states, wherein sensor state machine transitions are based on data acquired by the at least one sensor, a first set of condition parameters, and hush events; and a system state machine operative to transition to any one of a plurality of system states, the system states comprising the sensor states, wherein system state machine transitions are based on the data acquired by the at least one sensor, the hush events, and a second set of condition parameters, and wherein the sensor states shared between the sensor state machine and the system state machine are controlled by the sensor state machine.

2. The hazard detection system of claim 1, wherein the sensor state machine operates independently of the system state machine.

3. The hazard detection system of claim 1, wherein the sensor states comprise an idling state, an alarming state, and an alarm hushing state, and wherein the system states further comprise at least one pre-alarming state and a pre-alarm hushing state.

4. The hazard detection system of claim 1, wherein the sensor states comprise an idling state, a monitoring state, an alarming state, and an alarm hushing state, and wherein the system states further comprise at least one pre-alarming state and a pre-alarm hushing state.

5. The hazard detection system of claim 3, wherein the system states further comprise a monitoring state, a holding state, and an alarm monitoring state.

6. The hazard detection system of claim 4, wherein the system states further comprise a monitoring state, a holding state, and an alarm monitoring state.

7. The hazard detection system of claim 1, wherein the first set of condition parameters comprise:

first condition parameters for controlling a first transition to a first one of the sensor states; and second condition parameters for controlling a second transition to the first one of the sensor states.

8. The hazard detection system of claim 1, wherein the second set of condition parameters comprise:

first condition parameters for controlling a first transition to a first one of the system states; and second condition parameters for controlling a second transition to the first one of the system states.

9. The hazard detection system of claim 1, wherein each of the first and second sets of condition parameters comprises a plurality of sensor data value thresholds and a plurality of time thresholds.

10. The hazard detection system of claim 4, wherein the sensor state machine is a smoke sensor state machine, wherein the system state machine is a smoke system state machine, and wherein the at least one sensor is a smoke sensor.

11. The hazard detection system of claim 10, wherein the first set of condition parameters comprises an adjustable smoke alarm threshold, wherein the smoke sensor state machine transitions to the alarming state when a data value associated with the smoke sensor is one of equal to and greater than the adjustable smoke alarm threshold.

12. The hazard detection system of claim 11, wherein the at least one sensor comprises a carbon monoxide sensor, a heat sensor, and a humidity sensor, and wherein the adjustable smoke alarm threshold changes based on data values associated with the carbon monoxide sensor, the heat sensor, and the humidity sensor.

13. The hazard detection system of claim 4, wherein the smoke system state machine transitions to the at least one pre-alarming state when a data value associated with the smoke sensor is one of equal to and greater than a smoke pre-alarm threshold, and wherein the smoke pre-alarm threshold is less than an adjustable smoke alarm threshold.

14. The hazard detection system of claim 4, wherein the at least one pre-alarming state comprises first and second pre-alarming states, and wherein the smoke system state machine transitions to the second pre-alarming state when a data value associated with the smoke sensor is one of equal to and greater than a smoke pre-alarm threshold and when at least one time condition is satisfied.

15. The hazard detection system of claim 3, wherein the sensor state machine is a carbon monoxide (CO) sensor state machine and the system state machine is a carbon monoxide (CO) system state machine, and wherein the at least one sensor is a carbon monoxide sensor.

16. The hazard detection system of claim 15, wherein the CO sensor state machine maintains a plurality of CO buckets by adding time units to at least one of the CO buckets when first predetermined conditions are met.

17. The hazard detection system of claim 16, wherein the CO sensor state machine transitions to the alarming state when any one of the CO buckets has a time level that exceeds an alarm time threshold for that CO bucket.

18. The hazard detection system of claim 16, wherein the CO system state machine transitions to the at least one pre-alarming state when any one of the CO buckets has a time level that exceeds a pre-alarm time threshold associated with that one CO bucket, and wherein the pre-alarm time threshold for any given CO bucket is less than an alarm time threshold for that same given CO bucket.

19. The hazard detection system of claim 16, wherein the CO sensor state machine further maintains the plurality of CO buckets by subtracting time units from at least one of the CO buckets when second predetermined conditions are met.

20. The hazard detection system of claim 1, further comprising a heat sensor state machine operative to transition to any one of a plurality of heat sensor states, wherein the heat sensor state machine transitions are based on data acquired by the at least one heat sensor, a third set of condition parameters, and hush events.

21. The hazard detection system of claim 20, wherein the heat sensor states comprise an idling state, an alarming state, and an alarm hushing state.

22. A hazard detection system, comprising:

a plurality of sensors comprising a smoke sensor, a carbon monoxide sensor, and a heat sensor;

an alarm;

a speaker;

a first processor communicatively coupled to the plurality of sensors and the alarm, the first processor comprising:

a plurality of sensor state machine operation conditions, the sensor state machine operation conditions comprising a plurality of alarm thresholds, wherein each of the smoke sensor, the carbon monoxide sensor, and the heat sensor is associated with at least one alarm threshold, and wherein the first processor is operative to:

acquire data values from the smoke sensor, the carbon monoxide sensor, and the heat sensor; and activate the alarm in response to determining that a data value associated with at least one of the plurality of sensors is one of equal to and greater than one of the sensor state machine operation conditions; and a second processor communicatively coupled to the first processor and the speaker, the second processor comprising:

a plurality of system state machine operation conditions, the system state machine operation conditions comprising a plurality of pre-alarm thresholds, wherein the second processor is operative to:

receive the acquired data values; and playback a message using the speaker in response to determining that a received data value is one of equal to and greater than one of the system state machine operation conditions.

23. The hazard detection system of claim 22, wherein the at least one threshold alarm associated with the smoke sensor comprises at least one hardcoded smoke alarm threshold and at least two selectable smoke alarm thresholds.

24. The hazard detection system of claim 23, wherein the second processor is operative to:

compare the received data values to alarm threshold setting criteria;

select one of the at least two selectable smoke alarm thresholds based on the comparison; and communicate the selection to the first processor, and wherein the first processor is operative to:

receive the selection from the second processor; and select one of the at least two selectable alarm thresholds in response to the received selection.

25. The hazard detection system of claim 23, wherein the first processor is operative to select the hardcoded smoke alarm threshold as a default smoke alarm threshold.

26. The hazard detection system of claim 24, wherein the alarm threshold setting criteria comprises entry and exit conditions for at least one of the selectable smoke alarm thresholds, and wherein the entry and exit conditions define threshold values for the carbon monoxide sensor, the heat sensor, and a humidity sensor.

27. The hazard detection system of claim 24, wherein the alarm threshold setting criteria define parameters that result in selection of one of the at least two selectable smoke alarm thresholds based on data values acquired from the carbon monoxide sensor, the heat sensor, and a humidity sensor.

28. The hazard detection system of claim 22, wherein the second processor is operative to detect hush events, and wherein a hush event is a user initiation action to silence one of the alaiin and the playback of messages through the speaker.

29. The hazard detection system of claim 28, wherein the second processor is further operative to cease playback of messages in response to the detected hush event.

30. The hazard detection system of claim 28, wherein the second processor is further operative to transmit detected hush events to the first processor, and wherein the first processor is further operative to:

receive the detected hush event from the second processor; and silence the alarm in response to the received hush event when a data value associated with at least one of the plurality of sensors is equal to or greater than one of the sensor state machine operation conditions, wherein the sensor state machine operation condition is an alarm hushing condition.

31. The hazard detection system of claim 22, wherein the first processor is operative to change a sample rate of at least one of the sensors based on the acquired data values.

32. The hazard detection system of claim 22, wherein the first processor functions independently of the second processor and exercises exclusive control over the alarm.

33. The hazard detection system of claim 22, wherein the first processor functions according to one of two modes, wherein, in a first mode, the first processor cooperates with the second processor, and controls the alarm using an alarm threshold set by the second processor, and wherein, in a second mode, the first processor operates independently of the second processor and controls the alarm using an alarm threshold hardcoded within the first processor.

34. The hazard detection system of claim 22, wherein the sensor state machine operation conditions comprises smoke sensor state machine operation conditions, carbon monoxide sensor state machine operation conditions, and heat sensor state machine operation conditions.

35. The hazard detection system of claim 22, wherein the system state machine operation conditions comprise smoke system state machine operation conditions and carbon monoxide system state machine operation conditions.

36. The hazard detection system of claim 22, wherein the first processor is operative to function in a non-sleep state throughout the operational life of the hazard detection system, and wherein the second processor is operative to transition between sleep and non-sleep states throughout the operational life of the hazard detection system.

* * * * *